US012570334B2

(12) United States Patent
Hematian et al.

(10) Patent No.: US 12,570,334 B2
(45) Date of Patent: Mar. 10, 2026

(54) MULTI-UNIT RAILROAD CAR AND RAILROAD CAR TRUCKS THEREFOR

(71) Applicant: NATIONAL STEEL CAR LIMITED, Hamilton (CA)

(72) Inventors: Jamal Hematian, Burlington (CA); Zijian Yan, Oakville (CA)

(73) Assignee: National Steel Car Limited, Hamilton (CA)

( * ) Notice: Subject to any disclaimer, the term of this patent is extended or adjusted under 35 U.S.C. 154(b) by 711 days.

(21) Appl. No.: 17/954,963

(22) Filed: Sep. 28, 2022

(65) Prior Publication Data

US 2024/0101167 A1 Mar. 28, 2024

Related U.S. Application Data

(60) Provisional application No. 63/410,746, filed on Sep. 28, 2022.

(51) Int. Cl.

| | |
|---|---|
| ***B61F 5/38*** | (2006.01) |
| ***B61D 3/10*** | (2006.01) |
| ***B61F 3/12*** | (2006.01) |
| ***B61F 5/30*** | (2006.01) |

(52) U.S. Cl.

CPC ..... *B61F 5/38* (2013.01); *B61D 3/10* (2013.01); *B61F 3/125* (2013.01); *B61F 5/30* (2013.01)

(58) Field of Classification Search

CPC ..... B61F 5/38; B61F 5/40; B61F 5/46; B61F 5/10; B61F 3/125; B61F 5/125; B61D 3/10

See application file for complete search history.

(56) References Cited

U.S. PATENT DOCUMENTS

| | | | | |
|---|---|---|---|---|
| 3,670,660 | A | 6/1972 | Weber et al. | |
| 3,714,905 | A | 2/1973 | Barber | |
| 4,244,298 | A | 1/1981 | Hawthorne et al. | |
| 4,336,758 | A | 6/1982 | Radwill | |
| 5,271,571 | A | 12/1993 | Maynard, Jr. | |
| 7,823,513 | B2 * | 11/2010 | Forbes et al. | B61F 5/38 |
| 8,011,305 | B2 | 9/2011 | Al-Kaabi et al. | |
| 11,807,282 | B2 * | 11/2023 | Hematian et al. | B61F 3/02 |

(Continued)

FOREIGN PATENT DOCUMENTS

| | | |
|---|---|---|
| CA | 2436504 A1 | 2/2004 |
| WO | 2005005219 | 1/2005 |

*Primary Examiner* — S. Joseph Morano

(74) *Attorney, Agent, or Firm* — Hahn Loeser & Parks LLP

(57) ABSTRACT

A symmetrical multi-unit railroad freight car, such as a 3-pack railroad intermodal well car, has body units that are connected symmetrically. The body units have a symmetrical arrangement of end trucks and shared trucks. The end trucks are 70 Ton Trucks. The shared trucks are 125 Ton trucks. The trucks have passive steering using geometric rocker stiffnesses. The rockers in the end trucks have a smaller radius of curvature than the rockers in the shared trucks. The spring groups in the shared trucks are stiffer than the spring groups in the end trucks. The spring groups in the end trucks have a different proportion of damping when empty, a shorter live load range of travel, and greater reserve travel than the shared trucks. The end trucks and the shared trucks have four-cornered damper groups that have the same sized damper wedges. The damper wedges have non-metallic wear pads.

21 Claims, 23 Drawing Sheets

(56) References Cited

U.S. PATENT DOCUMENTS

| | | | | |
|---|---|---|---|---|
| 2003/0041772 | A1 | 3/2003 | Forbes | |
| 2020/0269887 | A1* | 8/2020 | Samarkina et al. ..... | B61F 5/38 |
| 2020/0298893 | A1* | 9/2020 | Herzog et al. ..... | B61D 3/10 |

* cited by examiner

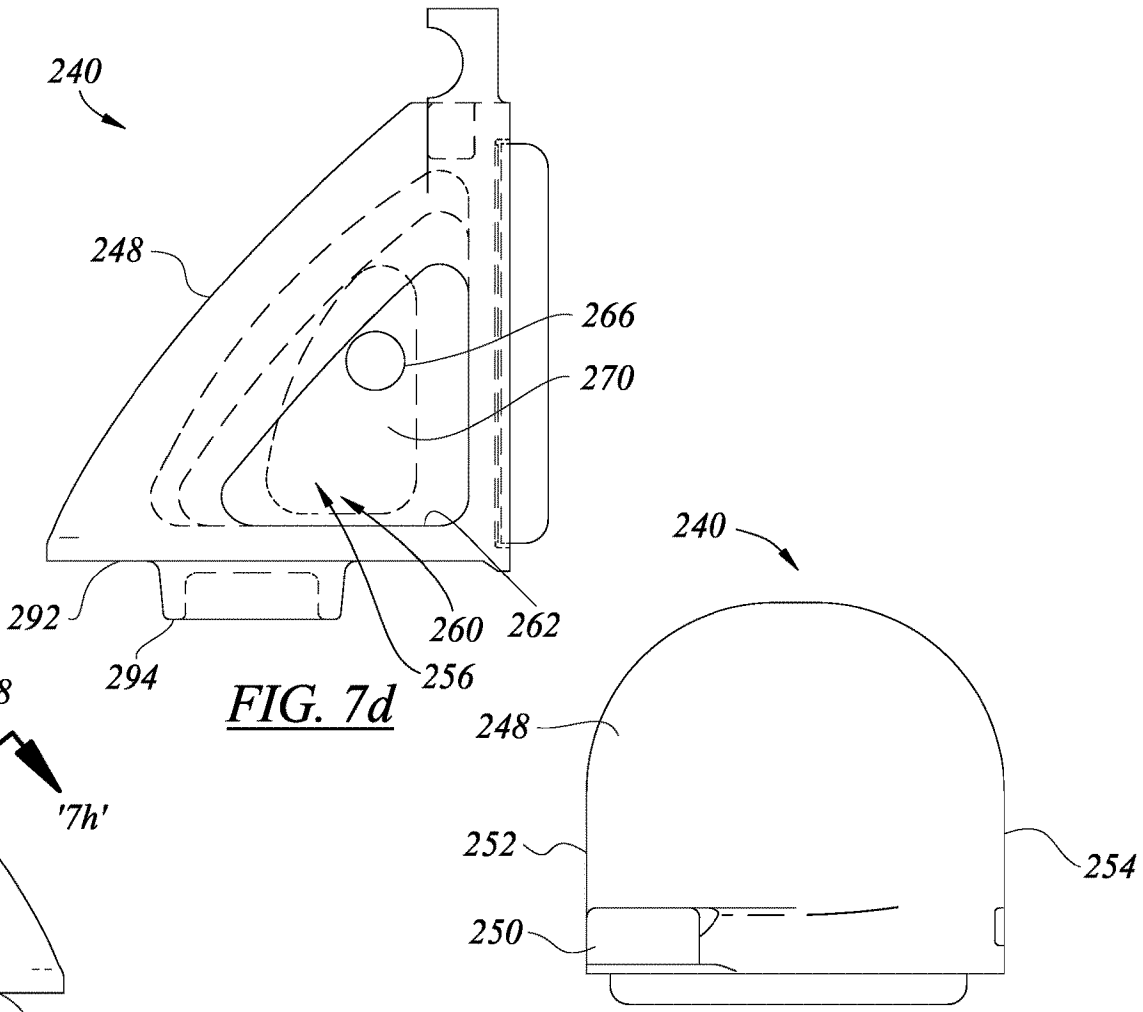
FIG. 7d
FIG. 7e
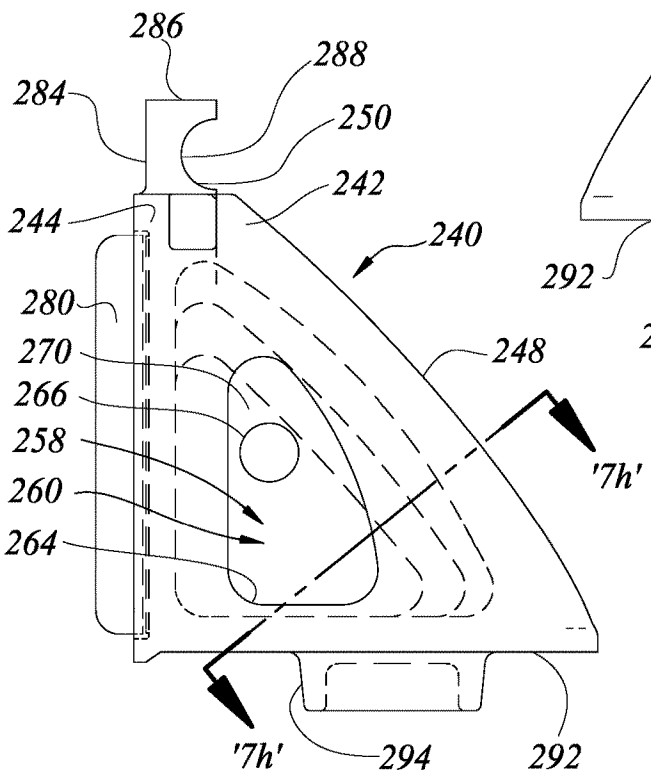
FIG. 7c

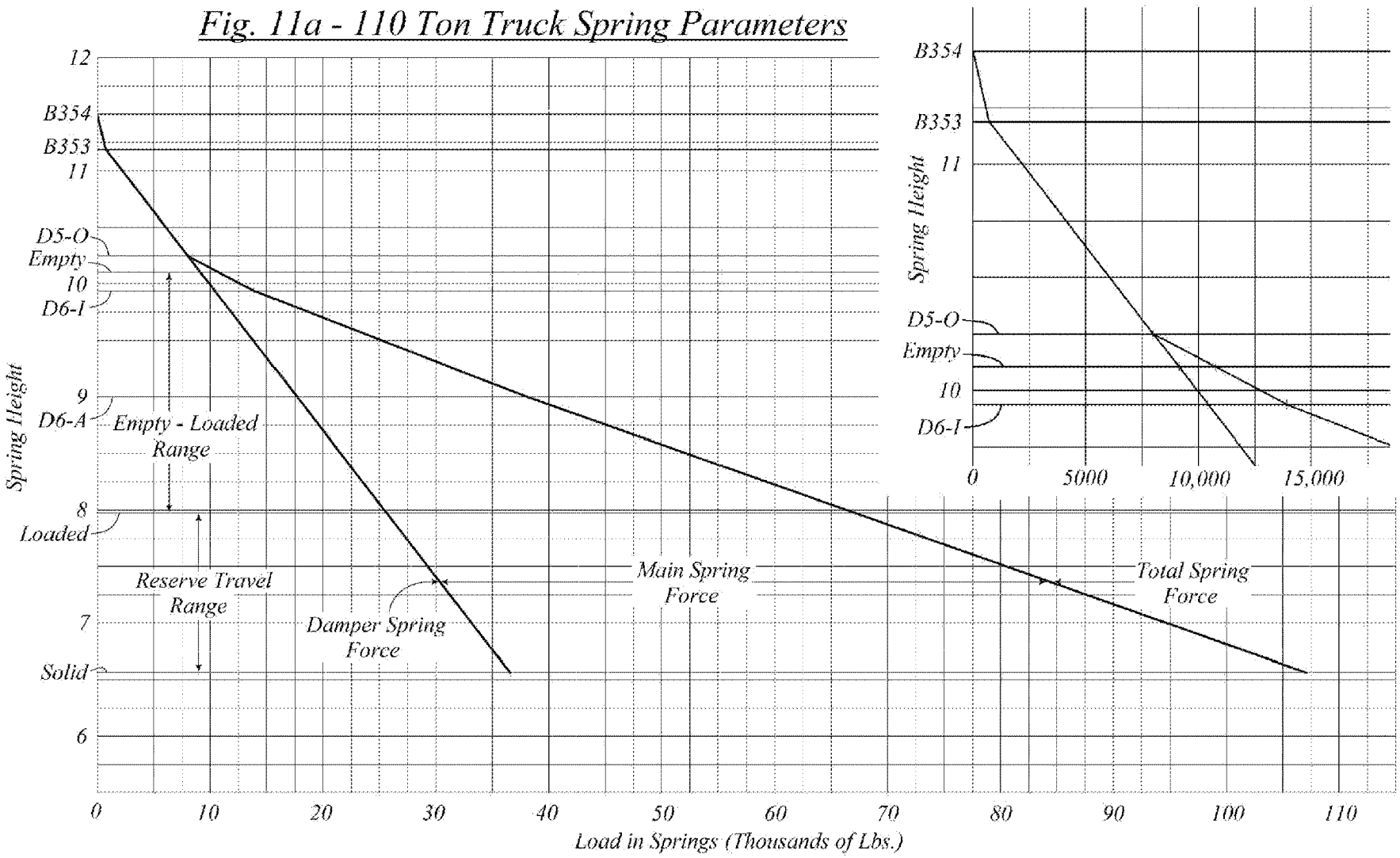
Fig. 11a - 110 Ton Truck Spring Parameters
Spring Height
12
B354
B353
11
D5-O
Empty
10
D6-1
9
D6-A
8
Loaded
7
Solid
6
Empty - Loaded Range
Reserve Travel Range
Main Spring Force
Damper Spring Force
Total Spring Force
0
10
20
30
40
50
60
70
80
90
100
110
Load in Springs (Thousands of Lbs.)
0
5000
10,000
15,000

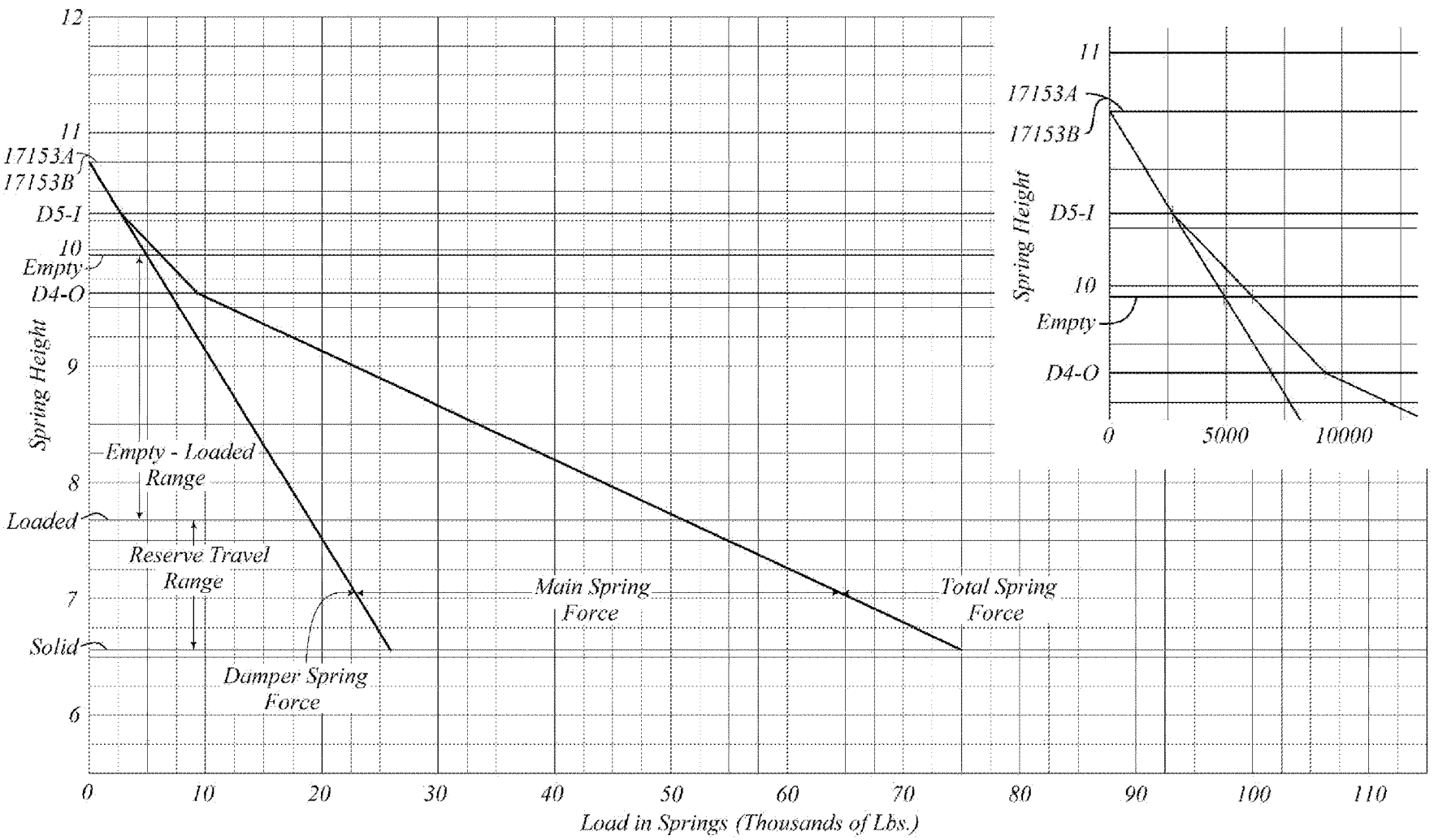
Fig. 11b - 70 Ton Stand Alone Truck Spring Parameters
Spring Height
Load in Springs (Thousands of Lbs.)
17153A
17153B
D5-I
Empty
D4-O
Empty - Loaded Range
Reserve Travel Range
Loaded
Solid
Main Spring Force
Damper Spring Force
Total Spring Force
0
5000
10000
0
10
20
30
40
50
60
70
80
90
100
110
6
7
8
9
10
11
12

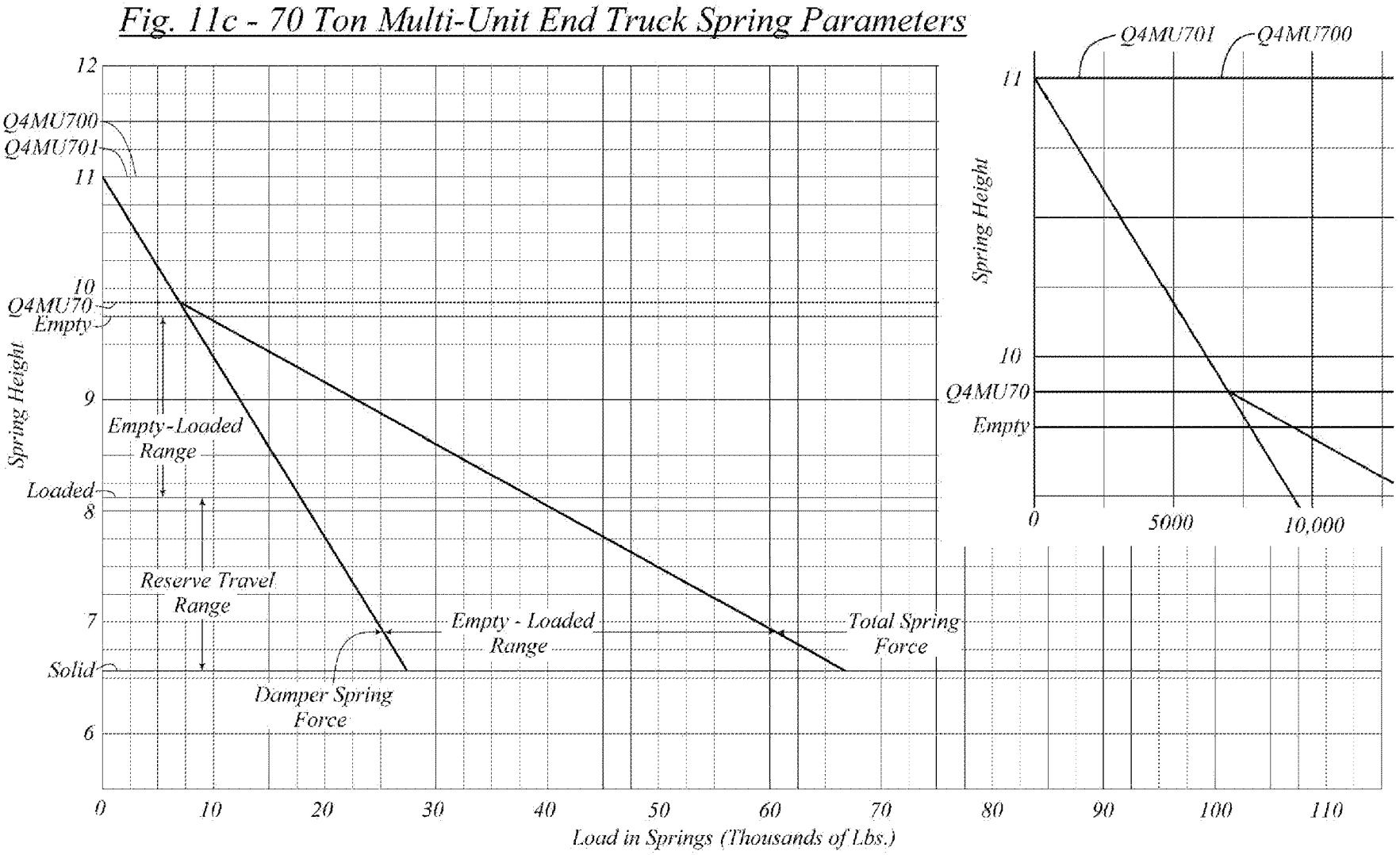
Fig. 11c - 70 Ton Multi-Unit End Truck Spring Parameters

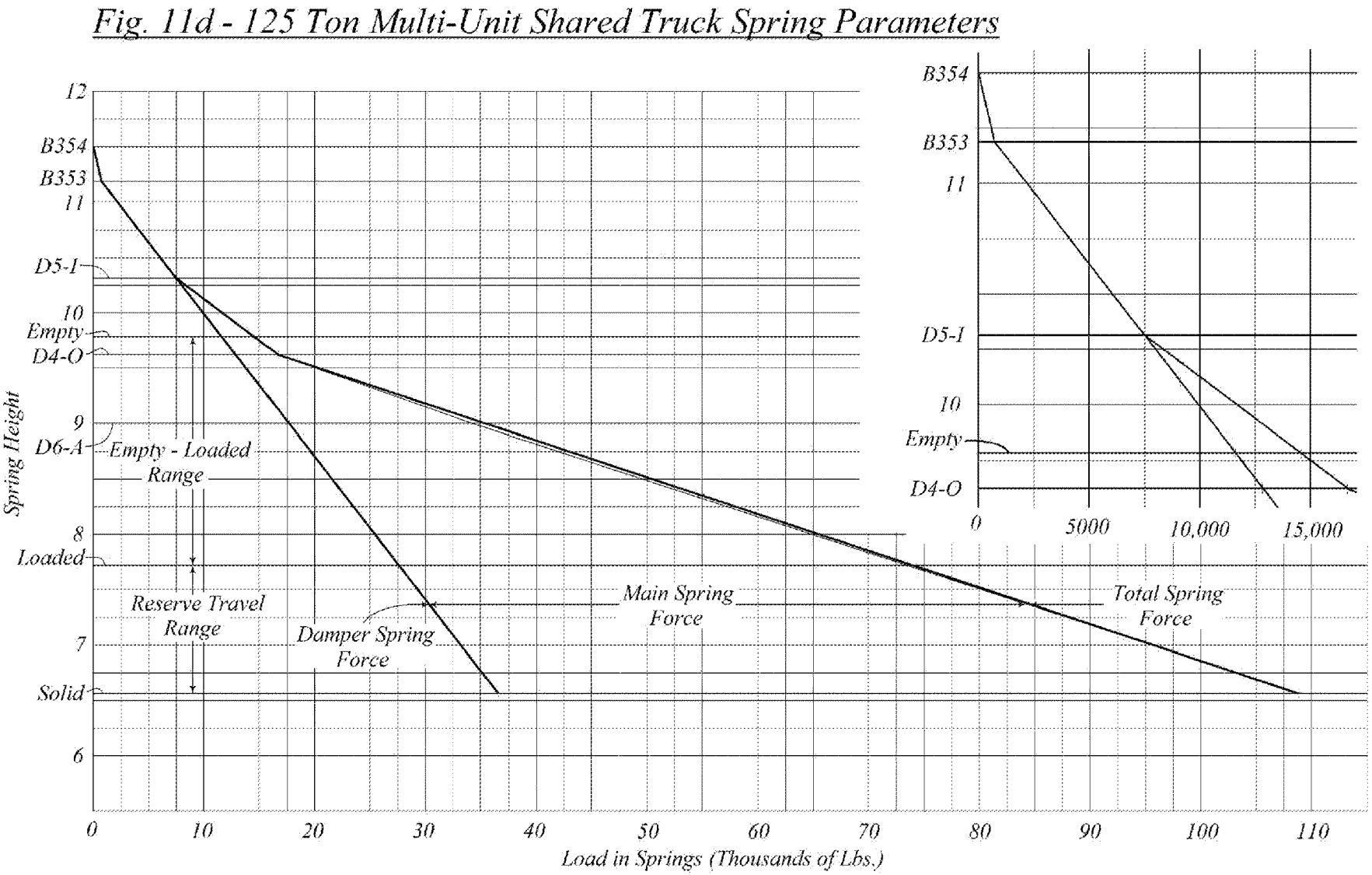
Fig. 11d - 125 Ton Multi-Unit Shared Truck Spring Parameters
Spring Height
Load in Springs (Thousands of Lbs.)
B354
B353
11
D5-1
10
Empty
D4-O
9
D6-A
8
Loaded
7
Solid
6
Empty - Loaded Range
Reserve Travel Range
Main Spring Force
Damper Spring Force
Total Spring Force
0
10
20
30
40
50
60
70
80
90
100
110
5000
10,000
15,000

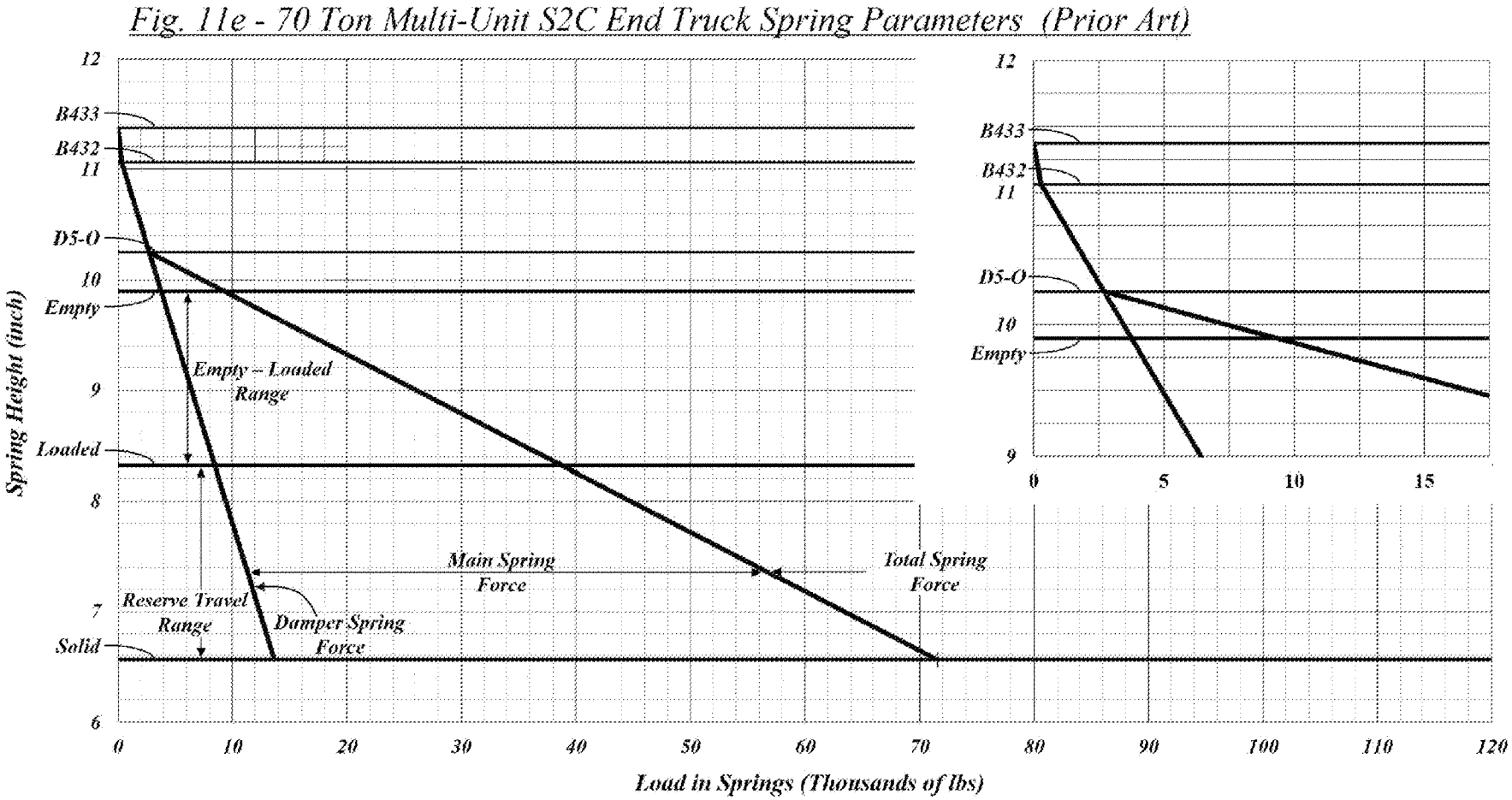
Fig. 11e - 70 Ton Multi-Unit S2C End Truck Spring Parameters (Prior Art)
Spring Height (inch)
Load in Springs (Thousands of lbs)
B433
B432
D5-O
Empty
Loaded
Solid
Empty – Loaded Range
Reserve Travel Range
Main Spring Force
Damper Spring Force
Total Spring Force
12
11
10
9
8
7
6
0
10
20
30
40
50
60
70
80
90
100
110
120
5
15

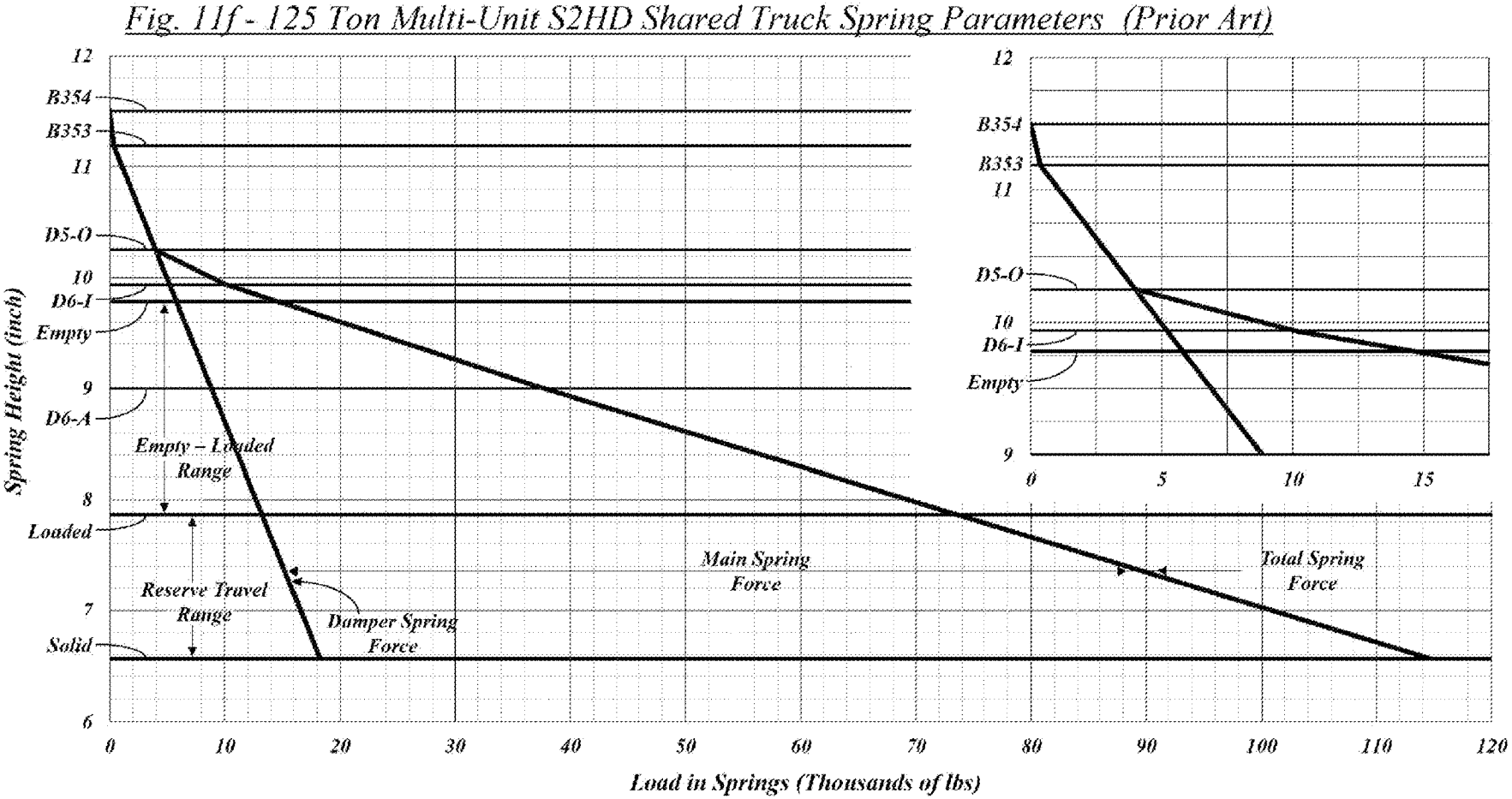
Fig. 11f - 125 Ton Multi-Unit S2HD Shared Truck Spring Parameters (Prior Art)

MULTI-UNIT RAILROAD CAR AND RAILROAD CAR TRUCKS THEREFOR

This Application claims the benefit of priority of U.S. Provisional Patent Application Ser. No. 63/410,746 filed Sep. 28, 2022, the specification and drawings thereof being incorporated in their entirety herein by reference.

FIELD OF THE INVENTION

This invention relates to the field of railroad cars, and, more particularly, to the field of multi-unit articulated railroad freight cars.

BACKGROUND OF THE INVENTION

Railroad freight car ride performance has been a cause of dissatisfaction for many years. Railroad car performance in terms of ride quality can be judged on a number of different criteria. There is longitudinal ride quality, where, often, the limiting condition is the maximum expected longitudinal acceleration experienced during humping or flat switching, or slack run-in and run-out. There is vertical ride quality, for which vertical force transmission through the suspension is a key determinant. There is lateral ride quality, which relates to the lateral response of the suspension. There are also other phenomena, such as truck hunting, the ability of the truck to self steer, and, whatever the input perturbation may be, the ability of the truck to damp out undesirable motion. Evaluation of railroad freight cars may involve tests for establishing the threshold speed and severity of truck hunting; for operation in steady state curving over the performance envelope at various speeds; in rolling resistance when curving, over the performance envelope; in spiral curving; in the twist and roll test; in the pitch and bounce test; in the yawing and swaying test; and in dynamic curving. Performance in these various modes tends to be inter-related, and the optimization of a suspension to deal with one phenomenon may yield a system that may not necessarily provide optimal performance in dealing with other phenomena.

Articulated cars are integrated dynamic systems that include multiple body units, suspensions, and, in the laded condition, containers—which may themselves be full or empty. Articulated railroad cars are complicated, multi-variable, dynamic systems. At the articulation locations, the respective adjacent car body units share a truck. The interaction of the units affects the dynamic behaviour of the whole system. For example, if an end unit is unstable due to lateral accelerations, or it is rolling on one side in spiral curving, it will pass those dynamic responses to the adjacent unit, and the adjacent unit may pass those responses, or some portion of them, to the next adjacent unit, and so on, as may be. The arrangement of the articulations when combined with the dynamic response characteristics of the respective trucks play a key role in determining the dynamic performance of the articulated cars as an overall system. Prediction of the dynamic behaviour of articulated systems is challenging, and even more complicated than those of, for example, stand-alone, single car-body unit freight cars. The Applicant has conducted extensive study and investigation of these systems to look into the effect of changes in various suspension arrangements on the performance of stand-alone freight cars and of articulated well cars.

The Applicant has turned its attention to issues of ride quality in intermodal railroad cars, and, in particular, multi-unit articulated intermodal well cars. These cars are used in high volume, high speed service across North America.

Among the previous efforts made by the Applicant are seen in WO 2005/005219 of Forbes and Hematian; and the Symmetrical Multi-Unit Railroad Car of U.S. Pat. No. 8,011,305 of Al-Kaabi and Hematian.

Railroad cars in North America employ double-axle swivelling trucks known as "three piece trucks" to permit them to roll along a set of rails. The three-piece terminology refers to a truck bolster and pair of first and second side frames. In a three-piece truck, the truck bolster extends cross-wise relative to the side frames, with the ends of the truck bolster protruding through the side frame windows. Forces are transmitted between the truck bolster and the side frames by spring groups mounted in the side frames. The side frames carry forces to the side frame pedestals. The pedestals seat on bearing adapters, from which forces are carried into the bearings, the axle, the wheels, and finally into the tracks.

Among the types of truck discussed in this application are swing motion trucks. An earlier patent for a swing motion truck is U.S. Pat. No. 3,670,660 of Weber et al., issued Jun. 20, 1972. The description that follows describes several embodiments of truck that use damper elements mounted in a four-cornered arrangement at each end of the truck bolster. An earlier patent for dampers is U.S. Pat. No. 3,714,905 of Barber, issued Feb. 6, 1973.

SUMMARY OF THE INVENTION

The present invention, in its various aspects, provides a multi-unit articulated railroad freight car that combines an arrangement of articulated railroad freight car body units mounted on a symmetrical arrangement of end trucks and shared trucks, in which the shared trucks are of greater rated capacity than the end trucks, and in which the trucks have high warp stiffness and have passive self-steering provided by rolling point contact rockers.

In a feature of that aspect of the invention, the shared trucks are transomless swing motion trucks. In another feature, the end trucks are transomless swing motion trucks. In a further feature, the rockers of the shared trucks have a larger male rocker radius of curvature than the corresponding rockers of the end trucks. In a further feature, the shared trucks are larger than 110 Ton trucks. In another feature, the shared trucks are 125 Ton trucks. In another feature, the end trucks are smaller than 110 Ton trucks. In a further feature the end trucks are 70 Ton trucks. In another feature, the shared trucks have a wheel diameter greater than 36". In a further feature the shared trucks have 38" diameter wheels. In another feature the end trucks have a wheel diameter that is smaller than 36". In a further feature the end trucks have a wheel diameter of 33". In another feature the self-steering rockers of the shared trucks have a male rocker radius of curvature greater than 40". In a further feature the shared trucks have a nominal male rocker radius of curvature that is about 50". In another feature, the self-steering rockers of end trucks have a male rocker radius of curvature that is less than 40". In a further feature, the rockers of the end trucks have a radius of curvature that is about 35" inches. In another feature, the end car body units have female articulated connector portions that mate with an associated male portion of the articulated connector of the next adjacent intermediate body units to which the end car body units are connected. In another feature, the end car body units have male articulated connector portions that mate with an associated female articulated connector portion of the next adjacent intermediate car body unit to which they are connected.

In another aspect, there is a multi-unit articulated railroad freight car that has a symmetrical arrangement of car body units carried upon a symmetrical arrangement of three-piece railroad car trucks. The car body units including first, second and third freight car body units. The first car body unit is a first end unit of the freight car. The second car body unit is an intermediate car body unit of the freight car. The third body unit is a second end unit of the freight car. The first body unit has a first end and a second end. The first end of the first body unit is connected to the second body unit at a first shared truck. The second end of the first body unit is distant from the first shared truck. The second end of the first body unit has a coupler operable to connect the multi-unit articulated railroad freight car to be connected to another freight car. The second end of the first body unit is carried on a first end truck. The first shared truck has first and second spring groups. The first shared truck has first and second four-cornered damper groups. The first shared truck has rolling point contact rockers mounted at respective side frame to bearing adapter interfaces, those contact rockers being operable to permit the first shared truck to self-steer. The first end truck has first and second spring groups. The first end truck has first and second four-cornered damper groups. The first end truck has rolling point contact rockers mounted at respective side frame to bearing adapter interfaces to permit the first end truck to self-steer. The rolling point contact rockers of the shared truck having a first radius of curvature. The rolling point contact rockers of the end truck having a second radius of curvature. The first radius of curvature being larger than the second radius of curvature.

In a feature of that aspect, the multi-unit articulated railroad car is a three-unit articulated railroad freight car. In another feature, the symmetrical set of three-piece trucks includes the first end truck, the first shared truck, a second shared truck, and a second end truck. The second end unit is connected to the intermediate unit. The second shared truck is located between the intermediate unit and the second end unit. The second end truck is located under the second end unit at a location distant from the second shared truck. The second shared truck is the same as the first shared truck. The second end truck is the same as the first end truck. In still another feature, the multi-unit articulated railroad freight car is an intermodal well car. In still another feature, the respective four-cornered damper groups of the first end truck and the first shared truck include four respective dampers, each of the four dampers having an alpha angle and a beta angle, two dampers being left-handed, and two dampers being right handed. In still another feature, the alpha angle and the beta angle of dampers of the first end truck are the same as the alpha angle and the beta angle of dampers of the first shared truck. In a feature, the dampers have wedges that have respective working points set rearwardly of their corresponding damper spring centers.

In another feature, each damper has a respective friction face that bears against a side frame column, and is mounted on a respective damper spring, the damper spring having a line of action lying in a datum plane of the damper, the datum plane being normal to the respective friction face. When the railroad freight car is at rest on level track, the damper has a working point located further from the friction face than is the line of action. In a further feature, the damper has a hypotenuse face, the line of action of the spring meets the hypotenuse face at an intersection point, and the working point lies within an inch of the intersection point when the multi-unit railroad car is at rest on level track. In still another feature, the respective damper has a hypotenuse face defining a working surface, the working surface has a spherical curvature, and the working point lies on the spherical curvature.

In yet another feature, the spherical curvature of the hypotenuse face of the damper wedge has a radius of less than 40". In another feature the spherical curvature has a radius of curvature, and the radius of curvature is about 20". In still another feature, the dampers of the respective four-cornered damper arrangements of the first end truck have the same spherical curvature as the dampers of the respective four-cornered damper arrangements of the first shared truck. In another feature, the respective four-cornered damper arrangement of the first end truck has the same damper geometry as the respective four-cornered damper arrangement of the first shared truck. In another feature, the first end truck has bearing adapters having rolling contact rockers having a radius of curvature less than 40 inches. In still another feature, the radius of curvature of the bearing adapters of the first end truck is approximately 35 inches. In yet another feature, the first shared truck has bearing adapters having rolling contact rockers having a radius of curvature of the first shared truck is greater than 40 inches. In a still further feature, the radius of curvature of the rolling contact rockers of the bearing adapters of the shared truck are approximately 50 inches. In another feature, the first shared truck has a vertical spring rate $k_s$; the first end truck has a vertical spring rate $k_e$; $k_s$ is greater than $k_e$; $k_s$ is less than twice $k_e$. In a still further feature, the first end truck is a 70 Ton truck and the first shared truck is a 125 Ton truck.

In another aspect there is a multi-unit articulated railroad freight car that has a set of railroad car body units carried on a set of railroad car trucks. The set of railroad car trucks includes first and second end trucks and at least a first shared truck. In a plurality of different aspects starting from that base there is (a) in one aspect, the set of rail car body units includes at least a first end car body unit, and the first end car body unit is nose up in a fully loaded condition; (b) in another aspect, the first end car truck has a higher empty car spring height than does the first shared truck; (c) in a further aspect, the first end car truck has a smaller range of vertical spring travel between empty car and loaded car conditions than does the first shared truck; (d) in still another aspect, the first end car truck has a larger range of vertical spring reserve travel than does the first shared truck; (e) in still another aspect, the first end car truck has a higher vertical first mode natural frequency than does the first shared truck; (f) in yet another aspect, in the empty car condition the first end car truck has a larger ratio of vertical static damper force: vertical static load than does the first shared truck; (g) is still yet another aspect, in the empty car condition the first end car truck has a larger ratio of vertical static damper force: vertical static main spring load than does the first shared truck; and (h) in still yet another aspect, in the empty car condition, the first end car truck has a smaller ratio of vertical static load:vertical spring rate than does the first shared truck.

In a feature of any of those aspects, the first shared truck has a capacity greater than a 110 Ton truck and the first and second end trucks have respective capacities less than a 110 Ton Truck. In another feature of any of them, the first shared truck is a 125 Ton Truck and the first and second end car trucks are 70 Ton trucks. In still yet another feature, the first shared truck and the first and second end trucks are self-steering trucks. In a yet further feature, the first shared truck has a self-steering apparatus that has a first geometric steering rocker stiffness and the first and second end trucks each have a second geometric steering rocker stiffness; the first geometric steering rocker stiffness has a first rocker curvature, the second geometric steering rocker has a second rocker curvature; and the second rocker curvature has a smaller radius of curvature than the first rocker curvature. In again another feature, the multi-unit articulated railroad freight car has a symmetrical arrangement of trucks that includes the first and second end trucks and the first shared truck. In another feature of that aspect, the first and second end trucks and the first shared truck have respective four-cornered friction damper groups. In still another feature, the dampers of the damper groups have respective hypotenuse faces formed on a spherical radius and defining a working point that cooperates with an inclined bolster pocket surface.

In still another feature of any of those aspects of the invention, the set of articulated car body units is a symmetrical set of car body units, and the set of trucks is a symmetrical arrangement of three-piece railroad car trucks. The set of articulated car body units includes first, second and third freight car body units. The first freight car body unit is a first end body unit of the freight car. The second car body unit is an intermediate car body unit of the freight car. The third body unit is a second end body unit of the freight car. The first body unit has a first end and a second end. The first end of the first body unit is connected to the second body unit at the first shared truck. The second end of the first body unit is distant from the first shared truck. The second end of the first body unit has a coupler operable to connect the multi-unit articulated railroad freight car another freight car. The second end of the first body unit is carried on a first end truck. The first shared truck has first and second spring groups. The first shared truck has first and second four-cornered damper groups. The first shared truck has rolling point contact rockers mounted at respective side frame to bearing adapter interfaces operable to permit the first shared truck to self-steer. The first end truck has first and second spring groups. The first end truck has first and second four-cornered damper groups. The first end truck has rolling point contact rockers mounted at respective side frame to bearing adapter interfaces to permit the first end truck to self-steer. The rolling point contact rockers of the shared truck has a first radius of curvature. The rolling point contact rockers of the end truck has a second radius of curvature. The first radius of curvature is larger than the second radius of curvature.

In another feature of any of those aspects, the multi-unit articulated railroad car is a three-unit articulated railroad freight car. The symmetrical arrangement of three-piece trucks includes the first end truck, the first shared truck, a second shared truck, and the second end truck. The second end unit is connected to the first intermediate unit. The second shared truck is located between the intermediate unit and the second end unit. The second end truck is located under the second end unit at a location distant from the second shared truck. The second shared truck is the same as the first shared truck. The second end truck is the same as the first end truck.

In any of the foregoing aspects and features, in an additional feature the multi-unit articulated railroad freight car is an intermodal well car. Also in any of the foregoing aspects and features, the respective four-cornered damper groups of the first end truck and the first shared truck include four respective dampers, each of the four dampers has an alpha angle and a beta angle, two of the dampers are left-handed, and two of the dampers are right handed; and the alpha angle and the beta angle of dampers of the first end truck are the same as the alpha angle and the beta angle of dampers of the first shared truck.

In another feature, each of the dampers has a respective friction face that bears against a side frame column, and is mounted on a respective damper spring. The damper spring has a line of action lying in a datum plane of the damper. The datum plane is normal to the respective friction face. When the railroad freight car is at rest on level track, the damper has a working point located further from the friction face than is the line of action. In a further feature, the friction face has a non-metallic friction pad mounted thereto. In another feature, the damper has a hypotenuse face, the line of action of the spring meets the hypotenuse face at an intersection point, and the working point lies within an inch of the intersection point when the multi-unit railroad car is at rest on level track.

In still another feature the respective damper has a hypotenuse face defining a working surface, the working surface has a spherical curvature, and the working point lies on the spherical curvature. In a further feature the spherical curvature of the hypotenuse face has a radius of curvature that is 20 inches, +5/−0. In another feature, the dampers of the respective four-cornered damper arrangements of the first end truck have the same spherical curvature as the dampers of the respective four-cornered damper arrangements of the first shared truck. In a yet further feature, the respective four-cornered damper arrangement of the first end truck has the same damper geometry as the respective four-cornered damper arrangement of the first shared truck. In another feature, the first end truck has bearing adapters has rolling contact rockers has a radius of curvature less than 45 inches. In a further feature, the radius of curvature of the bearing adapters of the first end truck is approximately 35 inches. In still another feature, the first shared truck has bearing adapters has rolling contact rockers has a radius of curvature of the first shared truck is greater than 40 inches. In yet another feature, the radius of curvature of the rolling contact rockers of the bearing adapters of the shared truck are approximately 50 inches. In another feature, the first shared truck has a vertical spring rate $k_s$; the first end truck has a vertical spring rate $k_e$; $k_s$ is greater than $k_e$; $k_s$ is less than twice $k_e$. In a yet further feature, the first end truck is a 70 Ton truck and the first shared truck is a 125 Ton truck.

In another aspect, there is a multi-unit articulated railroad freight car that has a set of rail car body units carried on a set of railroad car trucks. In the static loaded condition the articulated railroad freight car has at least one nose up end car body unit. In another aspect, there is a multi-unit articulated railroad freight car that has a set of rail car body units carried on a set of railroad car trucks. The set of railroad car trucks includes first and second end trucks and at least a first shared truck. The first end truck has a higher empty car spring height than does the first shared truck. In a further aspect, there is a multi-unit articulated railroad freight car that has a set of rail car body units carried on a set of railroad car trucks. The set of trucks includes first and second end trucks and at least a first shared truck. The first end truck has a smaller range of vertical spring travel between empty car and loaded car conditions than does the first shared truck. In still another aspect there is a multi-unit articulated railroad freight car that has a set of rail car body units carried on a set of railroad car trucks. The set of railroad car trucks includes first and second end trucks and at least a first shared truck. The first end car truck has a larger range of vertical spring reserve travel than does the shared truck. In a still further aspect, there is a multi-unit articulated railroad freight car that has a set of rail car body units carried on a set of railcar trucks. The set of railcar trucks includes first and second end trucks and at least a first shared truck.

The first end truck has a higher vertical first mode natural frequency than does the first shared truck. In yet another aspect there is a multi-unit articulated railroad freight car that has a set of rail car body units carried on a set of trucks. The set of trucks includes first and second end trucks and at least a first shared truck. In the empty car condition the first end car truck has a larger ratio of vertical static damper force:vertical static load than does the first shared truck. In another aspect, there is a multi-unit articulated railroad freight car that has a set of rail car body units carried on a set of trucks. The set of railroad car trucks includes first and second end trucks and at least a first shared truck. In the empty car condition the first end car truck has a larger ratio of vertical static damper force:vertical static main spring load than does the first shared truck. In another aspect, there is a multi-unit articulated railroad freight car that has a set of rail car body units carried on a set of railroad car trucks. The set of railroad car trucks includes first and second end trucks and at least a first shared truck. In the empty car condition, the first end truck has a smaller ratio of vertical static load:vertical spring rate than does the first shared truck.

In another aspect, there is a multi-unit articulated railroad freight car. It has at least a first car body unit and a second body unit. The first car body unit is an end car body unit. There is a first shared truck mounted between the first car body unit and the second car body unit. There is a first end truck mounted under the first car body unit distant from the first shared truck. The end car body unit is nose up relative to the second car body unit when the articulated railroad freight car is loaded.

These and other aspects and features of the invention may be understood with reference to the detailed descriptions of the invention and the accompanying illustrations as set forth below.

BRIEF DESCRIPTION OF THE FIGURES

The principles of the invention may better be understood with reference to the accompanying figures provided by way of illustration of an exemplary embodiment, or embodiments, incorporating principles and aspects of the present invention, and in which:

FIG. 7*c* is a large side view of the damper wedge of FIG. 7*a;*

FIG. 7*d* is a small side view of the damper wedge of FIG. 7*a;*

FIG. 7*e* is a top view of the damper wedge of FIG. 7*a;*

FIG. 11*a* shows the spring-deflection traits of a 110 Ton truck;

FIG. 11*b* shows the spring-deflection traits a 70 Ton stand alone truck for use in a stand alone freight car;

FIG. 11*c* shows the spring-deflection traits of a 70 Ton articulated end truck as used in the multi-unit articulated railroad freight cars of FIG. 1*a*; and FIG. 11*d* shows the spring-deflection traits of a 125 Ton shared truck as used in the multi-unit articulated railroad freight car of FIG. 1*a*.

FIG. 11*e* shows the spring-deflection traits of a 70 Ton Barber S2C articulated end truck as used in articulated railroad freight cars prior to the truck of FIG. 1*a*; and FIG. 11*f* shows the spring-deflection traits of a 70 Ton Barber S2HD articulated end truck as used in articulated railroad freight cars prior to the truck of FIG. 1*a*.

DETAILED DESCRIPTION

Figure 1A:
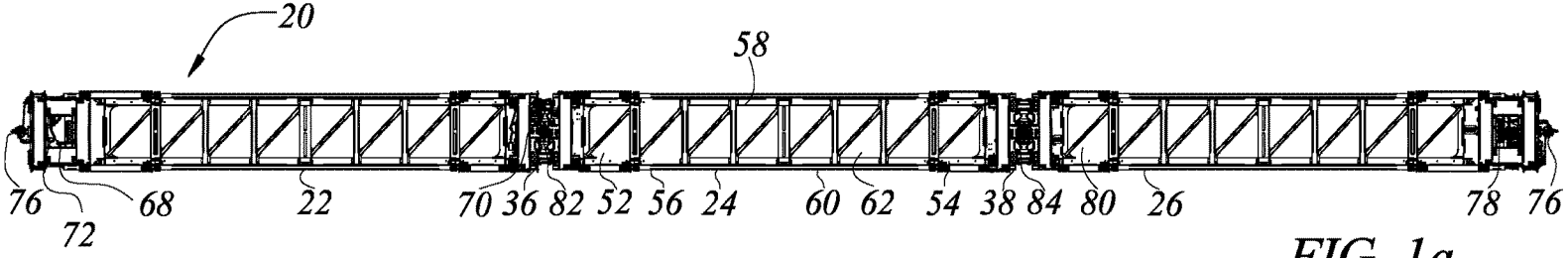
FIG. 1*a* is a general arrangement top view of a multi-unit railroad well car.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the railroad cars and railroad car trucks described herein, the longitudinal, or lengthwise, direction is defined as being coincident with the rolling direction of the railroad car, or railroad car unit, when located on tangent (that is, straight) track. In the case of a railroad car having a center sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit. The term "longitudinally inboard", or "longitudinally outboard" is a distance taken relative to a mid-span lateral section of the car, or car unit. Pitching motion is angular motion of a rail car unit about a horizontal axis perpendicular to the longitudinal direction. Yawing is angular motion about a vertical axis. Roll is angular motion about the longitudinal, or lengthwise, axis. When reference is made to the "at rest" condition, it pertains to a car that sits motionless, on track that is straight and level. Unless otherwise indicated, railroad cars herein are made of steel, typically mild steel. Major truck components such as the truck bolster and side frames may be taken as being steel castings. The common engineering terms "proud", "shy" and "flush" may be use in this description in relation to parts of components that protrude, that are recessed, or that stand in line with neighbouring items, the three terms being conceptually similar to the conditions of "greater than", "less than" and "equal to" respectively.

This description discusses to rail car trucks and truck components. Several Association of American Railroads (AAR) standard truck sizes are listed at page 711 in the 1997 *Car & Locomotive Cyclopedia*. As indicated, for a single unit, stand alone, rail car having two trucks, a "40 Ton" truck rating corresponds to a maximum gross rail load (GRL) of 142,000 lbs. Similarly, "50 Ton" corresponds to 177,000 lbs., "70 Ton" corresponds to 220,000 lbs., "100 Ton" corresponds to 263,000 lbs., and "125 Ton" corresponds to 315,000 lbs. In each case the load limit per truck is then half the maximum GRL. Two other types of truck are the "110 Ton" truck for rail cars having a 286,000 lbs. GRL and the "70 Ton Special" low profile truck sometimes used for auto rack cars. The various "40 Ton", "50 Ton", "70 Ton", "100 Ton", "110 Ton" and "125 Ton" nomenclature for truck sizes presume use in "stand alone" railroad cars. A "stand alone" railroad car is one having a single car body with a pair of first and second trucks at either end, joined to other cars using releasable couplers. A "stand alone" rail car is to be contrasted with a multi-unit rail car. Multi-unit railroad cars are railroad cars that have multiple car bodies permanently joined together. One kind of multi-unit railroad car employs substantially slackless draw-bars that permanently join adjacent car-bodies together. Another kind of multi-unit railroad car is the articulated railroad car, such as described herein, in which there are multiple car bodies that are joined together by articulated connectors over a shared truck, in which the base of the articulated connector sits on the truck bolster of the shared truck. In this description, the term "articulated connector" is intended to mean a substantially permanent connector such as may tend only to be taken apart during fabrication or repair of a rail car, and that is mounted between car body units of a multi-unit articulated rail car, as distinct from a releasable coupler, such as a Janney coupler, that used to release and re-connect cars as an ordinary incident of shunting cars to assemble or disassemble a train consist in a railyard.

Given that, leaving aside secondary structure such as safety appliances, stand-alone railroad cars and railroad car trucks tend to have both longitudinal and transverse axes of symmetry of major structural and dynamic, a description of one half of an assembly may generally also be intended to describe the other half as well, allowing for differences between right-hand and left-hand parts. To avoid needless description of multiple variations, permutations and combinations of embodiments, this specification incorporates by reference all permutations shown and described in WIPO publication WO 2005/005219.

This application refers to friction dampers for railroad car trucks, and multiple friction damper systems. There are several types of damper arrangements, some being shown at pp. 715-716 of the 1997 *Car and Locomotive Cyclopedia*, those pages being incorporated herein by reference. Double damper arrangements are shown and described US Patent Application Publication No. US 2003/0041772 A1, Mar. 6, 2003, entitled "Rail Road Freight Car With Damped Suspension", and also incorporated herein by reference. Each of the arrangements of dampers shown at pp. 715 to 716 of the 1997 *Car and Locomotive Cyclopedia* can be modified to employ a four-cornered, double damper arrangement of inner and outer dampers in conformity with the principles of aspects of the present invention.

In terms of general nomenclature, damper wedges tend to be mounted within an angled "bolster pocket" formed in an end of the truck bolster. In cross-section, each wedge may then have a generally triangular shape, one side of the triangle being, or having, a bearing face, a second side which might be termed the bottom, or base, forming a spring seat, and the third side being a sloped side or hypotenuse between the other two sides. The first side may have a substantially planar bearing face for vertical sliding engagement against an opposed bearing face of one of the side frame columns. The second face may not be a face, as such, but rather may have the form of a socket for receiving the upper end of one of the springs of a spring group. Although the third face, or hypotenuse, may appear to be generally planar, it may tend to have a slight crown. The end faces of the wedges may be generally flat, and may have a coating, surface treatment, shim, or low friction pad to give a smooth sliding engagement with the sides of the bolster pocket, or with the adjacent side of another independently slidable damper wedge, as may be.

During rail car operation, the side frame may tend to rotate, or pivot, through a small range of angular deflection about the end of the truck bolster to yield wheel load equalisation. The slight crown on the slope face of the damper may tend to accommodate this pivoting motion by allowing the damper to rock somewhat relative to the generally inclined face of the bolster pocket while the planar bearing face remains in planar contact with the wear plate of the side frame column. Although the slope face may have a slight crown, for the purposes of this description it will be described as the slope face or as the hypotenuse.

In the terminology herein, wedges have a primary angle $\alpha$, being the included angle between (a) the sloped damper pocket face mounted to the truck bolster, and (b) the side frame column face, as seen looking from the end of the bolster toward the truck center. In some embodiments, a secondary angle may be defined in the plane of angle $\alpha$, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper. The secondary angle $\beta$ is defined as the lateral rake angle seen when looking at the damper parallel to the plane of angle $\alpha$. As the suspension works in response to track perturbations, the wedge forces acting on the secondary angle $\beta$ may tend to urge the damper either inboard or outboard according to the angle chosen.

This specification is written in the context of the dynamic performance of articulated railroad cars that employ self-steering railroad car trucks. That dynamic performance is a function of several factors. First, it is a function of the interaction of the multiple car bodies that have been joined together. Second, it is a function of truck performance Truck performance is, itself, largely a function of dynamic performance at a first interface, namely the interface between the wheelset bearing adapters and the side frame pedestal seats; and at a second interface, namely the interface between the bolster ends and the side frames. Accordingly, this document will first describe the features of a multi-unit articulated railroad freight car; then it will describe the wheelset bearing adapter to side frame interface; and it will follow with a description of the interface between the four-cornered damper arrangements at the ends of the truck bolster and the side frame windows.

Description of Multi-Unit Railroad Freight Car

This description discusses articulated railroad freight cars. Articulated multi-unit railroad cars typically have at least two rail car units permanently joined to each other end-to-end at an articulation connection. The adjoining rail car units share a truck, with the articulated connector being mounted over the truck center. A common form of articulated railroad car is the "three-pack", such as railroad car 20 in FIGS. 1*a* and 1*b*, that has two end units (an "A" end, e.g., end unit 22; and a "B" end, e.g., end unit 26) and a middle unit located between them (e.g., intermediate body unit 24). Another form of articulated railroad car is the "five-pack", such as car 110 in FIGS. 2*a* and 2*b*. It has two end units 22, 26 and three intermediate units 24 located between end units 22, 26. In some embodiments, five-pack car 110 may have a symmetrical arrangement of car body units in respect of the male and female articulated connectors mounted to the various car bodies. One known use of three-pack and five-pack articulated railroad cars is as intermodal well cars, of which car 20 as shown is an example, that are used to transport intermodal shipping containers. They are usually "double stack" cars that allow one level of containers to seat in the bottom of the well, and a second level of containers to sit on top of them. An "end unit" is a car body unit that has a truck center, draft sill, draft gear, and a coupler 76 at one end (the "coupler end"); and an articulated connector 82 and a pair of side bearing arms 100, 102 at the other (the articulation end). At the coupler end there is an "end truck", such as end truck 28, 30 that is mounted under the truck center. At the articulated end, the articulated connector and the side bearing arms are mounted to a truck that is located between the end unit car body and the next adjacent car body unit. This is the "shared truck", such as shared truck 32, 34. A shared truck may also be referred to as an intermediate truck, given that each shared truck is intermediate two adjacent car body units, and is also intermediate in not being an end truck.

In a three-unit articulated railroad car there are four trucks, namely two end trucks 28, 30 mounted at the respective coupler ends of the end units 22, 26; and two shared trucks 32, 34 mounted between the respective articulated ends of the end units 22, 26 and the associated ends of the intermediate car body unit 24. As noted, in a five-unit articulated railroad car there are three intermediate car body units 24. They are connected together at articulated connectors 82 and shared trucks, with end units 22, 26 located at their respective ends.

As noted, the ends of intermediate car body unit 24 have articulated connector ends at both ends. Those ends are joined to respective adjacent ends of end car body units 22, 26 by articulated connectors 82. Articulated connector 82 includes a female articulated connector portion, or socket 86, mounted to one rail car unit; and an opposing mating male articulated connector portion or member 88, mounted to the next adjacent rail car unit. On installation, the female articulated connector portion 86 has a housing with a base, or center plate 90 that sits in the center plate bowl 48 of the shared truck 32, 34. The male articulated connector portion 88 has a tongue that seats inside the housing. There may be a vertical pin 92 at the truck center that locks them together, as in FIG. 4.

Prior to work by the Applicant, intermediate rail car units in three-unit railroad cars had an asymmetric arrangement of articulated connector portions, that is, the intermediate car body unit has a female articulated connector portion at one end and a male articulated connector portion at the opposite end. Correspondingly, the end rail car units had counterpart male or female articulated connector portions, as the case was. In that style of layout, all female articulated connector portions extended toward the same end of the three-unit railroad car.

To control "side sway", or roll, (i.e., rotation about the long axis of the rail car unit) of one rail car unit relative to the next adjacent rail car unit, at each end that has an articulated connector each rail car unit has a pair of side-bearing arms. These arms engage the side bearings that are mounted to the truck bolster of the shared truck. As shown, the respective pairs of side-bearing arms oppose each other in a middle, or "neutral" position in which the arms on each side of the articulated connector are spaced apart the same distance.

The ride characteristics in an asymmetric three-unit railroad car tended to vary depending on the direction of travel. The cars tended to perform "better" in one direction of travel than in the other, particularly when running over curved track. It was further noted that the wheels of the shared trucks tended to be subject to greater lateral forces when the car was travelling in the direction associated with less satisfactory performance. It was thought that in addition to causing uneven wear on the truck wheels, this also tended to increase the likelihood that the wheels would ride up on the rail, and jump the track.

The propensity of the wheels to ride up on the rail may be considered to be a function of the L/V ratio, where L is the lateral force to which the truck wheels are subject and V is the vertical force carried by the truck wheels. The higher the L/V value, the greater may be the likelihood that the truck wheels may tend to ride against the rail when the car negotiates a curve in the track. Accordingly, lower L/V values for the truck wheels may tend generally to be desirable. However, in a conventional railroad car of the type described above, i.e., an asymmetric three-unit railroad car, under certain circumstances the L/V values for the truck wheels may be significantly greater in one direction than the other. This may tend adversely to affect the stability of the car and may tend to generate undesirable vibration throughout the car structure. This in turn may ultimately lead to crack propagation and failure in the car, and consequently to costly car maintenance and repair. In addition, when travelling over a curved portion of track, the side-bearing arms in some of these cars may be subject to undesirably high forces further encouraging vibration in the car structure.

The difference in dynamic performance of the railroad cars may tend to be more (or less) pronounced depending on variation of the frequency of the input perturbances. That is, performance may tend to be a function of frequency and evaluation of the various alternatives may require optimization over the full range of forcing frequencies associated with in-service operation. It has been noted above that dynamic performance may be "better" in one direction than another. The term "better" needs to be understood in the expected operational life. An arrangement that may provide good performance at one frequency, may provide poor performance at another, such that, overall, it may be inferior to another layout that produces moderately good performance across the spectrum. In that context, the assessment of "better", is an overall performance evaluation.

These observations were also thought not to be restricted to three-unit cars. Other multi-unit articulated railroad cars having a larger number of rail car units may also tend to demonstrate similar dynamic performance phenomena. Accordingly, the Applicant developed symmetrical articulation arrangements in multi-unit articulated railroad cars with the objective of having similar ride performance characteristics in both travel directions.

More recently, as observed by the Inventor, the end units of articulated railroad cars have been observed to have a poorer overall performance than the middle units.

In accordance with the foregoing general commentary, a three-unit articulated railroad car is seen in FIGS. 1*a* to 1*d* as 20. Car 20 is a multi-unit articulated railroad freight car, such as a COFC or TOFC flat car, or a spine car, or, as shown in FIGS. 1*a* to 1*d*, a three-pack articulated well car, but it could be another type of railroad freight car, such as an auto-rack car, a gondola car, a center-beam car, a box car. It has a first rail car end car body unit 22, an intermediate, or middle, rail car body unit 24 and a second rail car end car body unit 26, arranged end-to-end. Car 20 is carried on shared trucks 32 and 34, and end car trucks 28 and 30. End units 22 and 26 are each joined to intermediate unit 24 at an articulated connection 36 or 38, as the case may be. First and second articulated connections 86 are mounted at articulated connections 36, 38 directly over shared trucks 32 and 34, respectively. That is, the centre line of the articulated connection is co-incident with the respective truck centres of those shared trucks.

Figure 3A:
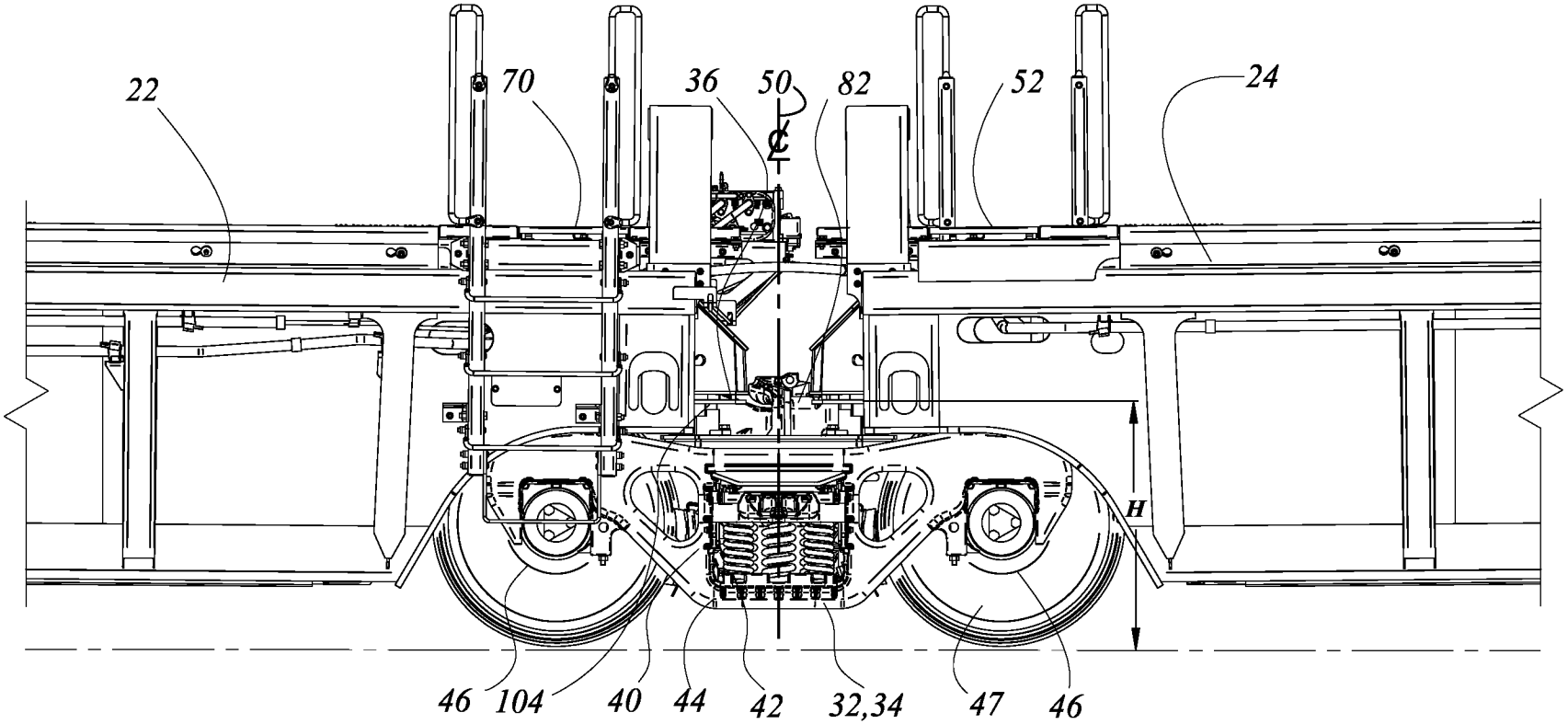
FIG. 3*a* is an enlarged side view of a portion of the railroad car of FIG. 1*a*, showing an articulated connection between an intermediate unit and an adjacent end unit.
Figure 3B:
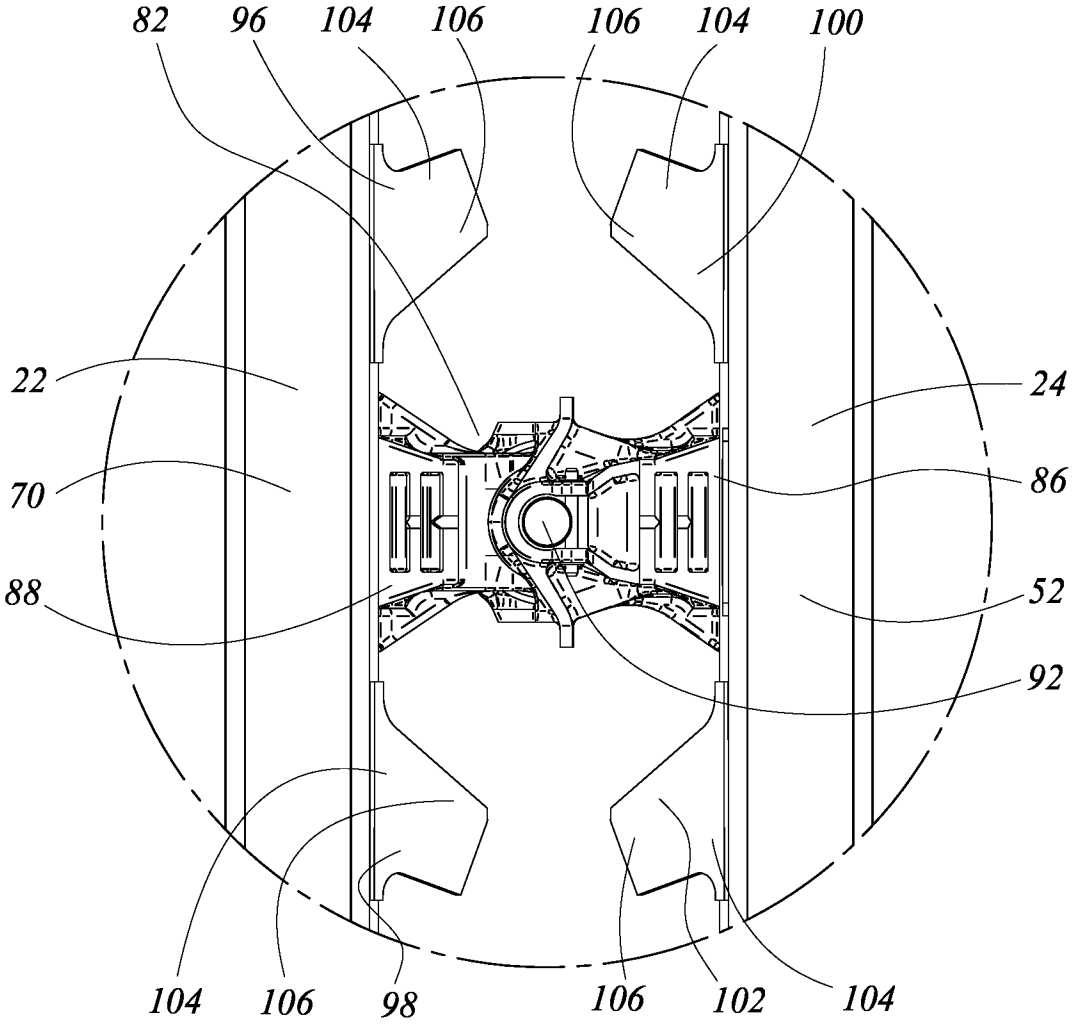
FIG. 3*b* is a top view of the portion of the three-unit articulated railroad car of FIG. 3*a* showing a pair of side bearing arms.

Shared trucks 32 and 34 are double axle, swivelling, three-piece trucks, such as symbolized by truck 160 of FIGS. 5*a*-5*d*. Trucks 32, 34 includes the common features of truck 160 such as a horizontal, transversely oriented truck bolster 40 supported on springs 42, and a pair of side frames 44 mounted to the laterally outboard ends of truck bolster 40. Side frames 44 carry a pair of first and second longitudinally spaced apart axles 46 upon which are mounted wheel pairs 47. Located atop truck bolster 40 is a truck center plate bowl 48 that supports the articulated connection 36 (or 38) associated with two adjacent rail car units. Truck center plate bowl 48 receives center plate 90 of articulated connector 86 and permits shared truck 32 or 34 to pivot, or swivel, about a generally vertical truck turning axis 50 at the truck centre (as shown in FIG. 3*a*), to follow the rails of the track. While in the embodiment of FIG. 4 shared trucks 32 and 34 are double axle trucks, other types of trucks such as three axle trucks could be used instead.

Intermediate car body unit 24 has a first end structure 52 supported by a first shared truck 32 and a second end structure 54 supported by a second shared truck 34. Intermediate unit 24 includes a body 56 having a pair of deep, spaced apart side beams 58 and 60 extending between, and mounted to, end structures 52 and 54. A well 62 for receiving one or more cargo containers is defined longitudinally between end structures 52 and 54. Side beams 58 and 60 define the sides of well 62. End structure 52 has a stub center sill 74 mounted over shared truck 32 and extending to articulation connection 36. Similarly, at the other end of intermediate unit 24, a second stub center sill 74 is mounted over shared truck 34 and extends to articulated connection 38.

End unit 22 has substantially the same structure as intermediate unit 24 described above, but has an articulated connection, 36, at one end only. More specifically, end unit 22 has a first end structure 68 supported by end car truck 28 and a second end structure 70 supported by first shared truck 32. Each end structure 68, 70 has a respective stub sill 74. Stub sill 74 is mounted above first shared truck 32 and extends to articulated connection 36. At the other end of end car body unit 22, respective stub sill 74 is supported by first end truck 28, and has a releasable coupler 76 mounted thereto to allow end unit 22 to be coupled and uncoupled when forming a new train consist. Coupler 76 is suitable for interchangeable service in North America. End unit 26 is substantially the same as end unit 22. Its first and second end structures are identified as 78 and 80, respectively. First end structure 78 is supported on second end truck 30. Second end structure 80 is mounted over second shared truck 34. First end structure 78 has a standard releasable coupler 76 mounted thereto.

Figure 1B:
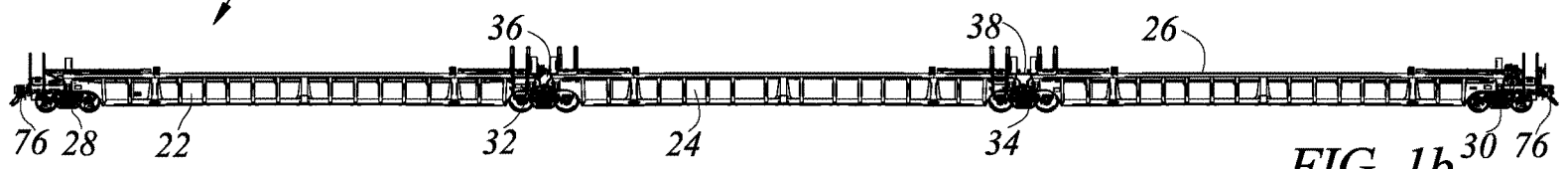
FIG. 1*b* is a side view of the railroad well car of FIG. 1*a;*
Figure 1C:
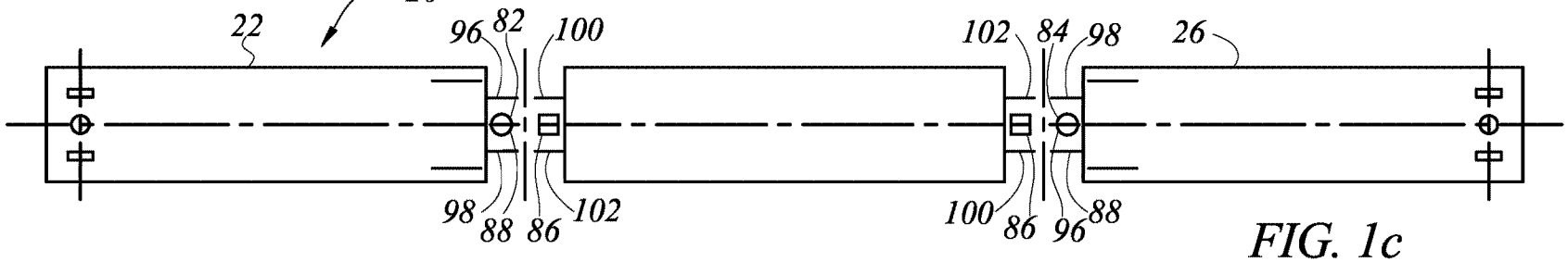
FIG. 1*c* is a schematic top view of the multi-unit railroad well car of FIG. 1*a;*

Articulated connections 36 and 38 (and the other articulated connections noted herein) have respective first and second steel articulated connectors, indicated as 82 and 84, respectively, similar to those commonly available from manufacturers such as Westinghouse Air Brake (WABCO) of Wilmerding Pa., or American Steel Foundries (ASF), also known as Amsted Industries Inc., of Chicago Il. The general form of one type of articulated connector (with a vertical pin) is shown, for example, in U.S. Pat. No. 4,336,758 of Radwill, issued Jun. 29, 1982. This kind of permanent, articulated connection has a female articulated connector portion, a female socket 86, mounted to the end structure of one articulated rail car unit (in the case of articulated connector 82, end structure 52 of intermediate unit 24), and a male articulated connector portion or member 88 mounted to the end structure of an adjacent rail car unit, (in the case of articulated connector 82, end structure 70 of end unit 22), as shown in FIGS. 1*a* and 1*b*. Female socket 86 of articulated connector 82 or 84 rests in, and is supported by, truck center plate bowl 48 of shared truck 32 or 34, as the case may be.

Figure 4:
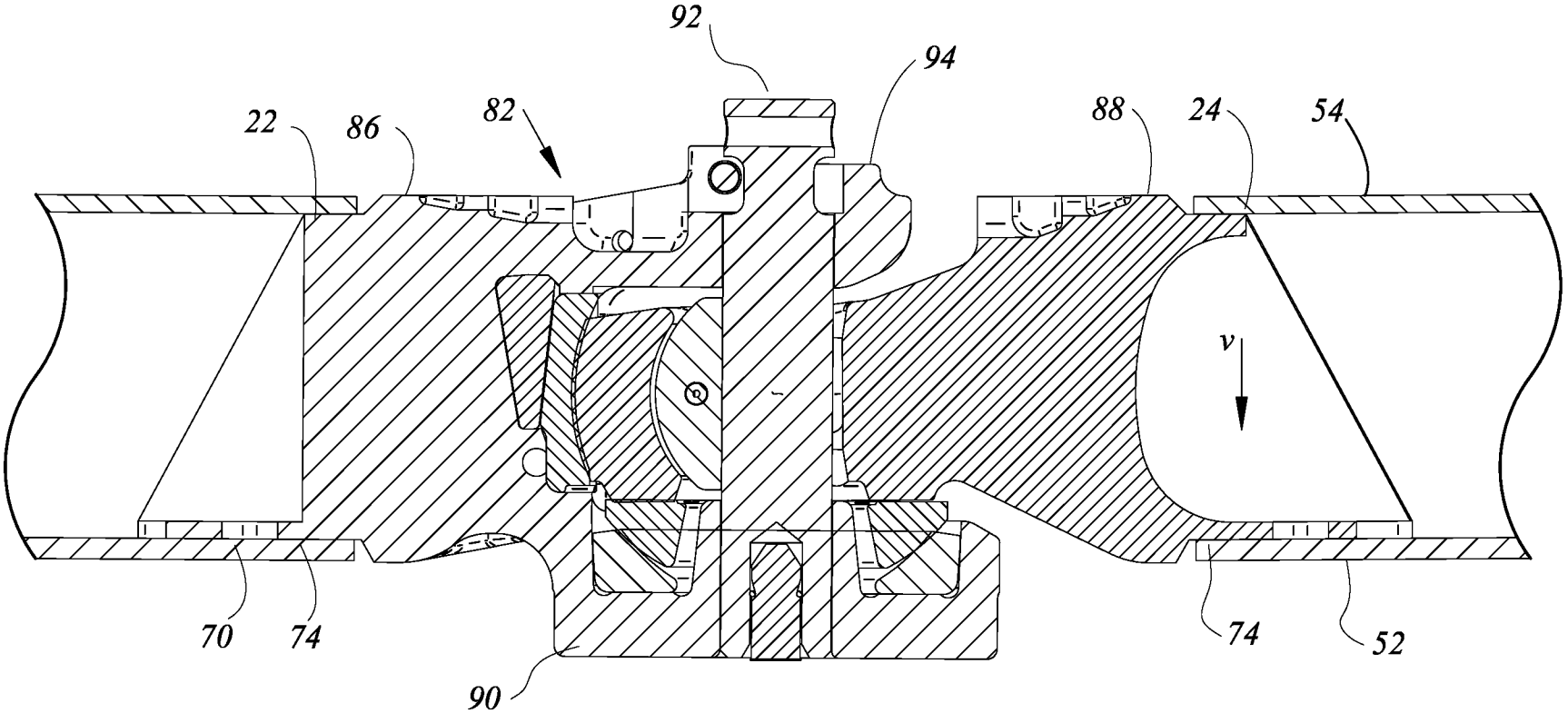
FIG. 4 is a cross-section of an illustrative articulated connector suitable for use with articulated railroad cars with the underlying shared truck thereof omitted for clarity.
Figure 5A:
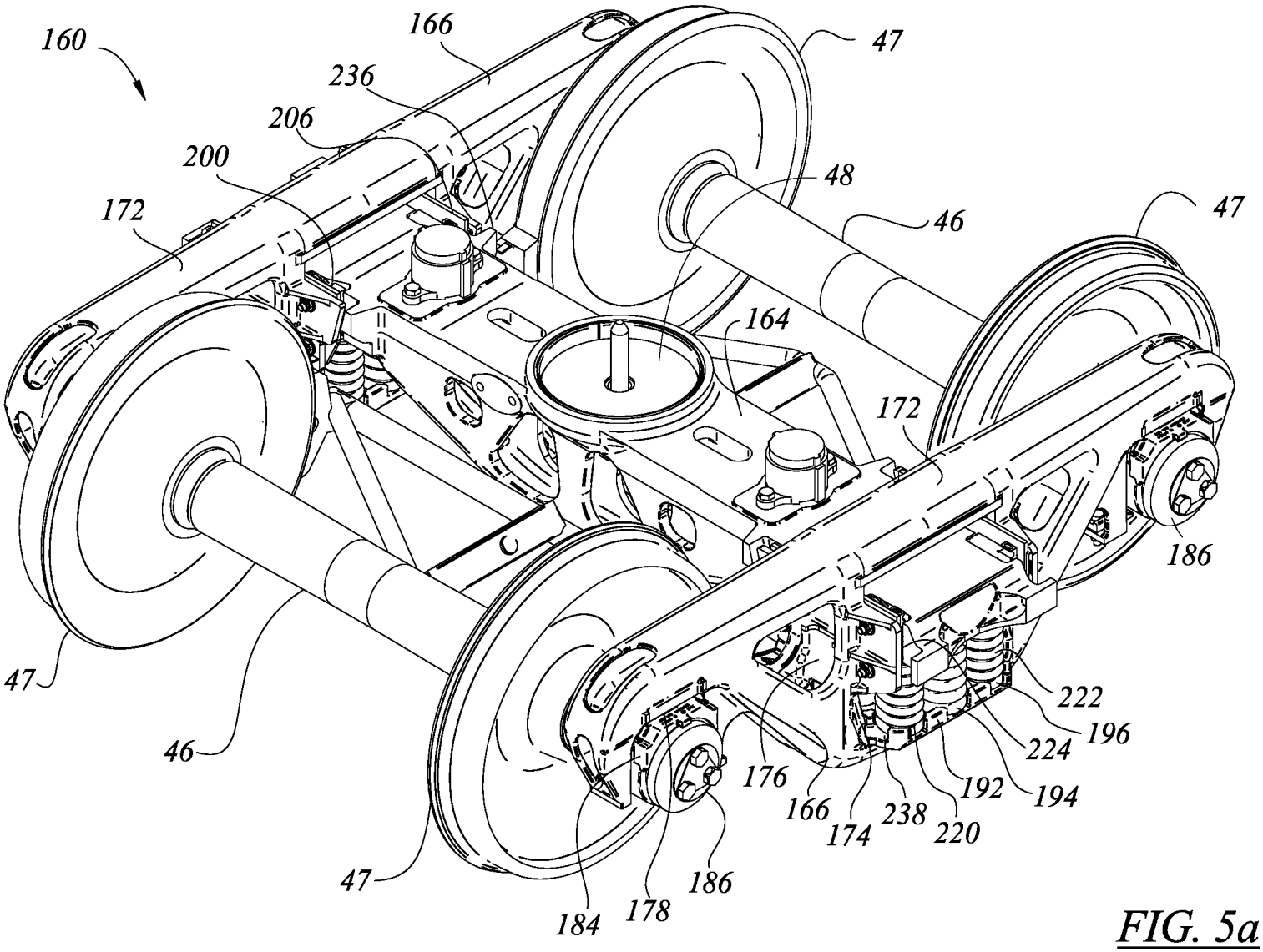
FIG. 5*a* shows an isometric view of an example of an embodiment of a railroad car truck for use in the railroad cars of FIG. 1*a* and 3*a;*
Figure 5B:
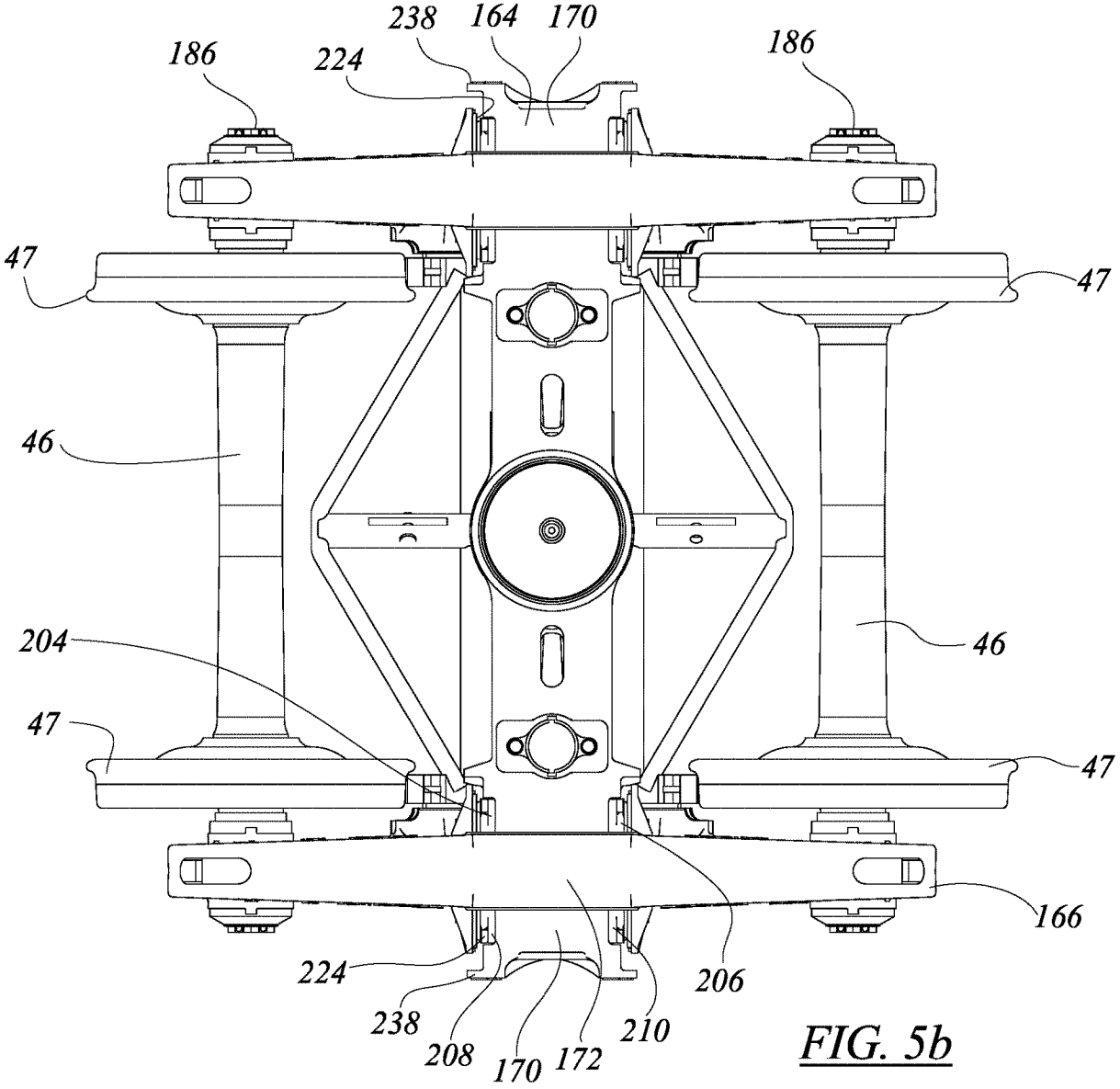
FIG. 5*b* shows a top view of the railroad car truck of FIG. 5*a;*
Figure 5C:
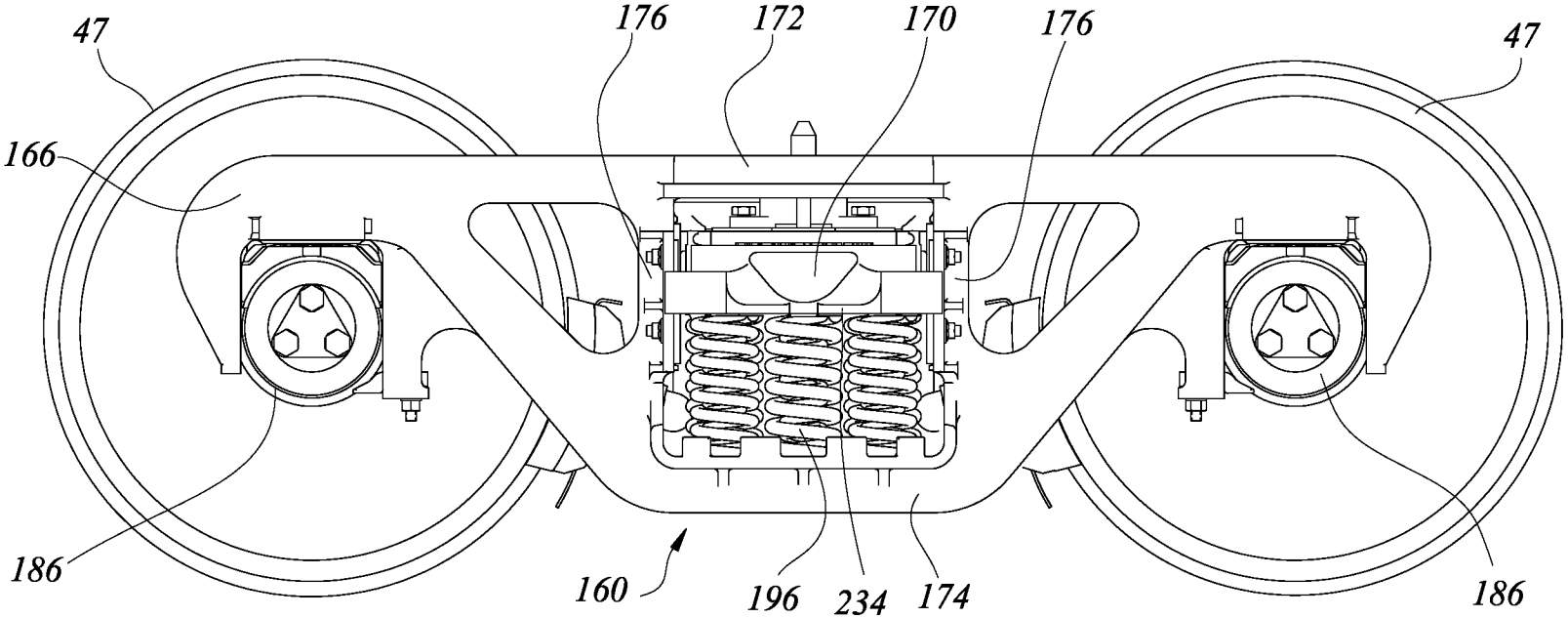
FIG. 5*c* shows a side view of the railroad car truck of FIG. 5*a;*
Figure 5D:
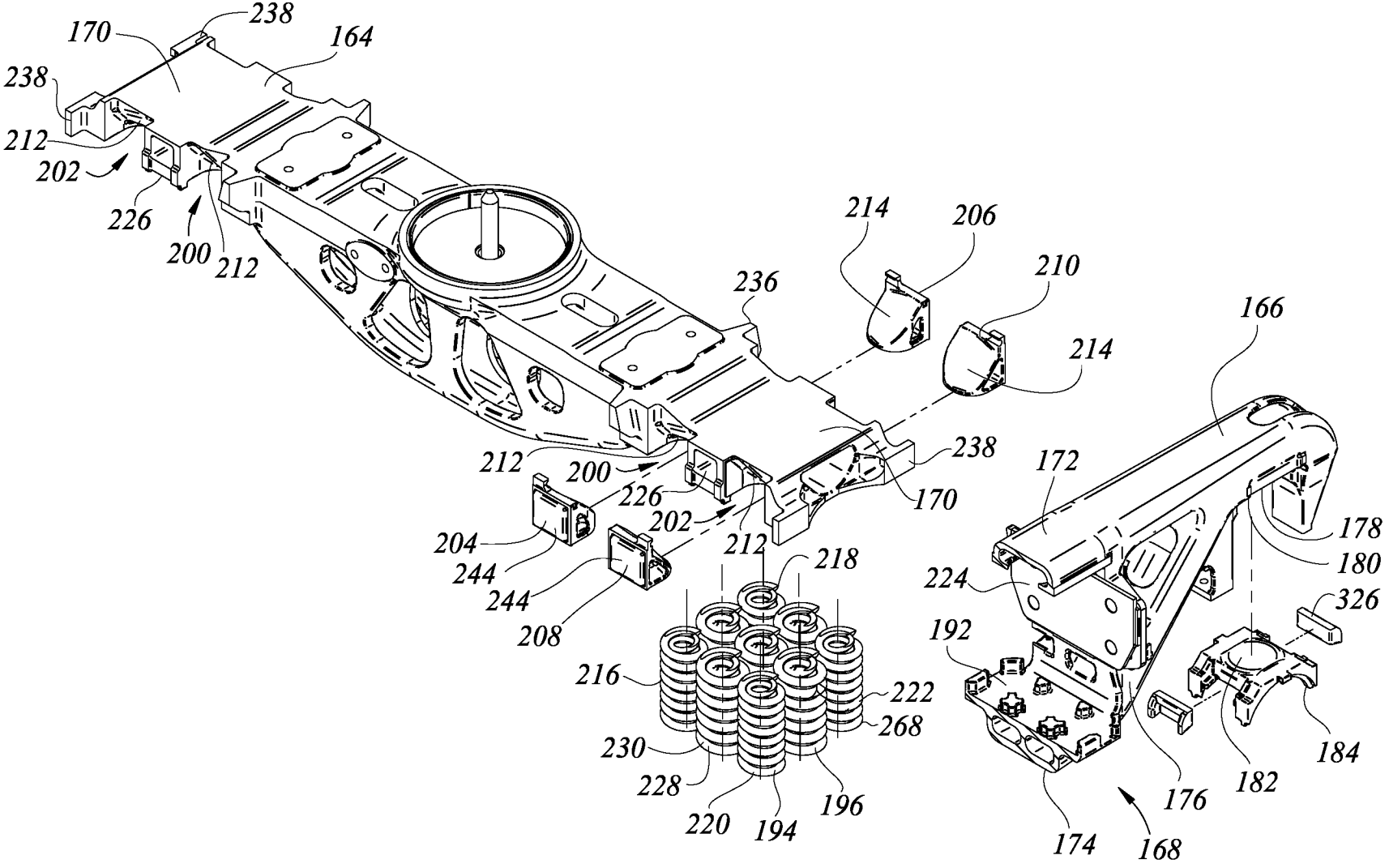
FIG. 5*d* shows an exploded view of a portion of the truck of FIG. 5*a;*
Figure 6A:
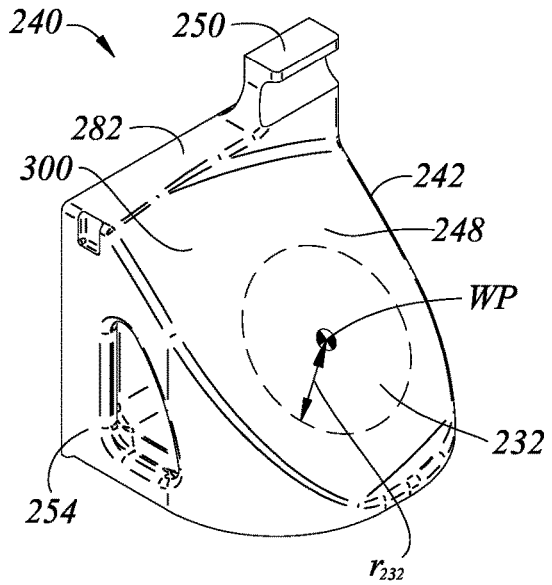
FIG. 6*a* is an isometric view from behind and above of a damper wedge used in the truck of FIG. 5*a;*
Figure 6B:
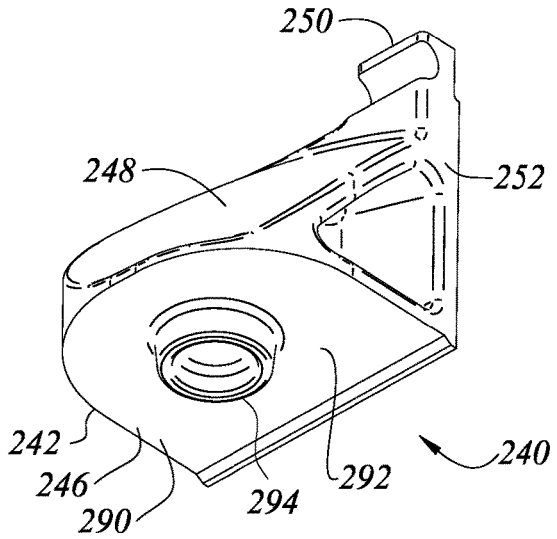
FIG. 6*b* shows the damper wedge of FIG. 6*a* from below and behind.
Figure 6C:
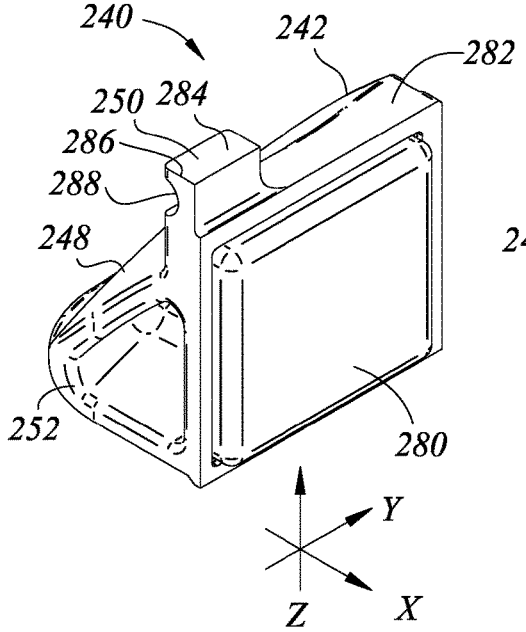
FIG. 6*c* shows the damper wedge of FIG. 6*a* from in front and above.
Figure 6D:
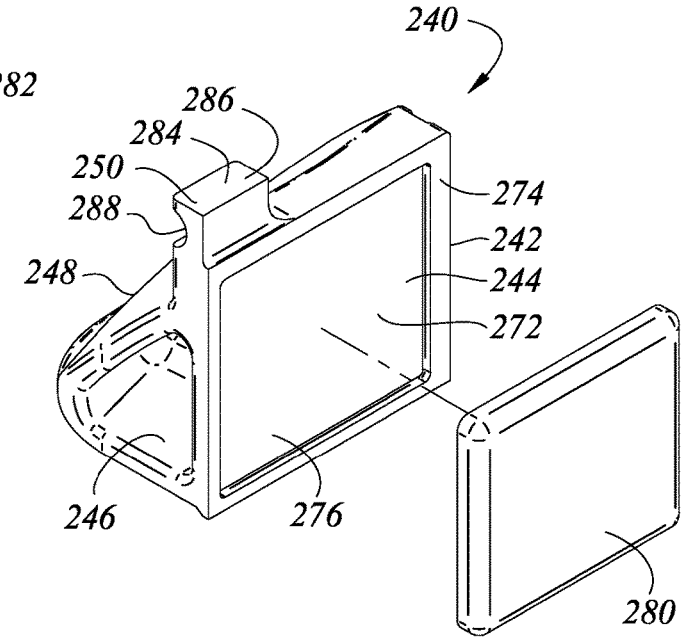
FIG. 6*d* is an exploded view of the damper wedge of FIG. 6*c* with the wear pad out prior to installation.
Figure 7B:
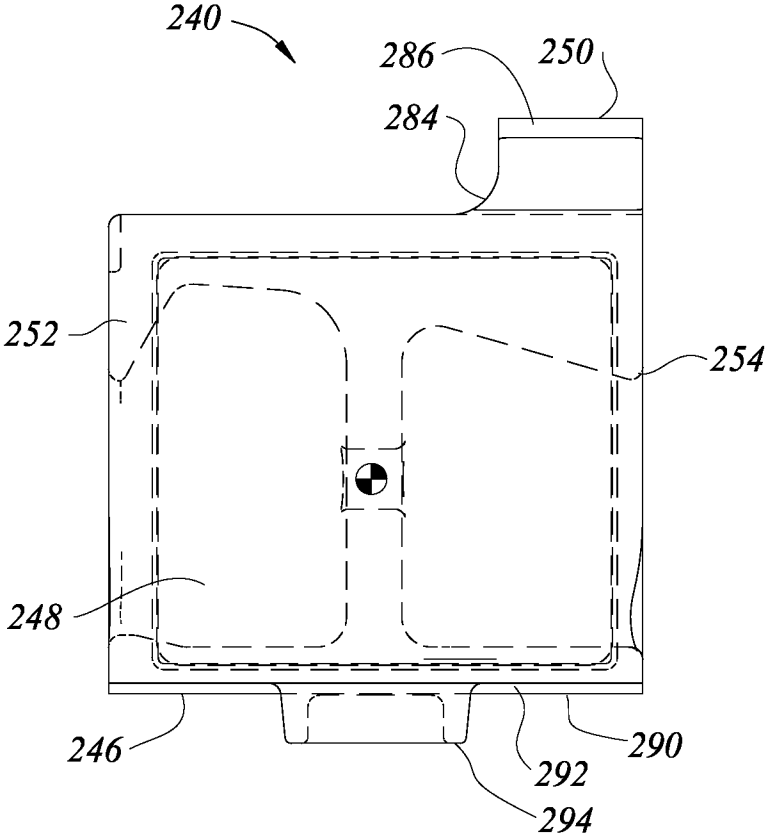
FIG. 7*b* is a rear view of the damper wedge of FIG. 7*a;*
Figure 7A:
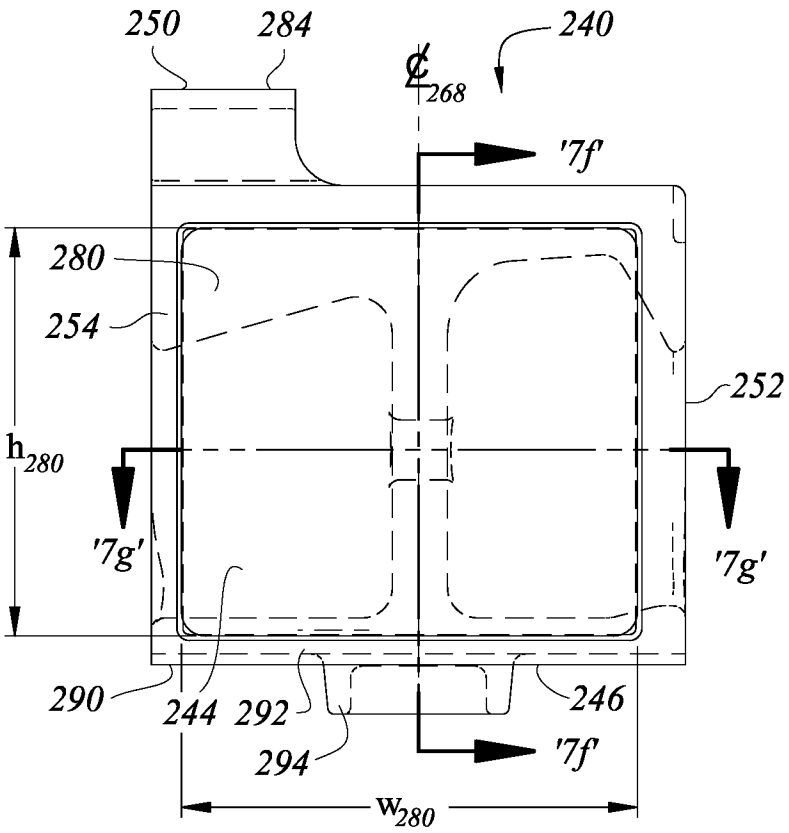
FIG. 7*a* is a front view of the damper wedge of FIG. 6*a;*
Figure 7G:
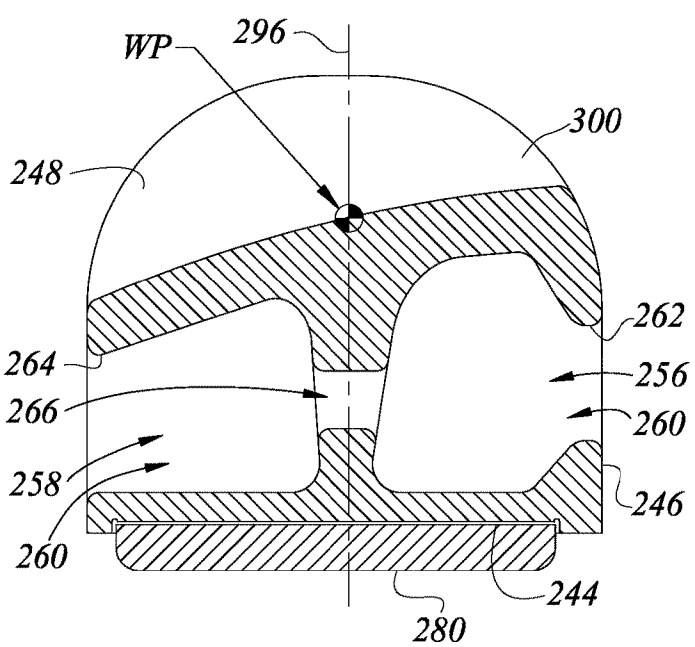
FIG. 7*g* is a sectional view in the horizontal plane of section '7*g*-7*g*' in FIG. 7*a;*
Figure 7F:
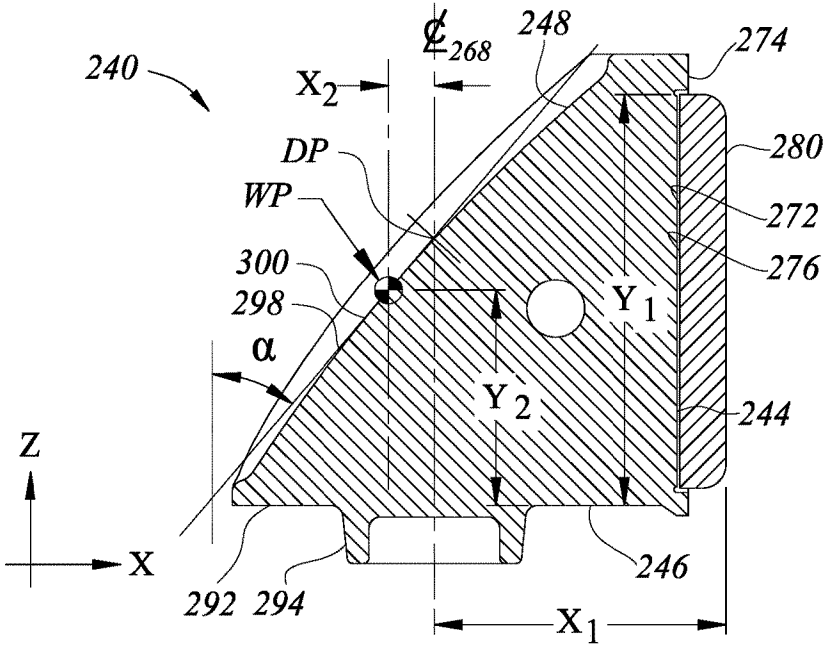
FIG. 7*f* is a sectional view on the spring seat vertical central plane indicated by section '7*f*-7*f*' in FIG. 7*a;*
Figure 7H:
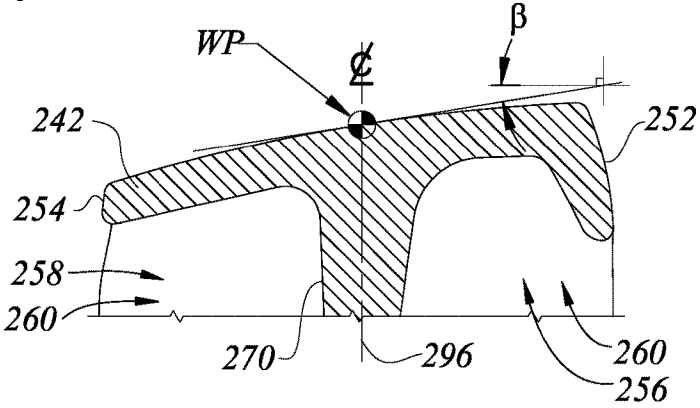
FIG. 7*h* is a sectional plane taken on the spherical radius through the working point as indicated by section '7*h*-7*h*' of FIG. 7*c;*

A conceptual illustration of articulated connector 82 (and 84) is shown in cross-section in FIG. 4. FIG. 4 is not necessarily to scale, and may not show all of the features of articulated connector 82 or 84 in detail. Male member 88 has an extension, or nose that seats in female socket 86. A main pivot pin 92 extends through a bore defined in top plate 94 of female socket 86, through a bore in male member 88, and through the base plate 90 of female socket 86. Pivot pin 92 is vertical on straight, level track. Pivot pin 92 acts as a locking pin to prevent female socket 86 and male member 88 from separating from each other. The mated portions 86 and 88 of the articulated connector are joined to shared truck 32 or 34, by way of a pin that seats in a central bore in truck center plate bowl 48. With specific reference to articulated connector 82, the truck center plate bowl 48 of shared truck 32, supports the portion of the weight of intermediate unit 24 that is transferred through female socket 86 mounted thereto, and the portion of the weight of end unit 22 is transferred through male member 88.

Male member 88 has three rotational degrees of freedom relative to female socket 86 to accommodate curvature, dips and rises in the track over which the railroad car 20 may travel. First, it can yaw about the main pivot axis, as when the car units negotiate a bend or switch. Second, it can pitch about a transverse horizontal axis, as when the car units change slope at the trough of a valley or the crest of a grade. Third, the car units can roll relative to each other, as when entering or leaving super-elevated cross-level track, (that is, banked track). It is not intended that male member 88 have any translational degrees of freedom relative to female socket 86, such that a vertically downward shear load can be transferred from male member 88 into female socket 86, with little or no longitudinal or lateral play. To permit these motions, female socket 86 has spherical seat having an upwardly facing bearing surface describing a portion of a spherical surface. Another mating spherical annular member sits atop the seat, and has a mating, downwardly facing, bearing surface describing a portion of a sphere such that a spherical bearing surface interface is created. The other member also has an upwardly facing surface upon which male member 88 sits. An insert has a cylindrical interface lying against pin 92, and a spherical surface that engages a mating spherical surface of a passage lying on the inside face of the nose. A wedge and wear plate are located between the nose and the inner wall, or groin, of female socket 86. The wear plate has a vertical face bearing against the wedge, and a spherical face bearing against a mating external spherical face of the nose. The wedge bears against the wear plate, as noted, and also has a tapered face bearing against a corresponding tapered face of the groin. As wear occurs, gravity will tend to urge the wedge downwardly, tending to cause articulated connector 82 or 84 to be longitudinally slackless.

While in the embodiment shown articulated connectors 82 and 84 are of the type in which the main pin is nominally vertical, other types of articulated connectors may be used. For instance, articulated connectors in which the main pin is nominally horizontal such as shown in U.S. Pat. No. 5,271,571 of Daugherty, Jr., could also be used.

Articulated connection 36 is formed with the female socket 86 of articulated connector 82 being mounted to intermediate unit 24 and male member 88 being mounted to end unit 22. Articulated connection 38 is configured in like fashion. Female socket 86 of articulated connector 82 is mounted to intermediate unit 24 and male member 88 is attached to end unit 26. In this way, end structures 52 and 54 of intermediate unit 24 possess identical female articulated connector portions 86. Stated another way, the articulated connector portions of intermediate unit 24 are symmetrical about the mid-span centerline of intermediate unit 24 (indicated in FIG. 1*b* as 'CL-Transverse'). Correspondingly, the articulated connector portions associated with end units 22 and 26 are mirror images one of the other.

The extent of "side sway" or roll of one rail car unit relative to the next adjacent rail car unit is controlled by a pair of longitudinally extending, side-bearing support arms associated with each rail car unit. While the arrangement of side-bearing arms in railroad car 20 is described below with reference to adjacent units 22 and 24, it is understood that this description applies as well to the arrangement of side-bearing arms of adjacent units 26 and 24, the latter arrangement being identical to the former arrangement. Accordingly, each end structure 52, 54 of intermediate unit 24 has an identical arrangement of side-bearing arms and the side-bearing arms of end units 22 and 26 are identical to each other as shown in FIG. 3*a*.

Each side-bearing arm 96, 98, 100 and 102 is supported by a respective side bearing interface in the nature of a local bearing pedestal having a bearing surface or interface 104 mounted atop truck bolster 40 on each side of truck center plate bowl 48. A side bearing 106 mounted beneath each side-bearing arm 96, 98, 100 and 102 permits a portion of the weight of intermediate unit 24 to be transferred from the given side-bearing arm through side bearing 106 and side bearing interface 104, to shared truck 32. In addition, side bearings 106 tend to lessen resistance to the movement of the side-bearing arms relative to side bearing interface 104. Side bearings 106 may be constant contact side bearings with or without rollers. However, preferably, side bearings 106 are 5000XT-SSB extended travel, constant contact, roller-less, side bearings manufactured by and available from A. Stucki Company of Pittsburgh, Pennsylvania. The use of these side bearings may tend to reduce the forces to which the side-bearing arms are subjected and may tend to contribute to a reduction in the L/V values of the truck wheels.

In FIG. 3*a* side-bearing arms 96, 98, 100 and 102 are shown mounted at a height H with their respective side bearing interfaces 104 lying slightly above the horizontal plane that (when the car units are sitting on straight, level track) passes through the center of curvature of the spherical surfaces of the articulated connector. As shown, H is approximately 37 inches above TOR. However, the bearing interfaces of the side-bearing arms may be carried at a different height in the range of 36 to 48 inches above TOR, or more. In one embodiment, height H is about 44 inches above TOR.

It has been shown that the forces generated in the side-bearing arms of a three-unit railroad car provided with a symmetrical arrangement of articulated connector portions, tend to be smaller than the forces acting on the side-bearing arms of conventional three-unit railroad cars employing asymmetric articulated connection arrangements. This reduction of the forces in the side-bearing arms may tend to reduce vibration in the car and in so doing may tend to discourage fatigue failure and extend the service life of the car.

Forces in the side-bearing arms may also tend to be reduced by having the wide pair of side-bearing arms associated with a rail car unit having a male articulated connector portion and correspondingly, the opposing, relatively narrower, pair of side-bearing arms associated with an adjacent rail car unit having a female articulated connector portion. A further advantage of this arrangement is that it may tend to contribute to a reduction in L/V values for the truck wheels.

The embodiment shown has symmetrical side bearing arms. Other embodiments are possible, such as a wide pair of side-bearing arms be mounted to a rail car unit having a male articulated connector portion and the relatively narrower pair of side-bearing arms are mounted to an adjacent rail car unit having a female articulated connector portion, or the reverse. In those embodiments, the opposed pairs of side-bearing arms are nested. However, other alternative side-bearing arm arrangements may also be used. However, the embodiment shown has opposed pairs of equally laterally spaced, side-bearing arms mounted on the adjacent car units.

Five-Unit Articulated Railroad Car

Figure 2A:
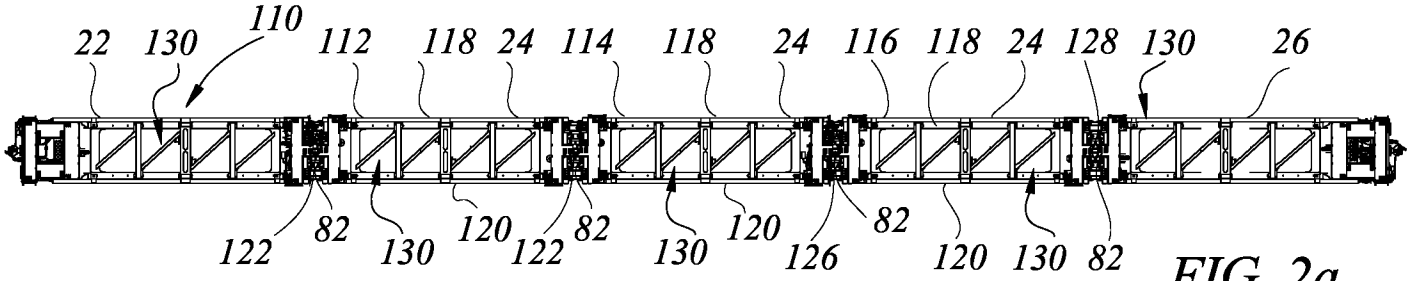
FIG. 2*a* is a general arrangement top view of an alternate multi-unit railroad well car to that of FIG. 1*a;*
Figure 2B:
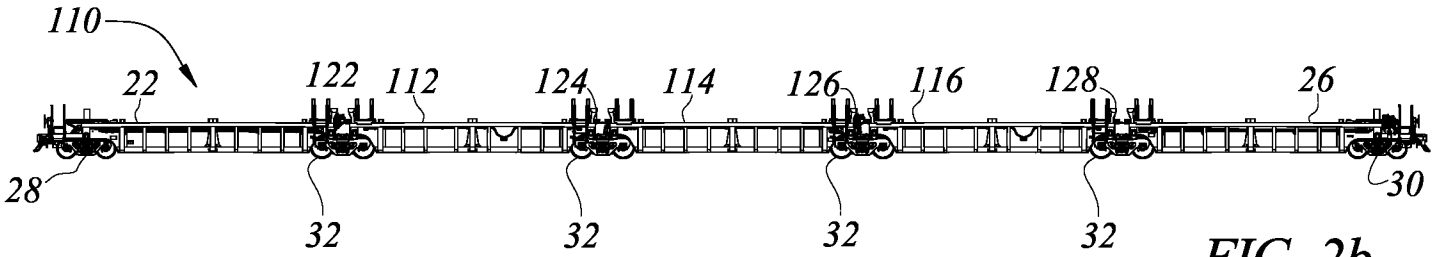
FIG. 2*b* is a side view of the multi-unit railroad well car of FIG. 2*a;*
Figure 2C:
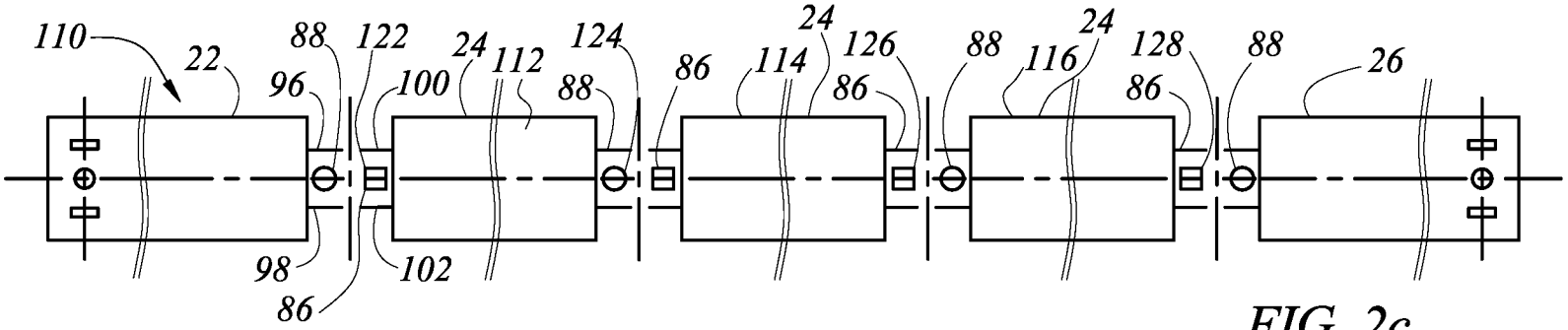
FIG. 2*c* is a schematic top view of the five-unit articulated railroad car as an alternate to the three-unit articulated railroad car of FIG. 1*c;*

FIGS. 2*a*, 2*b* and 2*c* show a five-unit articulated railroad car 110. Car 110 has two end car body units 22, 26, and three intermediate car body units 24 connected therebetween as 112, 114, 116. Unit 114 is the centre unit. The various units 22, 112, 114, 116 and 26 are joined end-to-end at articulated connections 122, 124, 126 and 128. Each articulated connection has an articulated connector 82 supported on a respective shared truck 32, as described above. Car 110 is symmetrical about the mid-span centerline of center unit 114 (indicated in FIG. 3*c* as 'CL-Transverse') such that intermediate units 112 and 116 are mirror images of one another, as are end units 22 and 26. Accordingly, it will suffice to describe the arrangement of units 22, 112 and 114.

Center unit 114 has mounted at each end a male articulated connector portion 88. Intermediate unit 112 has a female articulated connector portion 86 at the end adjacent center unit 114 and a male articulated connector portion 88 at the opposite end thereof facing end unit 22. End unit 26 is generally similar to end unit 22, and has a pair of side-bearing arms 96 and 98 facing side-bearing arms 100 and 102 of intermediate car body unit 116.

Center unit 114 has identical male articulated connector portions 88 at both ends thereof; intermediate unit 116 has an asymmetrical arrangement of articulated connector portions, namely a female connector portion 86 at one end to mate with female articulated connector portion 86 of center car body unit 114, and a male articulated connector portion 88 at the opposite end thereof to mate with the female articulated connector portion 86 of end car body unit 26.

Although flat cars are also used, railroad well cars are the predominant car type for carrying intermodal shipping containers. Whether the railroad car has a single body unit, or includes multiple body units, those body units, however many, are ultimately carried on railroad car trucks for rolling motion along railroad car tracks, as described above.

Each body unit has a central well that is carried between a pair of first and second end sections. The first and second end sections are joined together by a pair of first and second side beams. The first and second side beams are spaced laterally apart and form the outside walls of the rail car. In a railroad car that has a single body unit, the end sections will each have a main body bolster that mounts over a railroad car truck. In the case of an end unit of a multiple body unit car, one end will have a main bolster than mounts over an end truck, and the other end will have an articulated connector that engages with a mating articulated connector over a shared truck. In the case of an inner unit of a railroad well car having at least three body units, both ends of the car body unit have articulated connectors that mate with mating articulated connectors of adjacent car body units over a shared truck. In each case, the first and second end sections of the car body unit and the first and second side beam of the car body unit co-operate to form four sides of the well of the well car. This discussion is intended to apply to well car body units generally, whether they are stand-alone single units or units of a multi-unit car.

The side beams transmit longitudinal buff and draft loads, to carry the vertical bending loads of the lading, and lateral bending loads in curving. Reference is made to the well car floor or floor assembly. Although the term "floor" is used, the rail car bottom is largely open. The total opening area of the "floor" is bounded laterally by the horizontal legs of the side sills, and the bottom flanges of the end bulkheads at the body ends. The floor structure tends to be, and in all examples described herein is, non-continuous. Rather, it includes cross-members placed to support the corner castings of the inter-modal containers. The well car floor of a well car serves the following functions: (a) first, it handles in-service loads by acting as a truss to stiffen the car body structure when the car body is exposed to lateral loads. It prevents the side beams of the car body unit from buckling or deforming excessively during normal service loads. (b) The floor provides emergency container breakout protection. This tends to prevent derailments and other possible damage to the rail infrastructure, and to the train consist, in case of a container failure.

Generally, then, whether discussing an end car body unit, such as end car body unit 22, or an intermediate car body unit such as car body unit 24 or 114, each car body unit has a pair of first and second, spaced apart end structures 52 and 54 or 68 and 70, as may be; and a pair of opposed, spaced apart, parallel first and second, side beams seen as left and right hand longitudinally extending side beams 58, and 60 (in the case of an end car body unit) or 118 and 120 (in the case of an intermediate car body unit). Side beams 58, 60 (or 118, 120) extend between end structures 52, 54, or 68, 70. A well 130 is defined lengthwise between end structures 52, 54, or 68, 70. Side beams 58 and 60 define sides of well 130. End structures 52, 54 or 68, 70 each have a stub center sill 74 having either a draft pocket defined at its outboard end for mounting a coupler 76 or an articulated connector 82, as may be. A main bolster extends laterally to either side of stub center sill 74, or, alternatively, at the articulated connector end, an end sill extends laterally to either side of stub center sill 74. The distal tips of the main bolster and end sill are connected to the side beams. A shear plate overlies the end sill, and main bolster, and extends transversely outboard to mate with side beams 58, 60 or 118, 120. The respective inner end of end structures 52, 54 or 68, 70 may be defined by, or may include, an end bulkhead which forms the end wall of well 130. The end bulkhead may have a bottom flange that extends inwardly toward well 130, the bottom flange being flush with, or substantially flush with, the respective bottom flanges of the side sills.

Figure 1D:
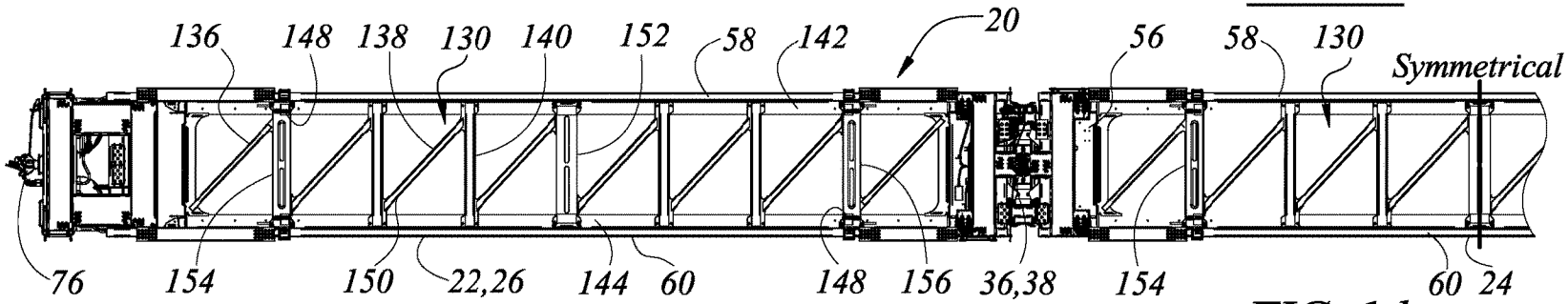
FIG. 1*d* is an enlarged top view of half the railroad car of FIG. 1*a;*

Referring to FIG. 1*d*, a floor or floor assembly 140, includes an array of cross-members 150 that includes a first structural cross-member shown as a main or central container support cross-beam 152 in the mid-span position that extends perpendicular to, and between, side sills 142, 144; and a pair of first and second end structural cross-beams identified as container support end cross-beams 154 and 156 located at the "40 foot" locations roughly 20 feet to either side (in the longitudinal direction of car 20) of cross-beam 152. The construction of cross-beams 152, 154 and 156 which join side sill assembly 142 to side sill assembly 144, is described in greater detail below. Container supports, or container locating cones 148 are located on end cross-beams 154 and 156. Cones 148 help to locate a container relative to cross-beams 154 and 156. The container support cross-beams 152, 154 and 156 are located so that the well 130 can accommodate either two 20-foot containers, each with one end located on cones 148 and the other end resting on center container support cross-beam 152, or a single 40 to 53 foot container, also located on cones 148 at either end. When supporting two 20-foot containers, an end of each container is supported by cross-beam 152. To accommodate these two container ends, cross-beam 152 is provided with load bearing portions of sufficient breadth to accommodate corner fittings of ends of two adjacent 20-foot shipping containers at the same time. That is, cross-beam 152 has a width at least as great as twice the width of the container corner fitting footprint plus an allowance for spacing between two adjacent containers carried back-to-back in the well. As such, cross-beam 152 carries, or is capable of carrying, approximately half of the load in this configuration. The weight supported by cross-beam 152 may be further increased if more than one level of cargo container is carried, such as when two containers are stacked on one another.

Within the allowance for longitudinal camber of car 20 generally, all container support cross-beam 152, 154, and 156 are understood to be parallel to, and generally coplanar with, one another. Floor assembly 140 may also include, and in the examples illustrate does include, a set or array of diagonal braces, identified as cross-members 136 and 138. Cargo loads, such as intermodal cargo containers or other types of shipping containers carried by rail car 20, are intended to be supported by cross-beams 152, 154 and 156. That is, it is not intended that vertical container loads due to gravity should be borne by the diagonal braces, i.e., cross-members 136, 138. Rather the lading may be held upwardly of them to tend not to be scraped or damaged by contact with the shipping container. This may nevertheless still tend to permit the relatively level loading of intermodal cargo containers which are raised at one end by container cones 148 located on end cross-beams 154 and 156. Central container support cross-beam 152 may be, and as shown is, equidistant from end container support cross-beams 154 and 156, being centrally located between them.

General Description of Truck Features

As noted above, the dynamic performance of a multi-unit articulated railroad car is a function of the interaction of the car bodies, track geometry, speed, and the behaviour of the trucks. To that end, the discussion turns to a general description of doubled-damper, self-steering trucks, generally, followed by a description of the differences between the end trucks and the shared trucks. A shared truck differs from an end truck in that a shared truck has side bearing accommodations for side bearing arms from both adjacent car body units to either side, whereas an end truck has only side bearing mounts to engage the main body bolster at the releasable coupler end of the car body unit. Aside from such differences, the description of truck 160 is otherwise intended to be generic as between the end truck and the shared truck, and is provided to establish truck component terminology and layout, generally.

To establish the context of railroad car truck geometry upon which this discussion is based, FIGS. 5*a* to 5*d* show a truck 160 illustrating the common structural features of both end trucks 28, 30 and shared trucks 32, 34. In that sense, truck 160 is described generically. Specific embodiments of truck 160, such as end trucks 28, 30 and shared trucks 32, 34, may have different pendulum lengths, spring stiffnesses, spring arrangements, wheelbase, and window width and height, and so on. That is, truck 160 may tend to have a wheelbase in the range of 60 inches to 75 inches. As discussed below, it has a spring group having a vertical spring rate, and a four-cornered damper group that has primary and secondary angles on the damper wedges. Truck 160 may have a 3×3 spring group arrangement, or such other as may be. Truck 160 may be optimized for carrying relatively low density, high value lading, such as automobiles or consumer products, for example. The various features of the two truck types may be interchanged, and are intended to be illustrative of a wide range of truck types. Notwithstanding possible differences in size, as discussed below, generally similar features are given the same part numbers. Truck 160 is symmetrical about both their longitudinal and transverse, or lateral, centreline axes. In each case, where reference is made to a side frame, it will be understood that the truck has first and second side frames, first and second spring groups, and so on.

Truck 160 has a truck bolster 164 and side frames 166. Each side frame 166 has a generally rectangular window 168 that accommodates one of the ends 170 of bolster 164. The upper boundary of window 168 is defined by the side frame arch, or compression member identified as top chord member 172, and the bottom of window 168 is defined by a tension member identified as bottom chord 174. The fore and aft vertical sides of window 168 are defined by side frame columns 176. The ends of the tension member sweep up to meet the compression member.

At each of the swept-up ends of side frame 166 there are side frame pedestal fittings, or pedestal seats 178. Each fitting 178 accommodates an upper fitting, which may be a rocker or a seat, as described and discussed below. This upper fitting, whichever it may be, is indicated generically as 180. Fitting 180 engages a mating fitting 182 of the upper surface of a bearing adapter 184. Bearing adapter 184 engages a bearing 186 mounted on one of the ends of one of the axles 46 of the truck adjacent one of the wheels 47. A fitting 180 is located in each of the fore and aft pedestal fittings 178, the fittings 180 being longitudinally aligned so the side frame can swing sideways relative to the truck's rolling direction.

The relationship of the mating fittings 180 and 182, described below, defines a first interface for the purposes of assessing dynamic performance That is, in determining the overall response, the degrees of freedom of the mounting of the axle end in the side frame pedestal involve a dynamic interface across an assembly of parts, such as may be termed a wheelset to side frame interface assembly, that may include the bearing; the bearing adapter; an elastomeric pad, if used; a rocker, if used; and the pedestal seat mounted in the roof of the side frame pedestal. To the extent that bearing 186 has a single degree of freedom, i.e., rotation about the wheelshaft axis, analysis can be focused on the bearing adapter to pedestal seat interface assembly. For the purposes of this description, items 180 and 182 are intended generically to represent the combination of features of a bearing adapter and pedestal seat assembly defining the interface between the roof of the side frame pedestal and the bearing adapter, and the six degrees of freedom of motion at that interface, namely vertical, longitudinal and transverse translation (i.e., translation in the z, x, and y directions) and pitching, rolling, and yawing (i.e., rotational motion about the y, x, and z axes respectively) in response to dynamic inputs.

The bottom chord or tension member 174 of side frame 166 has a basket plate, or lower spring seat 192 mounted thereto. Although truck 160 may be free of unsprung lateral cross-bracing, such as a transom or lateral rods, if truck 160 is taken to represent a "swing motion" truck with a transom or other cross bracing, the lower rocker platform of spring seat 192 may be mounted on a rocker to permit lateral rocking relative to side frame 166.

Spring seat 192 has retainers for engaging springs 194 of a spring set, or "spring group", 196, whether internal bosses, or a peripheral lip for discouraging the escape of the bottom ends of the springs. The spring group, or spring set 196, is captured between the distal end 170 of bolster 164 and spring seat 192, being placed under compression by the weight of the rail car body and lading that bears upon truck bolster 164 from above.

Bolster 164 is symmetrical about the central longitudinal vertical plane of the bolster (i.e., cross-wise relative to the truck generally) and symmetrical about the vertical mid-span section of the bolster (i.e., the longitudinal plane of symmetry of the truck generally). Bolster 164 has double, inboard and outboard, bolster pockets 200, 202 on each face of the bolster at the outboard ends 170 (i.e., for a total of 8 bolster pockets per bolster, 4 at each end). Each face of each end 170 of bolster 164 has a pair of spaced apart bolster pockets 200, 202 that receive damper wedges 204, 206, 208, 210, respectively. Pocket 200 is laterally inboard of pocket 202 relative to side frame 166 of truck 160 more generally.

Each bolster pocket 200, 202 has an inclined face, or damper seat 212, that mates with a similarly inclined hypotenuse face 214 of the damper wedge, 204, 206, 208 and 210. Wear plate inserts, e.g., of specially hardened, machined material, can be mounted in pockets 200, 202 along the angled damper wedge faces. Wedges 204, 206 each sit over a first, inboard corner spring 216, 218, and wedges 208, 210 each sit over a second, outboard corner spring 220, 222. Angled faces 214 of wedges 204, 206 and 208, 210 ride against the angled faces of respective seats 212.

As can be seen, and as discussed below, damper wedges 204, 206, 208, 210 have a primary angle, a as measured between vertical and the angled trailing vertex of the larger face. For the embodiments discussed herein, primary angle $\alpha$ may tend to lie in the range of 30-45 degrees, possibly about 40 degrees. This same angle $\alpha$ is matched by the facing surface of the bolster pocket, be it 200 or 202. A secondary angle $\beta$ gives the inboard, (or outboard), rake of the sloped surface of the damper wedge. The true rake angle can be seen by sighting along plane of the sloped face and measuring the angle between the sloped face and the planar outboard face. The rake angle is the complement of the angle so measured. The rake angle may tend to be greater than 5 degrees, may lie in the range of 5 to 20 degrees, and is preferably about 10 to 15 degrees. A modest rake angle may be desirable.

When the truck suspension works in response to track perturbations, the damper wedges may tend to work in their pockets. The rake angles yield a component of force tending to bias the inboard face of outboard wedge inboard against the opposing inboard face of outboard bolster pocket 202. Similarly, the outboard face of the inboard wedge is biased toward the outboard planar face of inboard bolster pocket 200. These inboard and outboard faces of the bolster pockets may be lined with a low friction surface pad, or may be left as a metal surface, as shown. The left hand and right hand biases of the wedges may tend to aid in discouraging twisting of the dampers in the respective pockets.

Bolster 164 includes a middle land 226 between pockets 200, 202, against which a middle end spring 228 works. The top ends of the central row of springs, 230, seat under the main central portion 234 of the end of bolster 164. Middle land 226 is such as might be found in a spring group that is three coils wide. However, whether two, three, or more coils wide, and whether employing a central land or no central land, bolster pockets can have both primary and secondary angles as illustrated, with or without wear inserts. Where a central land, e.g., land 226, separates two damper pockets, the opposing side frame column wear plates need not be monolithic. That is, two wear plate regions could be provided, one opposite each of the inboard and outboard dampers, presenting planar surfaces against which the dampers can bear. The normal vectors of those regions may be parallel, the surfaces may be co-planar and perpendicular to the long axis of the side frame, and may present a clear, un-interrupted surface to the friction faces of the dampers. In this four-corner arrangement, each damper is individually sprung by one or another of the springs in the spring group.

Static compression of the springs under the weight of the car body and lading biases the damper to act along the slope of the bolster pocket, forcing the friction surface against the side frame. Friction damping is provided when the vertical sliding faces of the friction damper wedges 204, 206 and 208, 210 ride up and down on friction wear plates 224 mounted to the inwardly facing surfaces of side frame columns 176. In this way kinetic energy is converted through friction to heat. This friction damps out motion of the bolster relative to the side frames. When a lateral perturbation is passed to wheels 47 by the rails, rigid axles 46 tend to cause both side frames 166 to deflect in the same direction. The reaction of side frames 166 is to swing, like pendula, on the upper rockers. The weight of the pendulum and the reactive force arising from the twisting of the springs urges the side frames back to their initial position. The tendency to oscillate harmonically due to track perturbations tends to be damped out by the friction of the dampers on the wear plates 224.

As compared to a bolster with single dampers, the use of doubled dampers such as spaced apart pairs of dampers 204, 208 may tend to give a larger moment arm for resisting parallelogram deformation of truck 160 generally. Use of doubled dampers may yield a greater restorative "squaring" force to return the truck to a square orientation than for a single damper alone with the restorative bias, namely the squaring force, increasing with increasing deflection. That is, in parallelogram deformation, or lozenging, the differential compression of one diagonal pair of springs (e.g., inboard spring 216 and outboard spring 222 may be more pronouncedly compressed) relative to the other diagonal pair of springs (e.g., inboard spring 218 and outboard spring 220 may be less pronouncedly compressed than springs 216 and 222) tends to yield a restorative moment couple acting on the side frame wear plates. This moment couple tends to rotate the side frame in a direction to square the truck, (that is, in a position in which the bolster is perpendicular, or "square", to the side frames). As such, the truck is able to flex, and when it flexes the dampers co-operate in acting as biased members working between the bolster and the side frames to resist parallelogram, or lozenging, deformation of the side frame relative to the truck bolster and to urge the truck back to the non-deflected position. The restoring moment in such a case would be $M_R$, the moment couple of one pair of diagonally opposed damper springs at the corner of the spring group, minus the moment couple of the other diagonally opposed pair, and, given the sloped back of the damper wedges, the restorative moment is a function of $k_c$, the vertical spring constant of the coil upon which the damper sits and is biased.

As shown dampers may be mounted over each of four corner positions. The coil groups can be of unequal stiffness if inner coils are used in some springs and not in others, or if springs of differing spring constant are used. Moreover, the damper springs may have a different undeflected length than the main spring coils. That is, the damper springs may be longer than the main spring coils. Thus, the pre-load deflection of the damper springs will be greater than the pre-load deflection of the main springs. This will be true in both the light car (i.e., empty) and fully laded car conditions. Accordingly, the proportionate difference (i.e., the percentage change) in energizing spring force in the damper springs will have a correspondingly smaller proportionate variation between the top and bottom of the stroke of the friction wedge over its full amplitude as compared to the main springs. In the example, the free height of corner springs 216, 218, 220 and 222 is 11" whereas the main springs are AAR standard D5 springs having a free height of 10.25".

In the various arrangements of spring groups, dampers are mounted over each of four corner positions. The portion of spring force acting under the damper wedges may be in the 25-50% range for springs of equal stiffness. The coil groups can be of unequal stiffness if inner coils are used in some springs and not in others, or if springs of differing spring constant are used. Varying the spring group and varying the corner springs driving the dampers affects ride performance in the truck.

The bearing plate, namely wear plate 224 is significantly wider than the through thickness of the side frames more generally, as measured, for example, at the pedestals, and may tend to be wider than has been conventionally common. This additional width corresponds to the additional overall damper span width measured fully across the damper pairs, plus lateral travel as noted above, typically allowing 1½ (+/−) inches of lateral travel of the bolster relative to the side frame to either side of the undeflected central position. That is, rather than having the width of one coil, plus allowance for travel, plate 224 may have the width of three coils, plus allowance to accommodate 1½ (+/−) inches of travel to either side for a total, double amplitude travel of 3" (+/−). Bolster 164 has inboard and outboard gibs 236, 238 respectively, that bound the lateral motion of bolster 164 relative to side frame columns 176. This motion allowance may be in the range of +/−1⅛ to 1¾ in., and may be in the range of 1 3/16 to 1 9/16 in., and can be set, for example, at 1½ in. or 1¼ in. of lateral travel to either side of a neutral, or centered, position when the side frame is undeflected.

The lower ends of the springs of the entire spring group seat in lower spring seat 192. Lower spring seat 192 may be laid out as a tray with an upturned rectangular peripheral lip.

Damper Wedges

How the friction pad, or friction member, interacts with the side frame column wear plate changes the ride quality of the truck. To obtain the designed-for ride quality, it is helpful if the non-metallic wear surfaces of the non-metallic wear pads wear relatively evenly, rather than wearing disproportionately along one edge.

Wear is sensitive to the location of the contact point on the sloped side of the damper wedge against the inclined face of the bolster pocket. In operation, the wedges tend to move slightly in the pockets, as when the side frames yaw, pitch, and roll relative to the bolster. These deflections may seem small. In existing trucks the crown radius on the back of the damper is very slight. It may be on the order of 60 inches. In one type of truck it is known to be about 40 inches. It is cylindrical to produce line contact, rather than point contact. By contrast, a compound curvature that yields point contact, allowing the crown of the damper wedge to find its own fit in the damper pocket, and to tolerate relative motion in yaw, pitch, and roll with less tendency toward jamming or binding. Over time, in use a wear patch, which may also be called a contact patch, 232 may form, where the back of the damper wedge has repeatedly contacted the face of the bolster pocket. This contact patch tends to wear as the faces are repeatedly placed in compression against each other. The contact patch reflects the two degrees of freedom of the rocking surface. That is, the contact patch has an extent along the primary angle slope of the back of the damper wedge and also transversely along the secondary angle bias. There will be a similar wear patch in the bolster pocket. The wear of the non-metallic wear surface of the friction pad may tend to be influenced by the forces it sees, and the forces experienced by the non-metallic wear surface of the friction pad appear to correlate to the location and size of this 2 degree-of-freedom contact patch.

FIGS. 6*a* to 6*d* and FIGS. 7*a* to 7*h*

Looking at this geometry in closer context, damper wedge 240 is intended generically to represent any one of damper wedges 204, 206, 208 and 210. Although a right-hand damper wedge is shown, a left-hand damper wedge is a mirror image of the right-hand damper wedge. Accordingly, a description of the right-hand damper wedge describes both parts, allowing for opposite-handedness.

Damper wedge 240 has a body 242. Body 242 may be, and as shown is, made of a relatively common material, such as a ductile iron, cast steel, or cast iron. In side view, it has a generally triangular shape. There is a first face or portion or member 244, which extends vertically; a second face or member, or portion 246 that extends horizontally, and a third member or face or portion 248 that extends generally on a slope, and may be thought of as being the hypotenuse member between member 244 and 246, the three parts thereby combining to form the generally triangular shape noted. Damper wedge 240 also has a first end face or first end wall 252 and a second end face of end wall 254. In this instance, the first end face 252 is the larger end face (i.e., FIG. 7*c*) and the second end face 254 is the smaller end face (FIG. 7*d*). Damper wedge 240 has a primary angle, α, (alpha) seen in side view in FIG. 7*c*. In the embodiment illustrated, angle α is the same angle α as that of the matching, or corresponding, or associated surface of the sloped face 214 of the bolster pocket, be it 200 or 202. While the two planes need not be exactly parallel, it is convenient both for conceptual understanding and for manufacture that they be made the same. Angle α defines the primary angle of the bolster relative to the vertical plane when the damper wedge is seen in side view. Damper wedge 240 also has a secondary damper angle, β (beta). In the example illustrated, the secondary angle of damper wedge 240 is the same as the secondary angle β of the inclined surface of the bolster pocket, be it 200 or 202. It runs transversely, and defines the lateral bias of damper wedge 240 in the pocket. The true view of secondary angle β is seen by sighting along the back of damper wedge 240 in the inclined plane of primary damper angle α. This is the view seen in FIG. 7*h*. Secondary angle β is the angle of the tangent plane at the point of contact, identified as the Working Point, WP, discussed below, relative to the perpendicular to end walls or end faces 252, 254 in the plane of angle α. Again, it may be possible for angle β to be slightly different from that of the corresponding or associated bolster pocket, but for ease of conceptual understanding and ease of manufacture, they may generally be assumed to be the same. Damper wedge 240 is asymmetric as viewed from behind or from above.

Damper wedge 240 also has a grip or hold, or lifting member, or retainer 250 that extends upwardly from first portion or first member 244.

Damper wedge 240 may be made as a solid casting. Alternatively, damper wedge 240 may be hollow, as shown. That is, body 242 has an internal cavity 260 bounded by items 244, 246, 248, 252 and 254. Internal cavity 260 as illustrated is divided into two sub-compartments or chambers 256, 258 by a gusset, or partition, or web 270. Web 270 may have a central opening or hole 266. Each of end faces 252, 254 may have a triangular, or generally triangular opening, 262, 264 respectively.

Looking at these items, the front face member, or first member 244 is planar, or generally planar, and has a rectangular or generally rectangular rim 274 that extends peripherally around a panel or web or plate or wall 272. Plate or wall 272 extends from side to side laterally between end walls 252, 254, and up and down between the forward margin of second member 246 and the forward and upward margin of third member 248. Rim 274 and wall 272 co-operate to form a socket 276 into which is mounted a wear member 280. This may be expressed differently, namely that a relief or rebate, or cavity, or accommodation is formed in first member 244 to define socket 276, with wall 272 forming the base or back of socket 276, and rim 274 forming the lip or retainer of the accommodation so formed. Wear member 280 may be, and in this instance is, a non-metallic friction pad. As may be understood, it has a non-metallic wear surface, that, in use, slides upward and downward in friction contact against side frame column wear plate 224. Wear member 280 is shaped to conform to, i.e., seat within the outline of, peripheral retaining rim 274. As shown, this shape is generally square or rectangular. Wear member 280 may typically be molded in place or held in place with an epoxy or other bonding method. Wear member 280 has a vertical height $h_{280}$ (in the z-direction) and a transverse width $w_{280}$ (in the y-direction). It may be taken that the half height and half width locations are coincident with the half height and half width locations of socket 276.

Lifting member 250 is formed on, and protrudes or extends upwardly from, one side of the upper edge or margin 282 of rim 274. It has the shape of an upwardly extending member 284 in which a rearwardly extending finger 286 is formed by making a semi-circular accommodation or rebate 288. The installation of damper wedges in the bolster pocket can take a bit of finesse. Lifting member 250 is sized to stand forwardly of the bolster pocket and upwardly proud of the outboard gib. The end of the bolster is positioned between the side frame column wear plates, when the bolster is in position a jig tool can be used to grab and lift the damper wedge in the bolster pocket while the springs are installed. The jig tool is them removed to release the lifting member, and the damper wedge sits on the springs.

Second member 246 may be, but need not necessarily be, in the form of a plate or wall 290 that has a spring seat 292 mounted to it. In the example shown, spring seat 292 is, or includes, a boss or downward protrusion 294 that is sized to sit closely within the inner diameter of the corner spring coil, or damper spring of the spring group. Damper spring 268 can be any of corner springs 216, 218, 220 or 222 identified above. For the purpose of this discussion, although the damper spring is referred to as a single spring, it will be understood that it could be, and in this case it is, a double coil that has both an inner coil and an outer coil. Protrusion 294 locates the spring coil axially. That portion of plate or wall 290 that extends radially away from protrusion 294 acts as an abutment or stop determining the end of travel of the upper end of the spring, and its vertical position depending on the dynamic vertical loading condition. Protrusion 294 may be understood as a cylindrical boss having a vertical centerline that, as installed, is the same as the vertical centerline of damper spring 268, indicated as $CL_{268}$. As might also be implicit from the previous discussion, second member 246 is square to (i.e., perpendicular to) first member 244.

Third member 248 is the sloped member. It is nominally on the slope of primary angle alpha, but it has a crown. The location of the tangent point of that crown that is the neutral contact point when the car is at rest defines the Working Point, WP. The formed steel wall whose outer surface defines the working surface 300 of third portion 248 is identified as 298. Inside body 242, the internal web 270 extends from front wall 272 to rear wall 298, and from both of them to bottom plate or bottom wall 290. In this position internal web 270 reinforces all three members. Web 270 is taken as having a web thickness $t_{270}$, indicated in FIG. 7*a*. As shown, wall 298 lies above centerline $CL_{268}$ and in the same vertical plane as the Working Point, WP. That plane, notionally indicated as 296, is defined as the plane in which lies the spring centerline $CL_{268}$, and a normal vector to the friction surface of the non-metallic friction member, namely pad 280, i.e., a vector normal to wall 272. That is, the plane is square to the friction member. It is referred to as the "datum plane". In the example shown, the datum plane may also be the plane mid-way between the first and second end faces of body 242. In this description, three ranges are considered. There is a broad range, such as might be termed a central region, or central zone of surface 300 adjacent to and containing plane 296 which would include material lying in plane 296 and in the region of surface 300 that is within two web thicknesses $t_{270}$ of web centerline $CL_{268}$ in the cross-wise or y-direction. There is a narrower range, lying within the projected thickness of web 270. Finally there is a narrow range, in which the rolling contact point lies in plane 296, or within ⅛ inch to either side thereof, or such that the contact surface of the male and female members in rolling point contact under load lies on, or over, plane 296. In such circumstances, a person of skill would reasonably describe Working Point WP as lying in, or lying approximately in, plane 296. The Working Point, WP lies in the tangent plane of inclined surface 300. That is, assuming that Working Point, WP, is in the Datum Plane, and that the curvature of surface 300 is spherical for simplicity, the tangent plane is constructed to pass through Working Point WP inclined according to primary angle $\alpha$ and according to secondary angle $\beta$. As drawn, that tangent plane would in the most conceptually simple example also be the plane of the sloped face of the bolster pocket. Since this is a rolling point contact interface, the adjacent regions of surface 300 are located shy of that tangent plane, and the normal to the tangent plane at the point of contact defines a radius of the spherical surface. The center of curvature at the origin of that radius will lie to one side of datum plane 296, the radius being skewed therefrom by the $\beta$ angle as taken in the plane of the $\alpha$ angle. The location of WP may be taken as being within 1" radius of datum point DP as measured in surface 300. Expressed differently, in terms scaled to damper wedge 240 itself, WP is within ¼ of the width of damper wedge 240 of DP; or, differently again, WP is within ¼ of the height of non-metallic wear pad 280 of DP. In some embodiments when the parts are in rolling point contact under load, it is within the width of the contact point of datum plane 296.

In terms of physical operation, the forces applied to body 242 include the normal force to side frame column wear plate 224, the friction force in the up or down direction in the plane of wear plate 224, the vertical reaction force in the spring seat, and the angled reaction force applied to sloped surface 300. When truck 160 is at rest, on level track, in equilibrium, the point of application of the reaction on the sloped surface is at the Working Point, WP. During dynamic operation, as the bolster moves up and down relative to the side frame column and as the side frame pitches, yaws, and sways, the actual instantaneous contact point diverges from nominal working point WP. The range of motion of the side frame in pitch is small, perhaps of the order of +/−2 degrees. The range of deflection in yaw is also small, being of the order of +/−3 degrees. The range of deflection in roll is also small, being, likewise of the order of +/−3 degrees. The squirming of damper wedge 240 during operation occurs within these ranges, and produces a "wear patch", which may also be called the "contact patch", 232 on the sloped surface 300 of damper wedge 240 where rolling contact actually occurs and forms a worn area on both surface 300 and on the sloped contact surface of the bolster pocket. Contact within the wear patch varies in a random, or largely random, manner as the truck moves, the track perturbations being assumed to be an input white noise function over time. The contact patch is a feature of the two-degree of freedom contact relationship of damper wedge 240 and bolster pocket 200 (or 202, as may be) extends both along the curvature of the sloped surface in the up-slope and down-slope sense, but also in the left and right cross-wise, or transverse sense, and tends to have a circular or elliptic shape associate with rolling point contact. "Cross-wise" and "transverse" are synonyms.

For a given angular deflection of side frame 166 in yaw or pitch, movement of the rolling point contact from Working Point WP is a function of the curvature of slope surface 300. If the curvature has a large radius, such as the default 60" radius found in some existing conventional dampers, the excursion in the y-direction in yaw, or the arc-wise displacement excursion in the up-slope or down-slope direction in pitch will be relatively large. Where the radius is smaller, the excursion is smaller. Curvature along the slope need not be the same as curvature across the slope. They could differ, as in an ellipse. However, it may be convenient that it be the same, such that the sloped surface is a partial spherical section of a single radius. The inventor has found the wear patch zone is smaller when the radius of curvature is smaller, and that the performance of the damper, and damper wear life, improves where the radius is less than 45 inches. The improvement is better still where the radius is less than 40 inches. In the inventor's observation it is helpful for the radius to be in the range of 15 to 30 inches. To that end, the embodiment illustrated is intended to represent a 20" radius, or approximately a 20 inch radius, +/−½ inch or +/−1 inch, as may be. This can be expressed differently. In the embodiment shown, the radius, $r_{232}$, of wear patch 232 is 2 inches or less. Expressed in parametric terms, the radius of wear patch 232 is less than half the width of damper wedge 240. Alternatively, the radius of wear patch 232 is less than 10% of the radius of curvature of surface 300. In the event that the curvatures had different radii to produce an ellipse having a minor axis and a major axis, those axes would replace radius $r_{232}$.

As above, in the example, surface 300 is formed on a curvature. For the purposes of this description, the vertical axis of damper spring 268 is taken as being the line of action along which spring 268 works in use. Given that springs 268 may have a component of deflection in shear, and may have a rotational component, that approximation is not necessarily exact. However, for the purpose of understanding the axial component of force on the damper that forces the damper against the side frame column, the vertical axis of the spring can be taken as defining the line of action. Looking at FIG. 7*f*, the vertical axis of damper spring 268 intersects surface 300 at a slope intersection point or datum point DP. The location of WP relative to DP can vary, depending on the geometry of the curvature of surface 300. The point contact of WP may be placed in the range of ⅛ to ⅝ offset rearwardly away in the x-direction from non-metallic friction member 280. In this example, the term "rearwardly" from DP also means "downslope". This offset can also be expressed in terms of the arc-length distance along surface 300 from DP. It can also be expressed as a proportion of the offset distance from the contact plane of the friction member with the side frame column wear surface, i.e., that surface being in the same plane as the front face of the non-metallic wear member. In the examples shown, that parametric range may be roughly 1/32 to 5/32 of the overall height of the surface of non-metallic wear member 280.

In one embodiment, the working point WP is offset rearwardly (i.e., downslope) in the x-direction (away from the front face non-metallic friction pad) between about ¼" and about ⅝". In one particular embodiment it is offset about 0.56", or 9/16". In taking these distances in proportion to the offset of the front face of the friction pad, the front edge of rim 274 is offset forwardly about 2⅝". Looking at FIG. 7*f*, in another embodiment, the non-metallic surface if offset from said axial centerline by a first distance, $x_1$; said working point is offset from said centerline by a second distance $x_2$; and a ratio of $x_1$:$x_2$ is in the range of one of (a) 21:2 to 21:8; and (b) 10:3 to 40:3. In one embodiment that ratio is about 5:1. In another way of expressing this, the non-metallic wear surface has an overall height $y_{160}$. In one embodiment, working point WP lies in the range of ⅜ to ⅝ of $y_{160}$ up the height of said non-metallic wear surface.

In the mechanical system described above, there is a single point rolling contact relationship established between the damper wedge sloped surface and the mating sloped surface of the bolster pocket. That same relationship can also be established by having the planar surface as the sloped surface of damper wedge 240 and the curved surface as the surface of the bolster pocket. That is it is to some extent arbitrary which surface is the male surface, and which female. In the further alternative, both surfaces may be formed on a curve, and one of the surfaces could be cylindrical rather than spherical. However, in the embodiments shown the mating surfaces are machined surfaces, and practicality of manufacture may lead to the flat, planar surface being formed in the bolster pocket, and the surface of curvature being formed on the smaller, lighter, less cumbersome, more easily machined damper wedge. Nonetheless, this specification is intended to encompass both possibilities as equivalents under the doctrine of equivalents.

Damper wedge 240 may provide friction damping with little or no "stick-slip" behaviour, but rather friction damping for which the co-efficients of static and dynamic friction are equal, or only differ by a small difference. Wedge 240 may be used in truck 160 in conjunction with a bi-directional bearing adapter as shown in FIGS. 8*a*-8*e* described herein. Wedge 240 may also be used in a four-cornered damper arrangement, as in truck 160, for example. Wear member 280 may be formed of a brake lining material, and the column wear plate may be formed from a high hardness steel.

Damper wedge 240 has a footprint having a vertical extent somewhat greater than the vertical extent of the sloped seat of face 214. Sloped seat of face 214 has a primary angle $\alpha$, and a secondary angle $\beta$. This allows for movement and wear. The lifting lug, of lifting member 250 is mounted on the upper margin, and is visible from above after installation.

In this embodiment, the vertical face of first portion of first member 244 of friction damper wedge 240 has a bearing surface having a co-efficient of static friction, $\mu_s$, and a co-efficient of dynamic or kinetic friction, $\mu_k$, that may tend to exhibit little or no "stick-slip" behaviour when operating against the wear surface of wear plate 224. In one embodiment, the co-efficients of friction are within 10% of each other. In another embodiment the co-efficients of friction are substantially equal and may be substantially free of stick-slip behaviour. In one embodiment, when dry, the co-efficients of friction may be in the range of 0.10 to 0.45, may be in the narrower range of 0.15 to 0.35, and may be about 0.30. Friction damper wedge 240 may have a friction face coating, or may be a bonded pad, such as 280, having these friction properties. Bonded pad 280 may be a polymeric pad or coating. In another embodiment, the co-efficients of static and dynamic friction are substantially equal. The co-efficient of dynamic friction may be in the range of 0.10 to 0.30, and may be about 0.20.

FIGS. 8*a*-8*e*

The rocking interface surface of the bearing adapter might have a crown, or a concave curvature, like a swing motion truck, by which a rolling contact on the rocker permits lateral swinging of the side frame. The bearing adapter to pedestal seat interface might also have a fore-and-aft curvature, whether a crown or a depression, and that, for a given vertical load, this crown or depression might tend to present a more or less linear resistance to deflection in the longitudinal direction, much as a spring or elastomeric pad might do.

Pendulum stiffness is proportional to pendulum weight. For small angles it can be taken as being proportional to the angular deflection, in a geometric relationship that approximates f=kx. A pendulum may tend to maintain a general proportionality between the weight borne by the wheel and the stiffness of the self-steering mechanism as the lading increases, and thereby tend to give proportionate steering whether the car is empty or fully laden. These stiffnesses are geometric stiffnesses, rather than spring stiffnesses. To the extent that the rockers have bi-directional curvature in both the longitudinal direction (i.e., the rolling direction of the truck) and the lateral direction, the rockers provide a geometric stiffness in self steering and also a geometric stiffness in the swing motion direction.

FIGS. 8*a*-8*e* and 9*a*-9*b* show an embodiment of bearing adapter and pedestal seat assembly. Bearing adapter 184 has a lower portion 302 that seats on bearing 186 on axle 46. Bearing adapter 184 has an upper portion 304 that has a male bearing adapter interface portion 306. A mating female rocker seat interface portion, or fitting, 308 is mounted within the roof 310. Upper fitting 308 may be a flat planar surface. When the side frames are lowered over the wheel sets, the end reliefs, or channels 318 lying between the bearing adapter corner abutments 322 seat between the respective side frame thrust blocks, also referred to as side frame pedestal jaws 320. With the side frames in place, bearing adapter 184 is thus captured in position with the male and female portions (306 and 308) of the adapter interface in mating engagement.

Bearing adapter 184 may have a central body portion 324 that has been trimmed shorter longitudinally, and the inside spacing between the corner abutment portions has been widened to accommodate installation of an auxiliary centering device, or centering member, or centrally biased restoring member, which may be elastomeric bumper pads, such as those identified as resilient pads, or members 326. Members 326 may be considered a form of restorative centering element, and may also be termed "snubbers" or "bumper" pads.

Figure 9A:
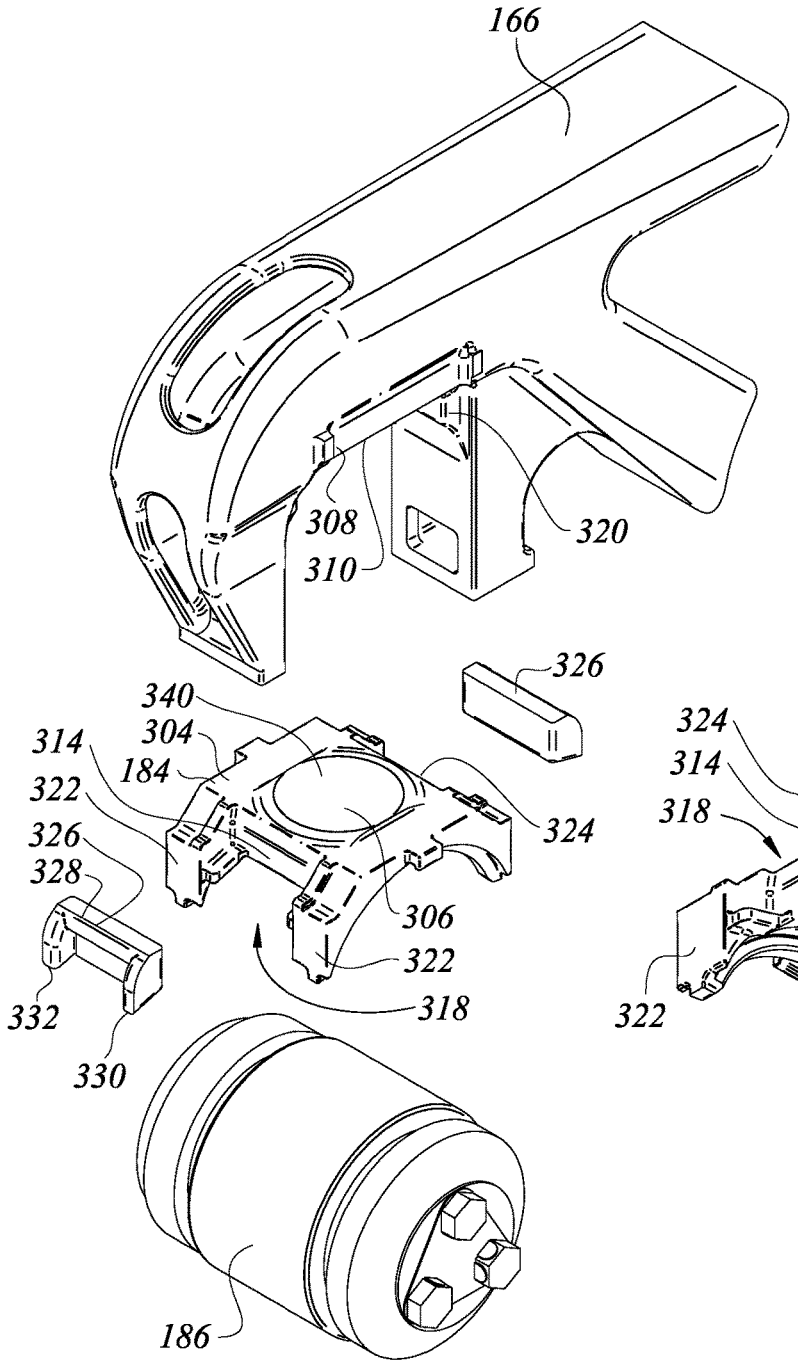
FIG. 9*a* shows an exploded isometric view of the side frame of FIG. 8*a* with the bearing, bearing adapter, and bearing adapter snubbers.
Figure 9B:
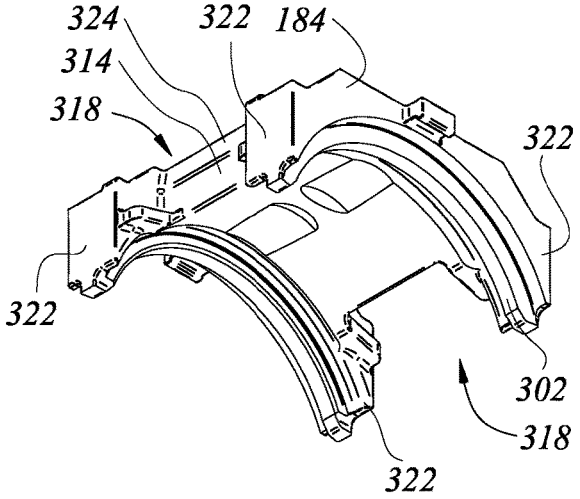
FIG. 9*b* shows the underside of the bearing adapter of FIG. 9*a;*
Figure 10A:
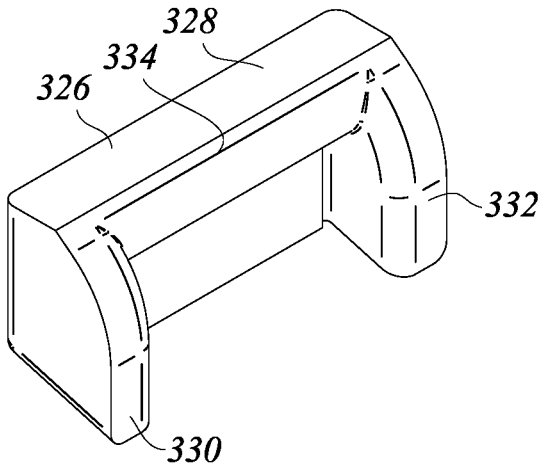
FIG. 10*a* shows an isometric view of one of the snubbers of FIG. 9*a;*
Figure 10B:
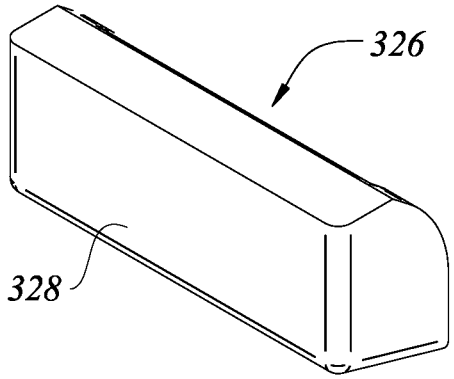
FIG. 10*b* shows an opposite isometric view of the snubber of FIG. 10*a;*
Figure 10C:
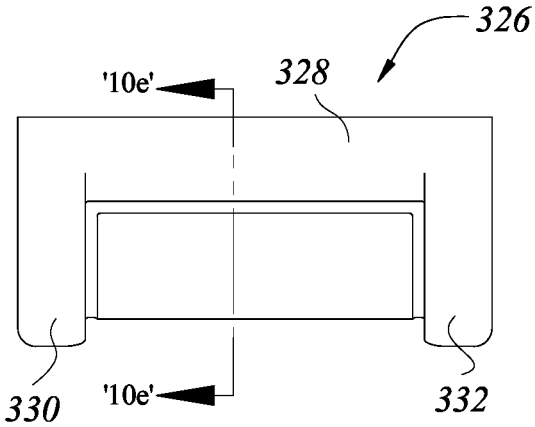
FIG. 10*c* shows a front view of the snubber of FIG. 10*a;*
Figure 10D:
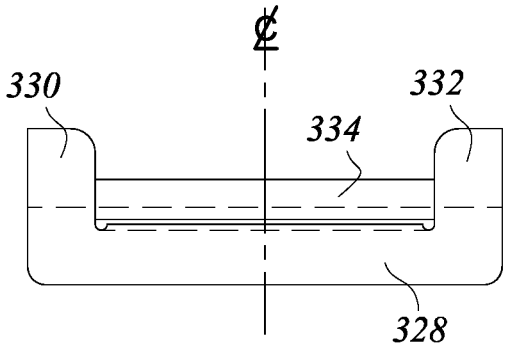
FIG. 10*d* shows a bottom view of the snubber of FIG. 10*a*.
Figure 10E:
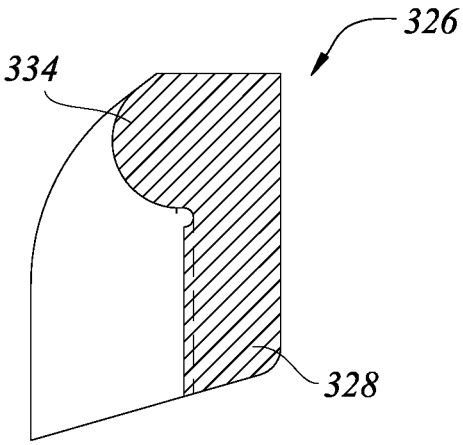
FIG. 10*e* shows the snubber of FIG. 10*c* on section '10*e*-10*e*' of FIG. 10*c*.

As shown in FIGS. 10*a*-10*e*, resilient members 326 have the general shape of a channel, having a central, or back, or web portion 328, and a pair of left and right hand, flanking wing portions 330, 332. Wing portions 330 and 332 have downwardly and outwardly tending extremities that have an arcuate lower edge that seats over the bearing casing. The inside width of wing portions 330 and 332 may be such as to seat snugly about the sides of thrust blocks or jaws 320. A transversely extending lobate portion 334, running along the upper margin of web portion 328, may seat in a radiused rebate 336 between the upper margin of thrust blocks 320 and the end of pedestal seat fitting 178. The inner lateral edge of lobate portion 334 may tend to be chamfered, or relieved, to accommodate, and to seat next to, the end of pedestal seat 178. FIGS. 9*a* and 9*b* show views of bearing adapter 184, and elastomeric bumper pad members 326, as an assembly for insertion between bearing 186 and side frame 166.

Male portion 306 has a generally upwardly facing surface 340 that has both a first curvature $r_1$ to permit rocking in the longitudinal direction (FIGS. 8*d*, 8*e*), and a second curvature $r_2$ (FIGS. 8*b*, 8*c*) to permit rocking (i.e., swing motion of the side frame) in the transverse direction. Similarly, in the general case, female portion 308 has a downwardly facing surface 350 having a first radius of curvature $R_1$ in the longitudinal direction, and a second radius of curvature $R_2$ in the transverse direction. The engagement of $r_1$ with $R_1$ permits longitudinal rocking motion, with resistance proportional to the weight on the wheel. I.e., the resistance to angular deflection is proportional to weight rather than a fixed spring constant. This yields passive self-steering in both light car and fully laden conditions. This relationship is shown in FIGS. 8*d* and 8*e*. FIG. 8*d* shows the centered, or at rest, non-deflected position of the longitudinal rocking elements. FIG. 8*e* shows the rocking elements at their condition of maximum longitudinal deflection. FIG. 8*d* represents a local, minimum potential energy condition for the system. FIG. 8*e* represents a system in which the potential energy has been increased by virtue of the work done by force F acting longitudinally in the horizontal plane through the center of the axle and bearing, $C_B$, which will tend to yield an incremental increase in the height of the pedestal. Put differently, as the axle is urged to deflect by the force, the rocking motion may tend to raise the car, and thereby to increase its potential energy.

In general, the deflection may be measured either by the angular displacement of the axle centerline, $\theta_1$, or by the angular displacement of the rocker contact point on radius $r_1$, shown as $\theta_2$. End face 314 of bearing adapter 184 is inclined at an angle $\eta$ from the vertical. A typical range for $\eta$ might be about 3 degrees of arc. A typical maximum value of $\delta_{long}$ may be about +/−3/16" to either side of the vertical, at rest, center line.

Figure 8C:
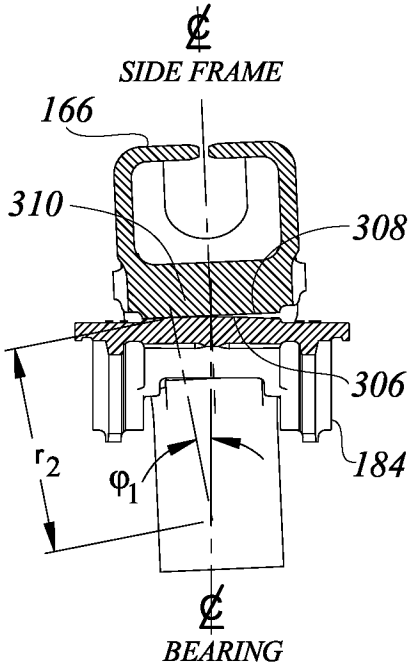
FIG. 8*c* is a section of FIG. 8*b* as deflected laterally in a swinging motion.
Figure 8B:
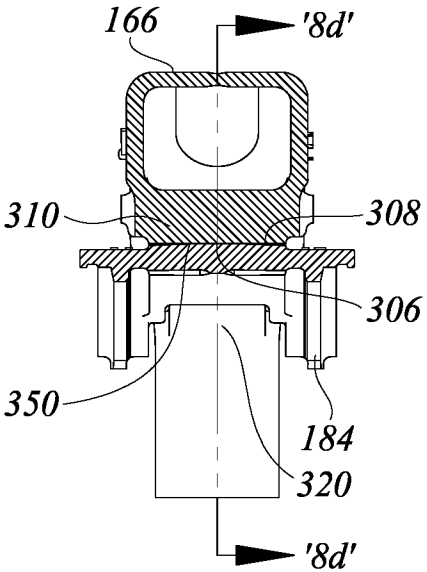
FIG. 8*b* is a section of the side frame on section '8*b*-8*b*' of FIG. 8*a;*

Similarly, as shown in FIGS. 8*b* and 8*c*, in the transverse direction, the engagement of $r_2$ with $R_2$ may tend to permit lateral rocking motion, as may be in the manner of a swing motion truck. FIG. 8*b* shows a centered, at rest, minimum potential energy position of the lateral rocking system. FIG. 8*c* shows the same system in a laterally deflected condition. In this instance $\delta_2$ is roughly $(L_{pendulum}-r_2)$ Sin $\varphi$, where, for small angles Sin $\varphi$ is approximately equal to $\varphi$. $L_{pendulum}$ is taken as the at rest difference in height between the center of bottom spring seat, 192, and the contact interface between male and female portions 306, 308.

This bearing adapter to pedestal seat interface assembly is biased by gravity acting on the pendulum toward a central, or "at rest" position, where there is a local minimum of the potential energy in the system. The fully deflected position shown in FIG. 8*c* corresponds to a deflection from vertical of less than 10 degrees (possibly less than 5 degrees) to either side of center, the actual maximum being determined by the spacing of gibs 236 and 238 relative to plate 224. Although in general $R_1$ and $R_2$ may differ, it may be desirable, for $R_1$ and $R_2$ to be the same, i.e., so that the bearing surface of the female fitting is formed as a portion of a spherical surface, having neither a major nor a minor axis, but merely being formed on a spherical radius. $R_1$ and $R_2$ give a self-centering tendency. Although it is possible for $r_1$ and $r_2$ to be the same, such that the crown is a spherical surface, in the general case $r_1$ and $r_2$ may be different. Where $R_1$ is the same as $R_2$, and both are infinite, that the female surface is planar. In one design by the applicant, the female surface is planar, and the spherical surface has a nominal radius of 40 inches (i.e., 40"+5/−0). This work was conducted with a nominal "110 Ton" truck.

The rocking assembly at the wheelset to side frame interface to tends to maintain itself in a centered condition. There is a spatial relationship of the assembly formed by (a) the bearing adapter, for example, bearing adapter 184; (b) the centering members, such as, for example, resilient members 326; and (c) the pedestal jaw thrust blocks, 320. When resilient member 326 is in place, bearing adapter 184; tends to be centered relative to jaws or thrust blocks 320. As installed, the snubber (member 326) seats closely about the pedestal jaw thrust lug, and may seat next to the bearing adapter end wall and between the bearing adapter corner abutments in a slight interference fit. It establishes the spaced relative position of the thrust lug and the bearing adapter; and provides an initial central positioning of the mating rocker elements as well as providing a restorative bias. Although bearing adapter 184 may still rock relative to side frame 166, such rocking tends locally to compress a portion of member 326, and, being elastic, member 326 tend to urge bearing adapter 184 toward a central position, whether or not there is much weight on the rockers. Resilient member 326 may have a restorative force-deflection characteristic in the longitudinal direction substantially less stiff than the force deflection characteristic of the fully loaded longitudinal rocker (perhaps one to two orders of magnitude less), such that, in a fully loaded car condition, member 326 tends not significantly to alter the rocking behaviour. In one embodiment member 326 is made of a polyurethane.

The rolling contact surface of the bearing has a local minimum energy condition when centered under the corresponding seat. The mating rolling contact surface radius encourages self centering of the male rolling contact element.

This can be expressed differently. In cylindrical polar co-ordinates, the long axis of the wheelset axle may be considered as the axial direction. There is a radial direction measured perpendicularly away from the axial direction, and there is an angular circumferential direction that is mutually perpendicular to both the axial direction, and the radial direction. There is a location on the rolling contact surface that is closer to the axis of rotation of the bearing than any other location. This defines the "rest" or local minimum potential energy equilibrium position. Since the radius of curvature of the rolling contact surface is greater than the radial length, L, between the axis of rotation of the bearing and the location of minimum radius, the radial distance, as a function of circumferential angle $\theta$ will increase to either side of the location of minimum radius (or, put alternatively, the location of minimum radial distance from the axis of rotation of the bearing lies between regions of greater radial distance). Thus the slope of the function $r(\theta)$, namely $dr/d\theta$, is zero at the minimum point, and is such that r increases at an angular displacement away from the minimum point to either side of the location of minimum potential energy. Where the surface has compound curvature, both $dr/d\theta$ and $dr/dL$ are zero at the minimum point, and are such that r increases to either side of the location of minimum energy to all sides of the location of minimum energy, and zero at that location. This may tend to be true whether the rolling contact surface on the bearing is a male surface or a female surface. The rolling contact surface has a radius of curvature, or radii of curvature, if a compound curvature is employed, that is, or are, larger than the distance from the location of minimum distance from the axis of rotation, and the rolling contact surfaces are not concentric with the axis of rotation of the bearing. Another way to express this is to note that there is a first location on the rolling contact surface of the bearing that lies radially closer to the axis of rotation of the bearing than any other location thereon. A first distance, L is defined between the axis of rotation, and that nearest location. The surface of the bearing and the surface of the pedestal seat each have a radius of curvature and mate in a male and female relationship, one radius of curvature being a male radius of curvature $r_1$, the other radius of curvature being a female radius of curvature, $R_2$, (whichever it may be). $r_1$ is greater than L, $R_2$ is greater than $r_1$, and L, $r_1$ and $R_2$ conform to the formula $L^{-1}-(r_1^{-1}-R_2^{-1})>0$, the rocker surfaces being co-operable to permit self steering.

Compound Pendulum Geometry

Figure 8A:
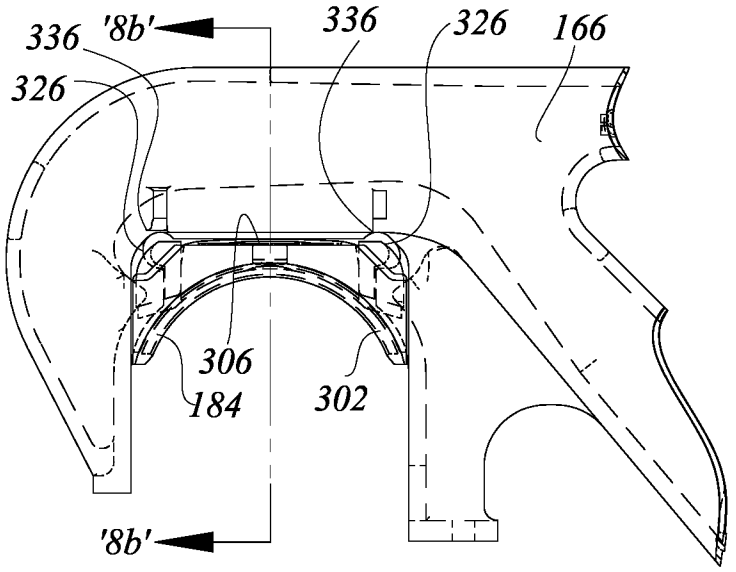
FIG. 8*a* is a side view in partial section of the end of a truck side frame of the railroad car truck of FIG. 5*a;*
Figure 8D:
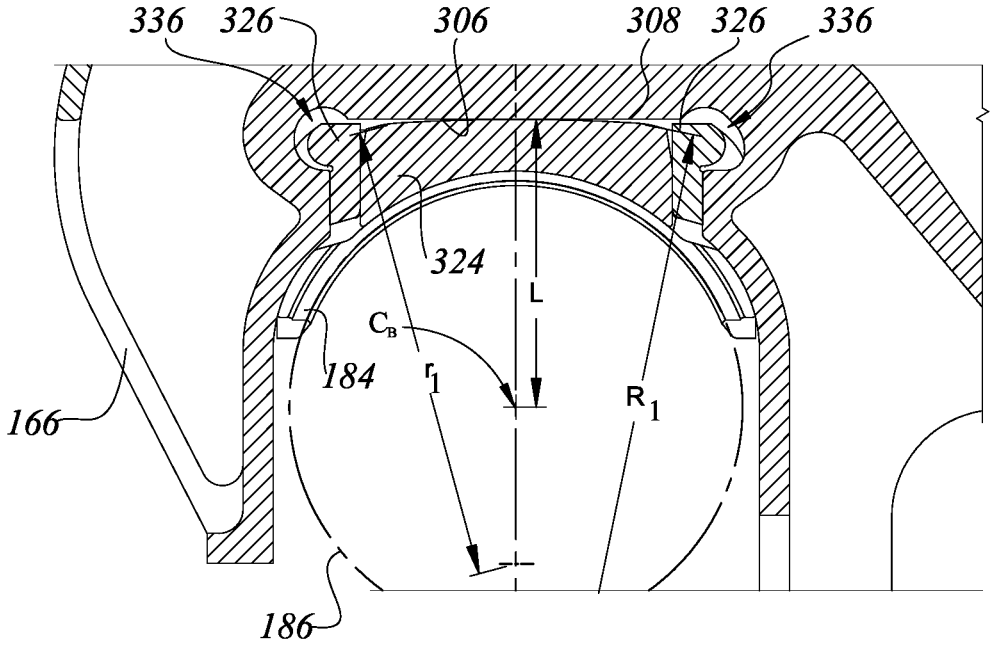
FIG. 8*d* is a view in the longitudinal direction through the pedestal seat and bearing adapter assembly of the side frame of FIG. 8*a* on section '8*d*-8*d*' of FIG. 8*b;*
Figure 8E:
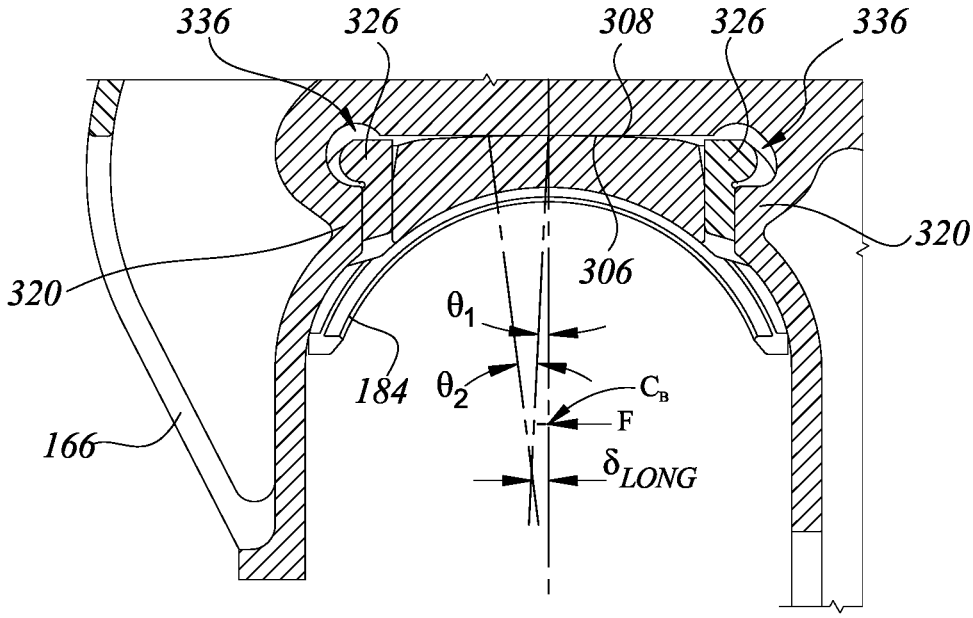
FIG. 8*e* shows the pedestal seat and bearing adapter assembly of FIG. 8*c* in a longitudinally deflected condition.

The rockers described herein employ rocking elements that define compound pendulums—that is, pendulums for which the male rocker radius is non-zero, and there is an assumption of rolling (as opposed to sliding) engagement with the female rocker. The embodiment of FIG. 8*a* shows a bi-directional compound pendulum. The performance of these pendulums affects both lateral stiffness and self-steering on the longitudinal rocker.

The lateral stiffness of the suspension reflects the stiffness of (a) the side frame between (i) the bearing adapter and (ii) the bottom spring seat (that is, the side frames swing laterally); (b) the lateral deflection of the springs between (i) the lower spring seat and (ii) the upper spring seat mounting against the truck bolster, and (c) the moment between (i) the spring seat in the side frame and (ii) the upper spring mounting against the truck bolster. The lateral stiffness of the spring groups may be approximately ½ of the vertical spring stiffness.

A formula may be used for estimation of truck lateral stiffness:

$$k_{truck}=2\times[(k_{sideframe})^{-1}+(k_{spring\ shear})^{-1}]^{-1}$$

where $k_{sideframe}=[k_{pendulum}+k_{spring\ moment}]$ $k_{spring\ shear}$=The lateral spring constant for the spring group in shear.

$k_{pendulum}$=The force required to deflect the pendulum per unit of deflection, as measured at the center of the bottom spring seat.

$k_{spring\ moment}$=The force required to deflect the bottom spring seat per unit of sideways deflection against the twisting moment caused by the unequal compression of the inboard and outboard springs.

In a pendulum, the relationship of weight and deflection is roughly linear for small angles, analogous to F=kx, in a spring. A lateral constant can be defined as $k_{pendulum}=W/L$, where W is weight, and L is pendulum length. An approximate equivalent pendulum length can be defined as $L_{eq}=W/k_{pendulum}$. W is the sprung weight on the side frame.

A formula for a longitudinal, or "lengthwise" (i.e., self-steering) rocker as in FIG. 8*a*, may also be defined:

$$F/\delta_{long}=k_{long}=(W/L)[[(1/L)/(1/r_1-1/R_1)]-1]$$

Where:

$k_{long}$ is the longitudinal constant of proportionality between longitudinal force and longitudinal deflection for the rocker.

F is a unit of longitudinal force, applied at the centerline of the axle $\delta_{long}$ is a unit of longitudinal deflection of the centerline of the axle L is the distance from the centerline of the axle to the apex of male portion.

$R_1$ is the longitudinal radius of curvature of the female hollow in the pedestal seat.

$r_1$ is the longitudinal radius of curvature of the crown of the male portion on the bearing adapter In this relationship, $R_1$ is greater than $r_1$, and (1/L) is greater than $[(1/r_1)-(1/R_1)]$, and, as shown in the illustrations, L is smaller than either $r_1$ or $R_1$. In some embodiments herein, the length L from the center of the axle to apex of the surface of the bearing adapter, at the central rest position may typically be about 5¾ to 6 inches (+/−), and may be in the range of 5-7 inches. Bearing adapters, pedestals, side frames, and bolsters are typically made from steel. The present inventor is of the view that the rolling contact surface may preferably be made of a tool steel, or a similar material.

In the lateral direction, an approximation for small angular deflections is:

$$k_{pendulum}=(F_2/\delta_2)=(W/L_{pend.})[[(1/L_{pend.})/((1/R_{Rocker})-(1/R_{seat}))]+1]$$

where:

$k_{pendulum}$=the lateral stiffness of the pendulum $F_2$=the force per unit of lateral deflection applied at the bottom spring seat $\delta_2$=a unit of lateral deflection W=the weight borne by the pendulum $L_{pend.}$=the length of the pendulum, as undeflected, between the contact surface of the bearing adapter to the bottom of the pendulum at the spring seat $R_{Rocker}=r_2$=the lateral radius of curvature of the rocker surface $R_{seat}=R_2$=the lateral radius of curvature of the rocker seat Where $R_{seat}$ and $R_{Rocker}$ are of similar magnitude, and are not unduly small relative to L, the pendulum may tend to have a relatively large lateral deflection constant. Where $R_{seat}$ is large compared to L or $R_{Rocker}$, or both, and can be approximated as infinite (i.e., a flat surface), this formula simplifies to:

$$k_{pendulum}=(F_{lateral}/\delta_{lateral})=(W/L_{pend.})[(R_{Rocker}/L_{pendulum})+1]$$

Using this number in the denominator, and the design weight in the numerator yields an equivalent pendulum length, $L_{eq.}=W/k_{pendulum}$ U.S. Pat. No. 3,670,660 of Weber shows a swing motion truck having lateral cylindrical rockers in the side frame pedestals, and a transom mounted on a lateral rockers in the spring seats under the truck bolster. The transom, or "spring plank", ties the lower spring seats of the two side frames together. Diagonal lateral rods have also been used for this purpose. As may be noted, truck 160 as illustrated does not have a transom or spring plank, and does not have lateral connecting rods, diagonal, resilient, or otherwise. It is accordingly free of lateral unsprung cross-bracing, and may therefore be termed "free of lateral unsprung bracing", or, more simply, "transomless". That is, truck 160 may be "transomless", i.e., free of lateral unsprung bracing, whether in terms of a transom, laterally extending parallel rods, or diagonally criss-crossing frame bracing or other unsprung stiffeners.

In terms of lateral deflection of the spring groups in shear, in the various examples herein, the gibs may be shown mounted to the bolster inboard and outboard of the wear plates on the side frame columns. In the embodiments shown herein, the clearance between the gibs and the side plates is desirably sufficient to permit a motion allowance of at least ¾" of lateral travel of the railroad car truck bolster relative to the wheels to either side of neutral, advantageously permits greater than 1 inch of travel to either side of neutral, and may permit travel in the range of about 1 or 1⅛" to about 1⅝ or 1 9/16" to either side of neutral.

In the trucks shown and described herein, the overall ride quality may depend on the inter-relation of the spring group layout and physical properties, or the damper layout and properties, or both, in combination with the dynamic properties of the bearing adapter to pedestal seat interface assembly. It may be helpful for the lateral stiffness of the side frame acting as a pendulum to be less than the lateral stiffness of the spring group in shear.

Where a flat female rocker surface and a male spherical surface are used, the male radius may be in the range of about 20" to about 50", and may lie in the narrower range of 30 to 40 in. End trucks and shared trucks may have, and as illustrated do have, different radii of curvature of their rockers. The rocker surfaces are formed of a relatively hard material, which may be a metal or metal alloy material, such as a steel or a material of suitable hardness and toughness. Such materials may have elastic deformation at the location of rocking contact in a manner analogous to that of journal or ball bearings. Nonetheless, the rockers may be taken as approximating the ideal rolling point contact of infinitely stiff members. This is to be distinguished from materials in which deflection of an elastomeric element be it a pad, or block, of whatever shape, may be intended to determine a characteristic elastomeric stiffness of the dynamic or static response of the element, as opposed to hard steel rockers that define a geometric stiffness.

The male and female surfaces may be inverted, such that the female engagement surface is formed on the bearing adapter, and the male engagement surface is formed on the pedestal seat. It is a matter of terminology which part is actually the "seat", and which is the "rocker". Sometimes the seat may be assumed to be the part that has the larger radius, and which is usually thought of as being the stationary reference, while the rocker is taken to be the part with the smaller radius, that "rocks" on the stationary seat. However, this is not always so. At root, the relationship is of mating parts, whether male or female, and there is relative motion between the parts, or fittings, whether the fittings are called a "seat" or a "rocker". The fittings mate at a force transfer interface. The force transfer interface moves as the parts that co-operate to define the rocking interface rock on each other, whichever part may be, nominally, the male part or the female part. One of the mating parts or surfaces is part of the bearing adapter, and another is part of the pedestal. There may be only two mating surfaces, or there may be more than two mating surfaces in the overall assembly defining the dynamic interface between the bearing adapter and the pedestal fitting, or pedestal seat, however it may be called.

The description thus far has established the geometry and terminology of multi-unit freight cars, and in particular multi-unit articulated well cars, and to establish the geometry and terminology of double-damper self-steering three-piece railroad freight car trucks.

Spring Groups

Frictional forces at the dampers may differ depending on whether the damper is being loaded or unloaded. The angle of the damper wedge, the co-efficients of friction, and the springing under the damper wedges can be varied. A damper wedge is being "loaded" when the bolster is moving downward in the side frame window, since the spring force is increasing, and hence the force on the damper wedge is increasing. Similarly, a damper wedge is being "unloaded" when the bolster is moving upward toward the top of the side frame window, since the force in the springs is decreasing. It tends to be helpful for the damping force during "unloading" to be roughly the same as the corresponding damping force during "loading".

In trucks such as truck 160, the resilient interface between each side frame and the end of the truck bolster associated therewith may include a four-cornered damper wedge arrangement and a 3×3 or 3:2:3 spring group. The damper wedges have friction modified surfaces, such as non-metallic surfaces. In the terminology used herein a spring group, such as a 3×3 spring group, in total, includes both damper springs and main springs. The "damper springs" are defined as those that are mounted to drive the damper wedges. The "main springs" are those springs that seat between the bottom spring seat of the side frame tension member and the underside of the bolster end, that do not drive the dampers. The total spring rate is the sum of the spring rates of the damper springs and the main springs. Similarly, at any point in the operating range the vertical force exerted by the spring group is the sum of the force exerted by the main springs and the force exerted by the damper springs. When reference is made to the natural frequency of the springs, unless otherwise noted it refers to the primary mode, or first mode, or lowest mode of natural frequency in vertical translation.

As seen in the properties listed in Table 2b, the various springs tend to have different spring heights and spring rates. The properties of the spring groups are the sum of the properties of the individual springs in the group. The springs of the group have a free height, an "empty" height, a "loaded height" and a "solid" height. In FIGS. 11*a* to 11*d*, the "empty" height is the height of the spring group when the car body unit is empty, and the springs in the group are only carrying the static load of the share of the car body unit carried by that truck. The truck is at rest on level track with no gradient and no cross-elevation. The "loaded" height is the at-rest height under the same conditions except the railroad car is at its full capacity. The "solid" height is the spring height at which the spring group can no longer compress, as the coils have bottomed out on themselves. The normal displacement range of the spring group, which can be referred to as the "live load" displacement, is taken as being the range of static displacement between the "empty" and "loaded" conditions. It is considered the "live load" displacement as it pertains to that portion of displacement that arises from the lading (i.e., the "live load", as opposed to the "dead load" or "dead weight" of the rail car body unit itself. The "reserve travel" range is the available displacement distance between the "loaded" condition and the "solid" condition.

Another distance, or set of displacements, relates to the initial compression, or pre-load, in the springs that occurs between the free height at installation and the height at the "empty" condition. Since the free height differs for the various springs, the compression deflection to the "empty" condition may be unequal, such that the ratio of force in the spring coils at the empty height is not necessarily proportional to their spring rates. In some instances, the free height of a particular size of spring may be less than the "empty" height of the spring group as a whole. Accordingly, such springs do not then influence the ratio of forces or the instantaneous spring rate at that height. The various damper coils may have nested inner and outer coils, and the various main spring groups may also have various nested inner and outer coils. The "empty" condition usually occurs at a height that is lower than the free height of at least one component of the main spring coils. That is, while there may be an outer coil, a nested inner coil, and a further nested inner coil, all of those coils may not be compressed at the "empty" height. The coils are nested such that the longest coil in any main spring coil nesting of coils may have a free height that is taller than the "empty" height of the spring group. A corollary of this feature is that the spring rate of the suspension may change as the spring groups become more deeply deflected, and the ratio of the force exerted by the damper springs relative to the main springs (and therefore to the total spring force at any height of deflection) may change over the operating range of the spring group.

The Applicant has developed a self-steering three-piece truck, having the various features identified in respect of truck 160 for service with stand-alone single unit railroad cars of "110 Ton" capacity, running on 36 inch wheels. "110 Ton" trucks are used on "stand alone" railway cars having maximum permissible GLR of 286,000 lbs, or 143,000 lbs per truck. Suspension features for the "110 Ton" truck are shown in Table 1, Part 1 and in FIG. 11*a*.

The arrangements of the spring groups are indicated in Table 1 Part 1. For comparison, parameters of two known trucks (Barber S2C 70 Ton and Barber S2HD 125 Ton) are shown in Table 1 Part 2. The properties of the springs pertinent to the spring groupings in Table 1 Part 1 are given in Table 2a (main springs) and 2b (side springs). In Table 1 Parts 1 and 2, the first rows indicate the type, number and layout of the springs in the spring group. The Main Spring entry shows the number of springs, followed by spring type. For example, the 125 Ton truck for an articulated Car, has 5 springs of the D4 Outer type, 5 springs of the D5 Inner type, nested inside the D4 Outers, and 5 springs of the D6A Inner-Inner type, nested within the D5 Inners. It also has 4 side springs of the B354 Outer type, and 4 springs of the B353 Inner type nested inside the B354 Outers. The use of 4 side spring coils confirms that it is a four-cornered damper arrangement. Reference may be made to the following parameters:

$k_{empty}$ refers to the overall spring rate of the group in lbs/in for a light (i.e., empty) car.

$k_{total}$ refers to the spring rate of the group in lbs/in., in the fully laded condition.

"Solid" refers to the limit, in lbs, when the springs are compressed to the solid condition $H_{Empty}$ refers to the height of the springs in the at rest light car condition $H_{Loaded}$ refers to the height of the springs in the at rest fully loaded condition kw refers to the overall spring rate of the springs under the dampers.

$kw/k_t$ gives the ratio of the spring rate of the springs under the dampers to the total spring rate of the group, in the loaded condition, as a percentage.

The wedge angle is the primary angle of the wedge, expressed in degrees.

$F_D$ is the friction force on the side frame column. It is given in the upward and downward directions, with the last row giving the total when the upward and downward amounts are added together.

The Applicant has also developed a "70 Ton" truck for use with a form of stand alone "70 Ton" cars. The features of its spring groups are also shown in Table 1 and graphically in FIG. 11*b*. This truck is for use in a car that has "70 Ton" trucks at both ends, and in which the loading history of both trucks is the same in terms of vertical static and dynamic loads, vertical changes in track stiffness, lateral perturbations, white noise random loading and so on.

Additionally, however, the Inventor has developed "70 Ton" multi-unit end trucks 28, 30 and "125 Ton" shared trucks 32, 34 used as shared trucks and ends trucks, respectively, in multi-unit articulated railroad freight cars, such as intermodal well car three-pack and five-pack cars of FIGS. 1*a*, 1*b*, 2*a* and 2*b*. The parameters of the suspensions of these cars are indicated in Table 1 and shown graphically in FIGS. 11*e* and 11*d* respectively.

Multi-unit articulated railroad cars have presented a ride quality challenge for some time. There has been a long-felt, unmet, desire in the industry to overcome those challenges. In the context of a multi-unit articulated freight car, such as shown and described herein, the loading of the end trucks 28, 30 differs from the loading of the shared trucks 32, 34, not merely in magnitude but also in its modal nature. It is not merely that the static load on shared trucks 32, 34 must carry the combined weight of portions of two car body units rather than one. It is that the dominant dynamic loading regimes are surprisingly different. In each case, the difference in dynamic loading envelope means that the process of establishing the bearing adapter, spring set and damper wedge parameter combinations will be a function of the degrees of freedom particular to that truck, and also a function of the influence of loading in the various degrees of freedom carried along the car body in co-operation with the other trucks. This process tends to be quite subtle, particularly in respect of responses to shared interaction.

At present, there are not thought to be any multi-unit articulated railroad cars in use in North America that employ four-cornered self-steering trucks at either the shared truck or end truck locations. At present in multi-unit articulated railroad cars in North America the "125 Ton" trucks used as shared trucks are types that were approved for service prior to the introduction of AAR Standard M-976. None of those existing types is a four-cornered self-steering truck and none of the existing approved types meets the M-976 criteria. Performance parameters for the Barber 70 Ton S2C trucks used as end trucks in existing three-packs are provided in Table 1, Part 2. These are non-self-steering trucks with single dampers (as opposed to the double-damper, four-cornered arrangements discussed herein). Performance data for the Barber 125 Ton S2HD trucks used as shared trucks in existing three-packs are also indicated in Table 1, Part 2. Once again, these are non-self-steering, single damper trucks. Moreover, although there may be as many as 100,000 three-pack or five-pack articulated railroad cars, such as multi-unit articulated intermodal well cars, in North America, at present none is approved by the AAR for general interchange service. Rather, in view of their use of "125 Ton" shared trucks, they are limited to use in "captive service". "Captive service" is use limited to designated rail lines of a particular railroad where the rail line itself—including its roadbed, bridges, tunnels and other fixed structure—has been built to a standard to host rail cars having "125 Ton" trucks. Nonetheless, there are multi-unit articulated intermodal railroad cars that operate in "captive service" but that are also selectively interchanged by agreement with other railroads that also operate them in "captive service" on specific mating rail lines built to a corresponding standard.

Similarly, as far as known, none of the existing pre-M-976 multi-unit articulated railroad cars have "70 Ton" end trucks that would pass, or have passed, the AAR M-976 standard whether in multi-unit or other railroad car applications. End trucks tend to have the most challenging difficulties when operated at high speed in the "light car", i.e., empty, condition. They appear to tend to struggle with insufficient warp stiffness. One factor is that the currently approved trucks are single damper trucks (i.e., they have a single damper wedge mounted over each of the end coils of the middle row of springs) as opposed to doubled-damper arrangements as in the various four-cornered damper arrangements of truck 160 herein.

However, a second aspect of the end truck ride quality issue appears to be that the ratio of vertical loading in the light car condition to vertical loading in the fully loaded condition is quite small in end trucks. In the past, one way to obtain a "70 Ton" truck was to start with a 100 Ton truck for a stand-alone car, and to soften the spring groups to yield a "70 Ton" truck for a multi-unit car. That is, the side frames and truck bolsters might be 100 Ton castings, but the spring groups would be reduced. However, although the multi-unit articulated well cars may only be used in captive service, even in that captive service they are expected to be able to couple to cars that are used in interchange service. A condition for that coupling is that the static height difference between the light car and fully loaded car conditions must not exceed 2⅜" for coupling to cars used in interchange service. This means that the spring rate of the "70 Ton" multi-unit cars will be softer than the "110 Ton" cars.

One consequence is that in the light car condition, the weight carried on the damper springs (also referred to as "side springs" in the industry) may be reduced, so the energizing force driving the dampers to act against the side frame columns tends to be soft or low. As such, the warp stiffness of the end trucks tends also to be reduced. That is, even a four-cornered damper arrangement still needs enough vertical force in the damper springs to give an adequate restorative moment to yield suitable warp resilience. Moreover, the truck may tend to sit lower than before. Further still, unlike the damping influence of the adjacent car body interface at a shared truck, the end trucks tend to be at a free end given that there is little or no rotational moderating influence passed across the releasable coupler connections, and even that connection is located at the end of the overhang of the draft sill at the coupler end. This combination of factors appears to make the end truck more prone to difficulties such as truck hunting.

Resistance to truck hunting tends to include two parts or aspects. The first concern is the ability of the truck flex to an out of square condition in response to input perturbations, and in that way to accommodate those perturbations. Second, once the truck has deflected resiliently to an out-of-square condition, it then has a restoring warp-resisting stiffness that resiliently urges the truck bolster and side frames to return to its un-deflected, square condition, as at its initial stationary equilibrium. It must neither be so stiff that the initial force and displacement transmissibility through the suspension is too high, nor so soft that it lacks an adequately robust restorative moment couple to return the truck firmly and promptly to square. It needs a combination, or balance, that is suitably stiff, and yet resiliently flexible.

In view of that challenge, as explained below, end trucks 28, 30 have relatively high damping for a 70 Ton truck, and a high ratio of damping spring force to main spring force in the light car or "empty" condition. The stand alone 70 Ton truck also has a high proportion of damping when empty in which the four main spring coils are not under load at rest. Moreover, nested damper spring coil pairs are used that having relatively long undeflected spring height as compared to the shorter main spring height. In the empty car condition, the proportion of the static load carried in the damper springs is higher than usual. E.g., in the 70 Ton end truck as in FIG. 11*c*, in the empty car condition the equilibrium force in the damper springs is roughly 7700-7750 lbs driving dampers having a 40 degree alpha angle, giving about 1750-1800 lbs of friction damping. Moreover, the pre-load damper spring deflection is about 1¼", i.e., roughly 40% of its travel compared to the live load deflection from empty to loaded of roughly 1⅝", (i.e., >80%) compared to the full solid deflection of 4⁷⁄₁₆" (i.e., more than ¼). The vertical force on the main springs is then about 1500 lbs, for a total vertical force of about 9200-9250 lbs. At "empty" the static load in the dampers is more than 80% of the total static load. In some embodiments, it is about ⅚ of the total static vertical load on the end truck. In the loaded car condition, while the overall magnitude of damping force increases, the proportion of damping force to main spring vertical force shifts toward a higher proportion of main spring participation, as the relative need for damping force as a proportion of total load tends to diminish as the car sits down further on its springs under heavier load.

As with truck 160 generally, trucks 28, 30 are self-steering trucks. Additionally, however, the use of doubled dampers and a high proportion of damper springs as a proportion of the total spring rate. They have damper springs with a proportionately higher pre-load at the light car condition all tend to enhance the warp-stiffness of the truck in terms of providing an ability to return the truck to a squared condition after it has flexed to an out-of-square condition in response to track input forces. This can be expressed several ways. First, the proportion of damping in end trucks 28, 30 is higher in the empty condition than the stand alone 70 Ton truck. It is higher than in the 110 Ton benchmark truck. It is higher than in the 125 Ton shared truck.

Another challenge relates to entry of the car into spiral curving. Since the trailing intermediate bodies are initially still on tangent track, the influence of the side bearing loads of the trailing car bodies carried through the shared truck tends to urge the leading end car body unit to want to roll toward the outside of the curve. This tendency is increased as the weight of lading in the end car unit increases. It may be reduced where the loaded car height of the springs in the end truck is the same, or higher than, the corresponding spring height in the shared truck, such that the leading end of the end car tends to have a "nose up" condition. That is to say, the "nose" of an end car body unit is the coupler end. The term "nose up" means that, in a static condition, the spring height of the spring groups in the end truck is higher than the spring height of the spring groups in the shared truck at the inboard end of the end car body unit at the articulated connector by which it is joined to the next-adjacent car body unit. Whether or not a car body unit is "nose up" can also be assessed by measuring the static height at the longitudinal locations of the center plate bowl. That is to say, the truck center plate of the car body unit sits in the center plate bowl of the truck bolster. These bowls are now customarily 16 inches in diameter, and often have a polymeric liner which may be made of an UHMW polymer material, as in the 125 Ton shared trucks herein. In the past for 70 Ton cars a 14 inch diameter bowl was used. This discussion is based on using 16 inch bowls and liners. The end trucks may not have polymeric liners, and in an example as discussed herein trucks 28, 30 do not have polymeric liners, but rather have steel liners, such as manganese steel liners. A car body unit will be "nose up" if, in the at-rest loaded condition the height of the center plate bowl of the end truck is as high as or higher than the corresponding center plate bowl height of the shared truck. In this description, if the corresponding loaded, at rest, spring height of the end truck is greater than or equal to the loaded, at rest, spring height of the shared truck, then it will be understood that the center plate bowl is also at a height that is greater than or equal to the corresponding height of the center plate bowl of the shared truck.

Further, in vertical excitation, the coupler ends of the end car body units, and the end car body units more generally, tend to have greater displacement in the vertical bounce mode than at the relatively more restrained, typically more heavily laden, shared truck end. Conceptually, in this mode the coupler end of the end car body can be like the tail of a whip being cracked. In this mode it can be helpful to have a greater reserve travel between the static loaded and solid heights of the spring group. A corollary is an end truck having less vertical travel between the static empty and loaded conditions (i.e., "live load" deflection), as compared to the shared trucks; and a larger vertical reserve travel (i.e., the potential maximum deflection from "loaded" to "solid" under a dynamic load). Accordingly, as seen in Table 1 Part 1, Tables 2a and 2b and in FIG. 11*c*, the multi-unit articulated end trucks 28 and 30 have a ratio of live load deflection of roughly 1⅝", and a reserve deflection of roughly 1⁹⁄₁₆", giving a ratio of just over 1:1 (i.e., 26/25) whereas in the 110 Ton truck this ratio is about ³⁄₂, and in the 125 Ton shared truck it is about ⁷⁄₄. In the stand-alone 70 Ton truck, the ratio is roughly 2:1. In each case, the proportion of the range of reserve travel relative to the normal range of live load travel is higher for the articulated end trucks than for the other trucks (that proportion being the reciprocal of those relationships). The live load travel range of the 70 Ton multi-unit truck is substantially less than the other trucks, being roughly ⁴⁄₅ of the live load travel of the live load travel of the 110 Ton truck and 125 Ton Truck, and only about ⅔ of the 70 Ton stand-alone truck. Given the small live load travel, it follows that the range of reserve travel is correspondingly larger in the 70 Ton multi-unit end truck than in the 110 Ton truck or 125 Ton shared truck.

The 125 Ton shared truck tends not to be as prone to truck hunting in the light car condition because it always carries the combined weight of its share of two car bodies, and so tends to have a higher static load on the dampers in the light car condition. Additionally, it has the moderating damping effect of the influence of the adjacent car body. For the 125 Ton shared trucks, the introduction of self-steering may tend to ease wheel wear. The use of a greater proportion of the spring rate to drive the main springs rather than the damper springs may aid in addressing the higher vertical loading. That is, the spring rate suitable for carrying the higher vertical loads at the shared trucks may tend to be inappropriately stiff for the springing required under the dampers over the full range of motion of the dampers against the side frame columns. Accordingly, this leads to allocation of a higher proportion to the main springs, and to use of damper springs with relatively softer spring rates.

In that light, in the multi-unit articulated freight cars described herein, the shared trucks 32, 34 are larger capacity than the multi-unit end trucks, 28, 30. Moreover, in the embodiment described, the shared trucks are larger, i.e., have greater capacity than, the nominal benchmark "110 Ton" trucks. That is, they have a capacity of greater than 143,000 lbs. per truck. Similarly, end trucks 28, 30 are smaller than, and have a capacity that is less than, the benchmark "110 Ton" trucks, i.e., less than 143,000 lbs. In the embodiment of FIGS. 1*a* and 1*b*, shared trucks 32, 34 are "125 Ton" trucks, i.e., have a capacity of half of 315,000 lbs, or 157,500 lbs per truck. Similarly, end trucks 28, 30 are "70 Ton" multi-unit trucks having a capacity of half of 220,000 lbs, i.e., 110,000 lbs per truck. It may be noted that it is possible to build trucks of capacities other than 70 Ton, 100 Ton, 110 Ton or 125 Ton.

In the 110 Ton truck the three major dynamic components are, first, the geometric self-steering apparatus defined by the bearing adapter rockers; second, the spring groups between main bolster and the side frame baskets (i.e., the lower spring seats); and third, the dampers used in the bolster pockets of the main bolster. In one embodiment of the 70 Ton truck, such as end trucks 28, 30, the damper wedges and damper pockets can have the same geometry used in the 110 Ton truck (and in the 125 Ton Truck). The damper wedges have non-metallic friction surfaces for engaging the wear plates of the side frame columns. The damper wedges have a primary damper angle between 35 and 45 degrees, and in the embodiment shown the alpha angle is about 40 degrees. The bearing adapter rockers of the 70 Ton truck have a spherical male rocker and a planar female rocker. The male rocker has a smaller radius of curvature than a 110 Ton truck (and smaller than the 125 Ton truck). That is, whereas a 110 Ton truck has a nominal bearing adapter rocker radius of 40 inches (−0/+5), the 70 Ton stand alone truck and the 70 Ton multi-unit end truck have a nominal radius of 35 inches (−0/+5). Finally, the multi-unit 70 Ton truck has a softer spring group than the 110 Ton truck. That spring group may have a main vertical stiffness of 12,000-16,000 Lbs/in; a corner spring (or damper spring) stiffness of 1500-1600 Lbs/in per corner, and a total vertical stiffness rate of 18,000-22000 Lbs/in, accordingly. The 70 Ton multi-unit end truck spring group may include, and in the embodiment shown does include, the inner and outer damper springs identified in the tables as Q4MU700 and Q4MU701. The main springs are Q4MU70 springs.

End trucks 28, 30 may be, and in the embodiment illustrated are, trucks having the side frames and truck bolsters suitable for use in general purpose 70 Ton trucks. They are three-piece trucks applicable to 70 Ton truck applications, generally Smaller side frames can be used for low-profile 70 Ton truck used in autorack cars. In the examples shown, end trucks 28, 30 have 33 inch wheels on a 68 inch wheelbase, and use Class E (6×11) sealed roller journal bearings, with a bolster and side frames that fall within the AAR track profile envelopes. Like the 110 Ton truck it has four friction wedges in a "four-cornered" doubled-damper arrangement at each end of the bolster and includes a passive self-steering system that has a bearing adapter with a spherical crown and non-metallic guides in the form of elastomeric members 326. The main load does not pass through the guides which provide lateral and longitudinal centering of the bearing adapter relative to the pedestal jaws and pedestal roof, but rather passes through the steel-on-steel rolling point contact between the male and female rocker surfaces. The 70 Ton truck can have a manganese steel center plate bowl wear liner. The spring group arrangement is seen in Table 1. As can be seen in Table 1, and by comparing FIGS. 11*b* and 11*c*, end trucks 28 and 30 employed in multi-unit articulated railcar 20 have different spring groups from those of the 70 Ton stand alone truck.

By contrast, shared trucks 32, 34 may be, and as shown are, 125 Ton three-piece trucks applicable to 125 Ton truck applications. They have 38" wheels on a 72" wheelbase, and use (7×12) sealed roller journal bearings, with a bolster and side frames that fall within the AAR track profile envelopes. Like the benchmark 110 Ton truck it has four friction wedges at each end of the bolster in a four-cornered arrangement and has a passive self-steering system that has a bearing adapter with a spherical crown and non-metallic guides in the form of elastomeric members 326. The 125 Ton truck generally has a nylon (i.e., high density molecular weight polymer) center plate wear liner. The spring group arrangement is also seen in Table 1.

In the 125 Ton truck, the damper wedges and bolster pockets can be the same the 110 Ton truck. They have non-metallic friction surfaces that engage the side frame column wear plates, as before. The damper wedges have alpha angles between 35 and 45 deg., being about 40 deg. as shown. The bearing adapter rockers of the 125 Ton truck have a spherical male rocker and a planar female rocker. The male rocker has a larger radius of curvature than the benchmark 110 Ton truck. That is, while a 110 Ton truck has a nominal radius of 40" (−0/+5), the 125 Ton truck has a nominal radius of 50" (−0/+5) Finally, the 125 Ton truck has a stiffer spring group. It may have a main vertical stiffness of 22,000-24,000 Lbs/in; a corner spring (or damper spring) stiffness of 1800-2000 Lbs/in per corner, and a total vertical stiffness rate of 30,000-32000 Lbs/in, accordingly. The spring group may include, and in the embodiment shown does include, 5 D4-O Outer springs, 5 D5-I Inner Springs, 5 D6-A Inner-Inner springs. The corner damper springs include a B353 Outer Stabilizer spring and a B-354 Inner Stabilizer spring at each corner (i.e., a total of four of each). As can be noted, the 125 Ton shared truck has a lower ratio of solid capacity relative to live load (about 1.5) than either the 110 Ton benchmark truck (about 1.6) or the 70 Ton end truck (1.7-1.75) Similarly, the loaded spring height is lower than the 110 Ton truck. It is lower than the 70 Ton end truck, too. It has greater main spring travel to solid than the 110 Ton Truck and than the 70 Ton end truck. It has about the same live load deflection as the 100 Ton truck, but a shorter reserve travel range, and a shorter overall range. In effect, the shared truck is not at a coupler, and can "sit down" lower under its static load, particularly in the loaded condition, and have less of a tendency to wander such as it might have if less heavily loaded. The heavier loading tends to discourage truck hunting.

In the various embodiments of trucks herein, the gibs may be shown mounted to the bolster inboard and outboard of the wear plates on the side frame columns. In the embodiments shown herein, the clearance between the gibs and the side plates is desirably sufficient to permit a motion allowance of at least ¾" of lateral travel of the truck bolster relative to the wheels to either side of neutral, advantageously permits greater than 1 inch of travel to either side of neutral, and may permit travel in the range of about 1 or 1⅛" to about 1⅝ or 1 9/16" inches to either side of neutral.

The embodiments of trucks shown and described herein may vary in their suitability for different types of service. Truck performance can vary significantly based on the loading expected, the wheelbase, spring stiffnesses, spring layout, pendulum geometry, damper layout and damper geometry.

As noted above, the description provides a multi-unit articulated railroad freight car having articulated railroad freight car body units mounted on a symmetrical arrangement of self-steering trucks with rolling point contact rockers, in which the shared trucks are of greater rated capacity than the end trucks. The respective shared trucks and end trucks have four-cornered damper groups at each end of their respective truck bolsters, those damper groups having respective damper wedges that sit in bolster pockets and that engage those bolster pockets at a rolling point contact working point.

In the example, the shared trucks are swing motion trucks. Further, they are transomless swing motion trucks—i.e., they have neither transoms nor unsprung lateral cross-bracing rods. The end trucks are swing motion trucks and are also transomless. The rockers of the shared trucks have a larger male rocker radius of curvature than the rockers of the end trucks. The end trucks have the same damper wedges and damper wedge pockets as the shared trucks. The shared trucks are larger than 110 Ton trucks. The shared trucks are 125 Ton trucks. The end trucks are smaller than 110 Ton trucks. In the example, the end trucks are 70 Ton trucks. The shared trucks have a wheel diameter greater than 36 inches. In the example, the shared trucks have 38" diameter wheels. The end trucks have a wheel diameter smaller than 36 inches. The end trucks have a wheel diameter of 33". The self-steering rockers of the shared trucks have a male rocker radius of curvature greater than 40". The shared trucks have a male rocker radius of about 50 inches. The self-steering rockers of end trucks have a male rocker radius of less than 40 inches. In the example, that curvature that is about 35". In the example, the end car body units have male articulated connector portions that mate with an associated female articulated connector portion of the next adjacent intermediate car body unit to which they are connected.

Various embodiments of the invention have been described in detail. Since changes in and or additions to the above-described best mode may be made without departing from the nature, spirit or scope of the invention, the invention is not to be limited to those details but only by the appended claims.

TABLE 1

Railroad Car Truck Suspension Parameters - Part 1

| | 70 Ton Stand Alone | 70 Ton Articulated Car | 110 Ton | 125 Ton Articulated Car |
|---|---|---|---|---|
| Main | 4 * D4-O | 4 * Q4MU70 | 5 * D5-O | 5 * D4-O |
| Springs | 3 * D5-I | * | 5 * D6-I | 5 * D5-I |
| | * | * | 5 * D6A | 5 * D6A |
| Side | 4 * 17153A | 4 * Q4MU700 | 4 * B354 | 4 * B354 |
| Springs | 4 * 17153B | 4 * Q4MU701 | 4 * B353 | 4 * B353 |
| Sprung weight (lbs); | 6120 | 9220 | 10750 | 14550 |
| empty/loaded/solid | 51120 | 38695 | 67250 | 73500 |
| | 75009 | 66909 | 107063 | 108860 |
| Solid/$W_{Sprung}$ | 1.47 | 1.73 | 1.59 | 1.48 |
| Empty Height (in) | 9.9546 | 9.7497 | 10.1039 | 9.7843 |
| Loaded Height (in) | 7.6753 | 8.1215 | 7.9720 | 7.7190 |
| Main Springs Free-To-Solid (in) | 3.7500 | 3.3125 | 3.6875 | 3.7500 |
| Deflection - Side springs - Empty (in) | 0.7954 | 1.2503 | 1.3961 | 1.7157 |
| Deflection - Main Springs - Empty (in) | 0.3579 | 0.1253 | 0.1461 | 0.5282 |
| D Live load (in) | 2.2793 | 1.6282 | 2.1320 | 2.0653 |
| D Reserve (in) | 1.1128 | 1.5590 | 1.4095 | 1.1565 |
| D L + D R (in) | 3.3921 | 3.1872 | 3.5414 | 3.2218 |
| Stiffness (lbs/in) | 9545 | 18102 | 18952 | 13352 |
| Empty, $k_e$; Loaded $k_t$ | 21467 | 18102 | 28247 | 30574 |
| Wedge Spring Rate - $k_w$ (Lbs · in) | 6180 | 6180 | 7744 | 7744 |
| $k_{wedges}/k_{total}$ | 28.79% | 34.14% | 27.42% | 25.33% |
| Wedge angle (Deg) | 40 | 40 | 40 | 40 |
| μc/μs | 0.25/0.15 | 0.25/0.15 | 0.25/0.15 | 0.25/0.15 |
| Cf-down/Cf-up | 0.284/0.290 | 0.284/0.290 | 0.284/0.290 | 0.284/0.290 |
| F-Damping - lbs | 1754 | 1754 | 2198 | 2198 |
| (down)/(up)/(total) | 1793 | 1793 | 2247 | 2247 |
| | 3547 | 3547 | 4445 | 4445 |
| $F_n$ - empty (Hz) | 3.91 | 4.39 | 4.16 | 3.00 |
| $F_n$ - loaded (Hz) | 2.03 | 2.14 | 2.03 | 2.02 |

Table 1 Part 1—Lists the spring groups for four self-steering trucks with four-cornered damper arrangements.

TABLE 1

Railroad Car Truck Suspension Parameters - Part 2

| | S2C 70 Ton Multi-Unit | S2HD 125 Ton Multi-Unit |
|---|---|---|
| Main | 7 * D5-O | 7 * D5-O |
| Springs | * | 7 * D6-I |
| | * | 5 * D6A |
| Side | 2 * B433 | 2 * B354 |
| Springs | 2 * B432 | 2 * B353 |
| Sprung weight (lbs); | 9313 | 14721 |
| empty/loaded/solid | 38713 | 73521 |
| | 71555 | 114743 |
| Solid/$W_{Sprung}$ | 1.85 | 1.56 |
| Empty Height (in) | 9.8962 | 9.7801 |
| Loaded Height (in) | 8.3215 | 7.8650 |
| Main Springs Free-To-Solid (in) | 3.6875 | 3.6875 |
| Deflection - Side springs - Empty (in) | 1.4788 | 1.7199 |
| Deflection - Main Springs - Empty (in) | 0.3538 | 0.4699 |
| D Live load (in) | 1.5747 | 1.9151 |
| D Reserve (in) | 1.7590 | 1.3025 |
| D L + D R (in) | 3.3337 | 3.2176 |
| Stiffness (lbs/in) | 18670 | 29330 |
| Empty, $k_e$; Loaded $k_l$ | 18670 | 31648 |
| Wedge Spring Rate - $k_w$ (Lbs · in) | 2979 | 3872 |
| $k_{wedges}/k_{total}$ | 15.96% | 12.23% |
| Wedge angle (Deg) | 32 | 32 |
| μc/μs | 0.38/0.15 | 0.38/0.15 |
| Cf-down/Cf-up | 0.801/0.467 | 0.801/0.467 |
| F-Damping - lbs | 2386 | 3101 |
| (down)/(up)/(total) | 1391 | 1808 |
| | 3777 | 4909 |
| $F_n$ - empty (Hz) | 4.43 | 4.42 |
| $F_n$ - loaded (Hz) | 2.17 | 2.05 |

Table 1 Part 2—provides a listing of truck parameters for two known trucks.

TABLE 2a

Parameters of Main Spring Types

| Main Springs | Free Height (in) | Rate (lbs/in) | Solid Height (in) | Free to Solid (in) | Solid Capacity (lbs) | Diameter (in) | Wire (in) |
|---|---|---|---|---|---|---|---|
| D4-O Outer (AAR) | 10.9340 | 2973.3 | 7.8715 | 3.0625 | 9128 | 5.500 | 1.0000 |
| Q4MU70 (NSC) | 9.875 | 2980.0 | 6.5625 | 3.3125 | 9871 | 5.500 | 1.0000 |
| D5-O Outer (AAR) | 9.875 | 2241.6 | 6.5625 | 3.6875 | 8266 | 5.500 | 0.9531 |
| D5 - I Inner (AAR) | 10.3125 | 1121.6 | 6.5625 | 3.7500 | 4206 | 3.3750 | 0.6250 |
| D6 - I Inner (AAR) | 9.9375 | 1395.2 | 6.5625 | 3.3750 | 4709 | 3.4375 | 0.6563 |
| D6 - A Inner-Inner (AAR) | 9.0000 | 463.7 | 5.6875 | 3.3125 | 1536 | 2.0000 | 0.3750 |

TABLE 2b

Parameters of Side Spring Types

| Side Springs | Free Height (in) | Rate (lbs/in) | Solid Height (in) | Free to Solid (in) | Solid Capacity (lbs) | Diameter (in) | WireDia. (in) |
|---|---|---|---|---|---|---|---|
| B353 Outer (AAR) | 11.1875 | 1358.4 | 6.5625 | 4.6250 | 6283 | 4.8750 | 0.8125 |
| B354 Inner (AAR) | 11.5000 | 577.6 | 6.5625 | 4.9375 | 2852 | 3.1250 | 0.5313 |
| B432 Outer (AAR) | 11.0625 | 1030.4 | 6.5625 | 4.5000 | 4637 | 3.8750 | 0.6719 |
| B433 Inner (AAR) | 11.3750 | 459.2 | 6.5625 | 4.8125 | 2210 | 2.4063 | 0.4375 |
| 17153A Outer (NSC) | 10.7500 | 1338.0 | 6.5625 | 4.1875 | 5603 | 4.875 | 0.813 |
| 17153B Inner (NSC) | 10.7500 | 207.0 | 6.5625 | 4.1875 | 867 | 3.125 | 0.438 |

TABLE 2b-continued

| Parameters of Side Spring Types | | | | | | | |
|---|---|---|---|---|---|---|---|
| Side Springs | Free Height (in) | Rate (lbs/in) | Solid Height (in) | Free to Solid (in) | Solid Capacity (lbs) | Diameter (in) | WireDia. (in) |
| B49427-1 Outer | 11.3125 | 1359.0 | 6.5625 | 4.7500 | 6455 | 4.8750 | 0.8125 |
| Q4MU700 (NSC) | 11.0000 | 1338.0 | 6.5625 | 4.4375 | 5937 | 4.875 | 0.813 |
| Q4MU701 (NSC) | 11.0000 | 207.0 | 6.5625 | 4.4375 | 919 | 3.125 | 0.438 |

We claim:

1. A multi-unit articulated railroad freight car comprising:

a set of articulated car body units, said set of articulated car body units being carried upon a symmetrical arrangement of three-piece railroad car trucks;

said set of articulated car body units including first, second and third car body units, said first car body unit being a first end unit of said multi-unit articulated railroad freight car; said second car body unit being an intermediate unit of said freight car; said third body unit being a second end unit of said freight car; said first car body unit having a first end and a second end;

said first end of said first car body unit being connected to said second car body unit at a first shared truck; said second end of said first car body unit being distant from said first shared truck; and said second end of said first car body unit having a coupler operable to connect said multi-unit articulated railroad freight car to another freight car;

said second end of said first car body unit being carried on a first end truck;

said first shared truck having first and second spring groups;

said first shared truck having first and second four-cornered damper groups;

said first shared truck having rolling point contact rockers mounted at respective side frame to bearing adapter interfaces operable to permit said first shared truck to self-steer;

said first end truck having first and second spring groups;

said first end truck having first and second four-cornered damper groups;

said first end truck having rolling point contact rockers mounted at respective side frame to bearing adapter interfaces operable to permit said first end truck to self-steer;

said rolling point contact rockers of said shared truck having a first radius of curvature; said rolling point contact rockers of said end truck having a second radius of curvature; and said first radius of curvature being larger than said second radius of curvature.

2. The multi-unit articulated railroad freight car of claim 1 wherein:

said multi-unit articulated railroad freight car is a three-unit articulated railroad freight car;

said symmetrical arrangement of three-piece trucks including said first end truck, said first shared truck, a second shared truck, and a second end truck;

said second end unit being connected to said intermediate car body unit;

said second shared truck being located between said intermediate car body unit and said second end unit;

said second end truck being located under said second end unit at a location distant from said second shared truck;

said second shared truck being the same as said first shared truck; and said second end truck being the same as said first end truck.

3. The multi-unit articulated railroad freight car of claim 1 wherein said multi-unit articulated railroad freight car is an intermodal well car.

4. The multi-unit articulated railroad freight car of claim 1 wherein the respective four-cornered damper groups of said first end truck and said first shared truck include four respective dampers, each of said four dampers having an alpha angle and a beta angle, two of said dampers being left-handed, and two of said dampers being right-handed.

5. The multi-unit articulated freight car of claim 4 wherein said alpha angle and said beta angle of dampers of said first end truck are the same as said alpha angle and said beta angle of dampers of said first shared truck.

6. The multi-unit articulated railroad freight car of claim 4 wherein each of said dampers has a respective friction face that bears against a side frame column, and is mounted on a respective damper spring, the damper spring having a line of action lying in a datum plane of the damper, the datum plane being normal to said respective friction face; and, when said multi-unit articulated railroad freight car is at rest on level track, said damper has a working point located further from said friction face than is said line of action.

7. The multi-unit articulated railroad freight car of claim 6 wherein said friction face has a non-metallic friction pad mounted thereto.

8. The multi-unit articulated railroad freight car of claim 6 wherein said damper has a hypotenuse face, said line of action of said damper spring meets said hypotenuse face at an intersection point, and said working point lies within an inch of said intersection point when said multi-unit articulated railroad freight car is at rest on level track.

9. The multi-unit articulated railroad freight car of claim 6 wherein said respective damper has a hypotenuse face defining a working surface, said working surface has a spherical curvature, and said working point lies on said spherical curvature.

10. The multi-unit articulated railroad freight car of claim 9 wherein said spherical curvature has a radius of curvature, and said radius of curvature is 20 inches, +5/−0.

11. The multi-unit articulated railroad freight car of claim 9 wherein said dampers of said respective four-cornered damper arrangements of said first end truck have the same spherical curvature as said dampers of said respective four-cornered damper groups of said first shared truck.

12. The multi-unit articulated railroad freight car of claim 1 wherein said respective four-cornered damper group of said first end truck has the same damper geometry as the respective four-cornered damper group of said first shared truck.

13. The multi-unit articulated railroad freight car of claim 1 wherein said bearing adapters of said first end truck have respective ones of said rolling point contact rockers having a radius of curvature less than 45 inches.

14. The multi-unit articulated railroad freight car of claim 13 wherein said radius of curvature of said bearing adapters of said first end truck is approximately 35 inches.

15. The multi-unit articulated railroad freight car of claim 14 wherein said radius of curvature of said rolling contact rockers of said bearing adapters of said first shared truck are approximately 50 inches.

16. The multi-unit articulated railroad freight car of claim 1 wherein said bearing adapters of said first shared truck have respective ones of said rolling point contact rockers having a radius of curvature of said first shared truck is greater than 40 inches.

17. The multi-unit articulated railroad freight car of claim 1 wherein said first shared truck has a vertical spring rate $k_s$; said first end truck has a vertical spring rate $k_e$, $k_s$ is greater than $k_e$; and $k_s$ is less than twice $k_e$.

18. The multi-unit articulated railroad freight car of claim 1 wherein said first end truck is a 70 Ton truck and said first shared truck is a 125 Ton truck.

19. The multi-unit articulated railroad freight car of claim 1 wherein said multi-unit freight car has a symmetrical arrangement of said car body units.

20. A multi-unit articulated railroad freight car that has a set of articulated railroad freight car body units mounted on a symmetrical set of end trucks and shared trucks;

the shared trucks being of greater rated capacity than the end trucks;

the end trucks and shared trucks having passive self-steering provided by rolling point contact rockers;

the respective shared trucks and end trucks having four-cornered damper groups at each end of their respective truck bolsters, those damper groups having respective damper wedges that sit in bolster pockets and that engage those bolster pockets at a rolling point contact working point;

the shared trucks and said end trucks are swing motion trucks;

the rolling point contact rockers of the bearing adapters of the shared trucks have a larger male rocker radius of curvature than the corresponding rolling point contact rockers of the bearing adapters of the end trucks;

the shared trucks are larger than 110 Ton trucks; the end trucks are smaller than 110 Ton trucks;

the shared trucks have a wheel diameter greater than 36 inches;

the end trucks have a wheel diameter that is smaller than 36 inches;

the self-steering rolling point contact rockers of the shared trucks have a male rocker radius of curvature greater than 40 inches; and the self-steering rolling point contact rockers of said first and second end trucks have a male rocker radius of curvature that is less than 45 inches.

21. The multi-unit articulated railroad freight car of claim 20 wherein:

the shared trucks are 125 Ton trucks and the end trucks are 70 Ton trucks;

the shared trucks have 38" diameter wheels and the end trucks have 33" wheels;

the self-steering rolling point contact rockers of the shared trucks have a male rocker radius of curvature of 50" and the self-steering rolling point contact rockers of end trucks have a male rocker radius of curvature of 35";

the dampers of the shared trucks and end trucks have the same alpha angle, of 40 degrees, and the same beta angle; and the dampers of the shared trucks and end trucks have working points that are set rearwardly and downslope of the centers of their respective damper springs.

* * * * *